US007284945B2

(12) United States Patent
Ikehata et al.

(10) Patent No.: US 7,284,945 B2
(45) Date of Patent: Oct. 23, 2007

(54) TRANSPORTING APPARATUS

(75) Inventors: Yoshiteru Ikehata, Shiga-ken (JP); Takayoshi Ono, Shiga-ken (JP); Yuichi Morimoto, Shiga-ken (JP)

(73) Assignee: Daifuku Co., Ltd., Osaka (JP)

( * ) Notice: Subject to any disclaimer, the term of this patent is extended or adjusted under 35 U.S.C. 154(b) by 414 days.

(21) Appl. No.: 10/928,301

(22) Filed: Aug. 27, 2004

(65) Prior Publication Data

US 2005/0067766 A1 Mar. 31, 2005

(30) Foreign Application Priority Data

Aug. 29, 2003 (JP) ..... 2003-307193
Nov. 14, 2003 (JP) ..... 2003-385469
Nov. 14, 2003 (JP) ..... 2003-385479
Dec. 16, 2003 (JP) ..... 2003-418069

(51) Int. Cl.
*B65G 35/00* (2006.01)

(52) U.S. Cl. ..... 414/676; 406/19; 406/77; 406/89

(58) Field of Classification Search ..... 414/676; 406/19, 77, 88, 89
See application file for complete search history.

(56) References Cited

U.S. PATENT DOCUMENTS 2,984,364 A * 5/1961 Lamb ..... 414/676
3,253,756 A * 5/1966 Haley et al. ..... 225/2
3,822,777 A * 7/1974 Jepsen ..... 198/370.07
4,355,940 A * 10/1982 Derickson ..... 414/439
4,842,125 A * 6/1989 Besemann ..... 198/457.03
4,944,635 A * 7/1990 Carlier et al. ..... 406/10
5,037,245 A * 8/1991 Smith ..... 406/88
5,248,236 A * 9/1993 Ooshima et al. ..... 414/676
5,570,977 A * 11/1996 Simkowski et al. ..... 406/88
6,676,365 B2 * 1/2004 Adam et al. ..... 406/83
7,004,711 B2 * 2/2006 Ikehata et al. ..... 414/676
7,108,474 B2 * 9/2006 Moriya et al. ..... 414/676
7,140,827 B2 * 11/2006 Ikehata et al. ..... 414/676
7,185,748 B2 * 3/2007 Malatesta ..... 193/8

FOREIGN PATENT DOCUMENTS

JP 2000-062951 2/2000
JP 2002-176091 12/2000
JP 2002-321820 11/2002

* cited by examiner

*Primary Examiner*—Joe Dillon, Jr.
(74) *Attorney, Agent, or Firm*—The Webb Law Firm

(57) ABSTRACT

The invention discloses a transporting apparatus provided with a air-supplying-type support device for supplying purified air toward a lower surface of a transported object to contactlessly support the transported object in a horizontal orientation or a substantially horizontal orientation, a drive force application device for applying a drive force in the transporting direction to the transported object, a first transport member, a second transport member, and a relay transport member that links the first transport member and the second transport member. The drive force application device applies a drive force by contacting a lower surface of the transported object that is supported by the air-supplying-type support device. The relay transport member changes at least one of the transporting direction and the transporting orientation of the transported object.

48 Claims, 57 Drawing Sheets

TRANSPORTING APPARATUS

BACKGROUND OF THE INVENTION

The present invention relates to transporting apparatuses provided with air-supplying-type support means for supplying purified air toward a lower surface of a transported object to contactlessly support the transported object, drive force application means for applying a drive force in the transporting direction to the transported object, a first transport member, a second transport member, and a relay transport member that links the first transport member and the second transport member.

Such transporting apparatuses are used for transporting objects such as glass substrates for liquid crystal displays, and in conventional transporting apparatuses, the drive force application means is configured for dual-side driving for applying a drive force to both end sides in the width direction, which is perpendicular to the transporting direction, of the transported object so as to transport the transported object in a horizontal orientation or a substantially horizontal orientation (for example, see JP 2002-321820A).

With such transporting apparatuses it was not possible to transport the transported object in a second transporting direction that intersects a first transporting direction.

A different conventional transporting apparatus for changing the transporting direction of the transported object is provided with a first transport member for transporting the transported object in a first direction, a second transport member for transporting the transported object in a second transporting direction that intersects the first transporting direction, and a relay transport member for switching the transporting direction of a transported object that has been transported to the transporting downstream side end portion of the first transport member from the first transporting direction to the second transporting direction to deliver the transported object to the transporting upstream side end portion of the second transport member (for example, see JP 2000-62951A).

This relay transport member is provided with a holding mechanism for holding the transported object, a rotational driving member for rotating the holding mechanism about a vertical shaft, and an air cylinder for raising and lowering the holding mechanism, and is configured so as to hold a transported object that has been transported to the transporting downstream side end portion of the first transport member with the holding mechanism, raise the holding mechanism with the air cylinder and rotate the holding mechanism about a vertical shaft with the rotational driving member to position the transported object above the second transport member, and then lower the holding mechanism with the air cylinder and change the transporting direction from the first transporting direction to the second transporting direction to deliver the transported object to the transporting upstream side end portion of the second transport member.

With this transporting apparatus, the relay transport member is provided with a holding mechanism, an air cylinder, and a rotational driving member, for example, and it is necessary to transport the transported object over mechanisms positioned on the downstream transport portion side in the width direction, making the structure complicated. Moreover, the transporting apparatus has a structure for moving an entire device for contactlessly supporting the transported object on a rail. With such devices there is a limit to the length of the tube for delivering the air that is supplied for contactlessly supporting the transported object, and thus are not suited for use on long transport routes.

SUMMARY OF THE INVENTION

It is an object of the present invention to provide a transporting apparatus provided with a drive force application means for applying drive force in a contacting manner to a transported object, and at the same time is capable of changing at least one of the transporting direction and transporting orientation of the transported object.

Consequently, a transporting apparatus of the present invention is provided with drive force application means for applying a drive force in the transporting direction to a transported object by contacting the lower surface of the transported object, which is supported by a air-supplying-type support means, a first transport member, a second transport member, and a relay transport member disposed at a position that links the first transport member and the second transport member, and the relay transport member is provided with means for changing at least one of the transporting direction and the transporting orientation of the transported object.

DETAILED DESCRIPTION OF PREFERRED EMBODIMENTS

Figure 1:
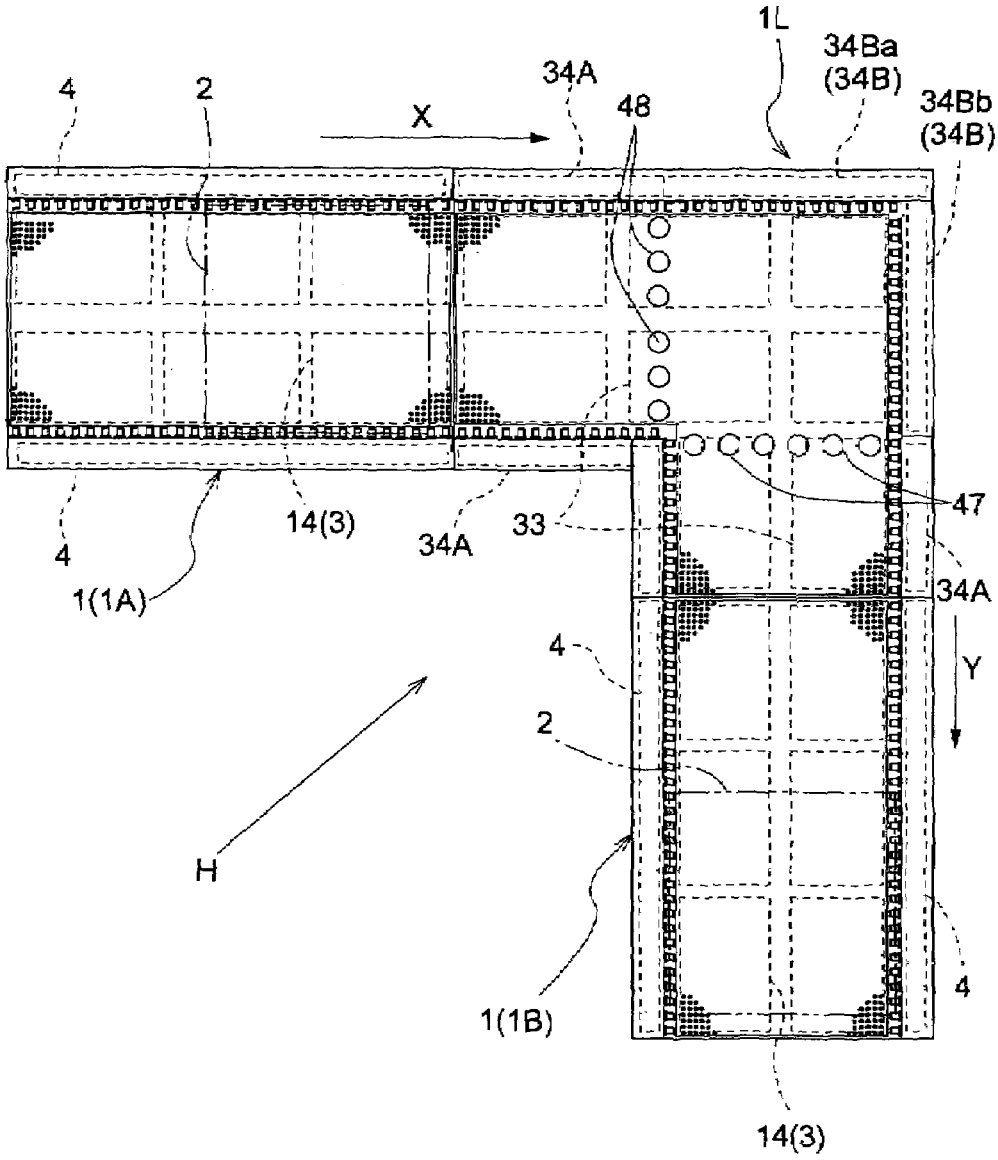
FIG. 1 is a plan view of the transporting apparatus according to the first embodiment.

Working examples of the present invention are described below with reference to the drawings. In the following plurality of embodiments, components having identical or similar structures are assigned identical reference numerals. Also, the features disclosed in one embodiment can be combined with the features disclosed in another embodiment so long as contradictions therebetween do not exit, and such combinations are also included within the scope of the present invention.

First Embodiment

As shown in FIG. 1, a transporting apparatus H transports a glass substrate 2, serving as a transported object, in a first transporting direction X, and during transporting, changes the transporting direction of the glass substrate 2 from the first transporting direction X to a second transporting direction Y that intersects the first transporting direction X, and then transports the glass substrate 2 in the second transporting direction Y.

That is, the transporting apparatus H is provided with a first transport member 1A on the upstream side having a plurality of transport units 1 and that transports the glass substrate 2 in the first transporting direction X, a second transport member 1B on the downstream side having a plurality of transport units 1 and that transports the glass substrate 2 in the second transporting direction Y, which perpendicularly intersects the first transporting direction X, and an L-shaped transport unit 1L (relay transport member) that changes the transporting direction of the glass substrate 2 received from the first transport member 1A by 90° from the first transporting direction X to the second transporting direction Y to deliver the glass substrate to the second transport member 1B.

Next, in order to transport a glass substrate 2 that has been placed on a transport unit 1 positioned on the transporting upstream side to a transport unit 1 positioned on the transporting downstream side via the L-shaped transport unit 1L, the transporting apparatus H supports the glass substrate 2 with a air-supplying-type support means 3 and an L-shaped air-supplying-type support means 33 while applying a drive force thereto through a drive force application means 4 and an L-shaped drive force application means 34 to transport the glass substrate 2 from the transporting upstream side toward the transporting downstream side.

Figure 2:
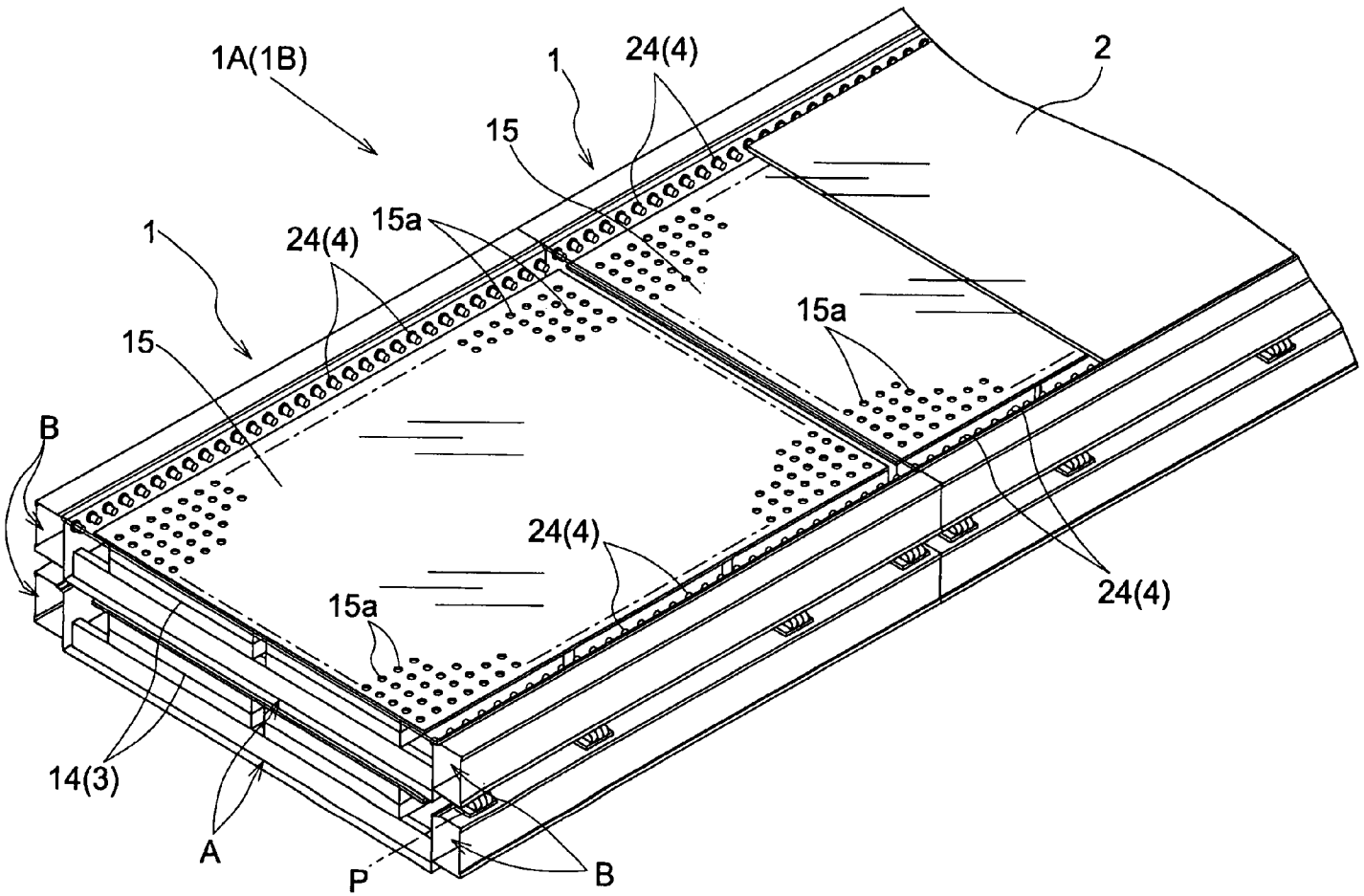
FIG. 2 is a perspective view of the first transport member according to the first embodiment.
Figure 3:
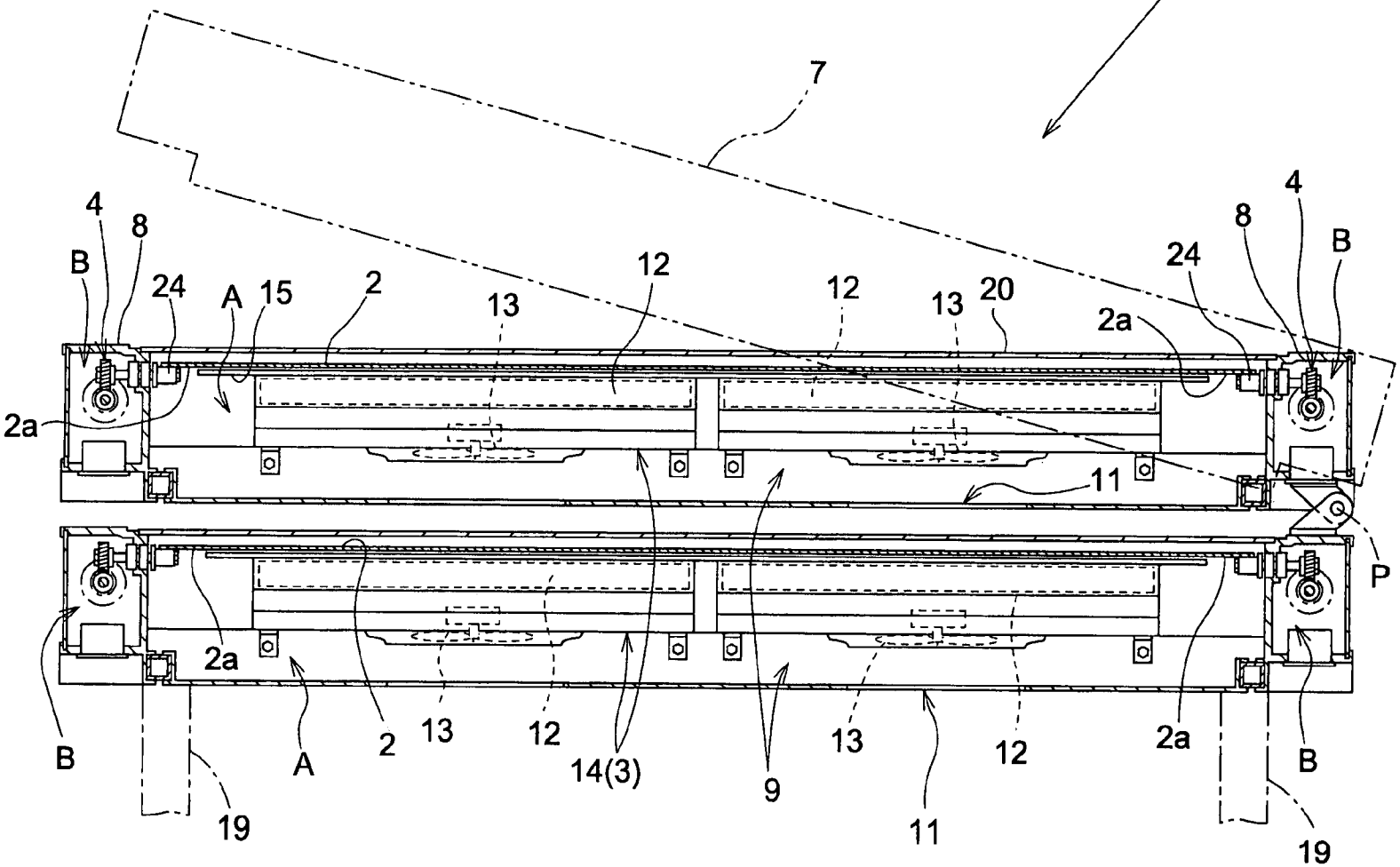
FIG. 3 is a front sectional view of the transport units according to the first embodiment.

As shown in FIG. 2, the transport units 1 are disposed in two stages, an upper stage and a lower stage, and are lined up in the transporting direction of the glass substrate 2. The first transport member 1A and the second transport member 1B are both made of a plurality of transport units 1 provided lined up in the transporting direction. As shown in FIG. 3, each transport unit 1 is provided with air-supplying-type support means 3 for supplying purified air toward a lower surface 2*a* of the glass substrate 2 to contactlessly support the glass substrate 2 in a substantially horizontal orientation, drive force application means 4 for applying a drive force in the transporting direction to the glass substrate 2, which is supported by the air-supplying-type support means 3, and a casing member 7 in which the air-supplying-type support means 3 and the drive force application means 4 are accommodated. It should be noted that the transport units 1 are supported in a horizontal manner by a horizontal support frame 19. Also, the upstream transport units 1 can freely swing about a transverse shaft P in the first transporting direction X in the case of the first transport member 1A and in the second transporting direction Y in the case of the second transporting direction 1B.

Figure 4:
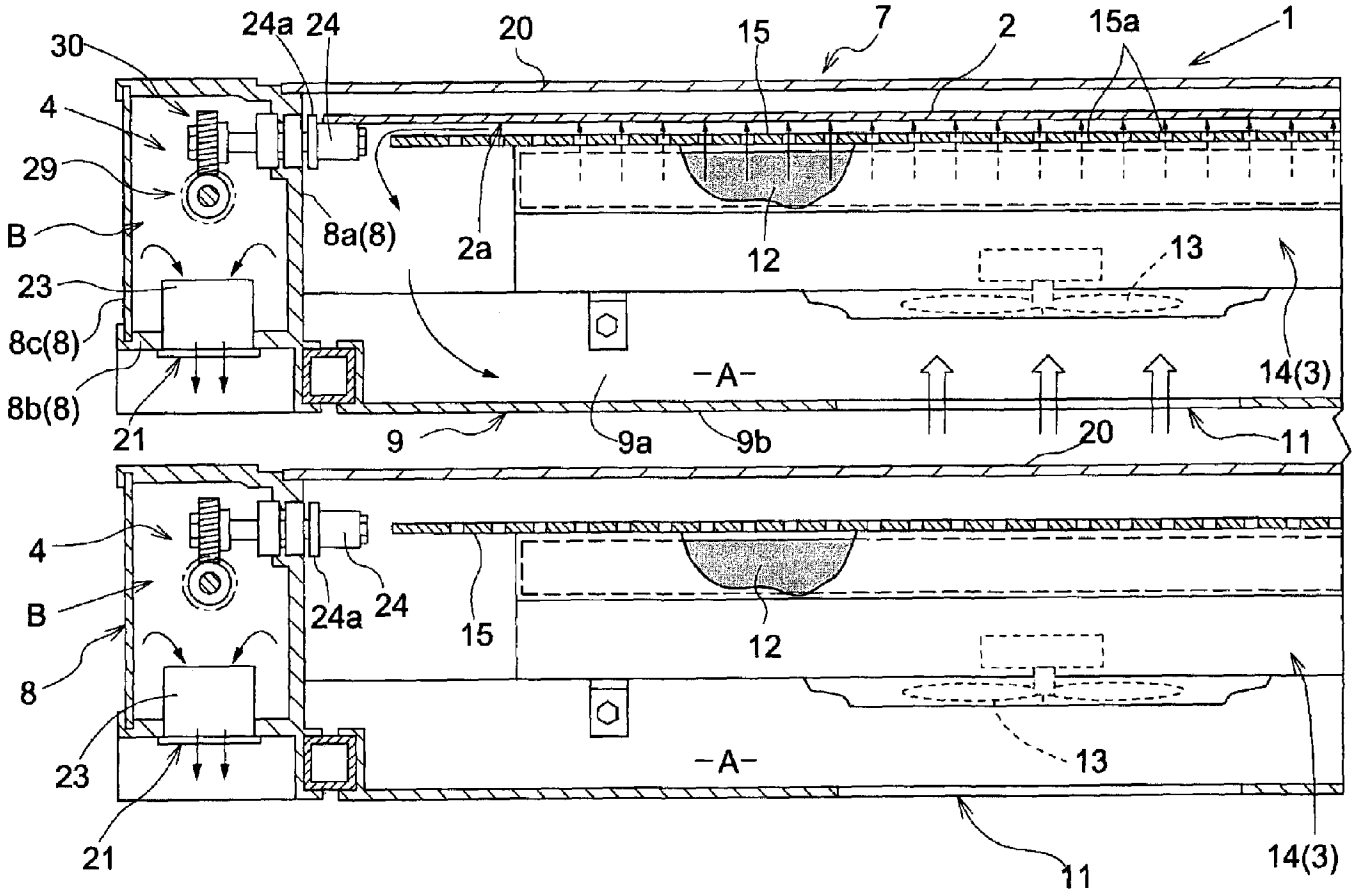
FIG. 4 is a partially magnified view of a front cross section of the transport units according to the first embodiment.

As shown in FIG. 3 and FIG. 4, the casing member 7 is provided with a unit frame member 9 that is substantially elongate in a plan view and that is for supporting the air-supplying-type support means 3 resting thereon, accommodation frames 8 provided in the transporting direction on both sides in the width direction of the unit frame member 9, and a transport cover 20 provided spanning between the upper end portion of both accommodation frames 8.

As shown in FIG. 4, the accommodation frames 8 have the shape of a rectangular cylinder when viewed in the transporting direction, and include an accommodation cover 8*c* that can be opened and closed that is on the side opposite the side of an inner wall 8*a* linked to the unit frame member 9. The unit frame member 9, the accommodation frames 8, and the transport cover 20 together define a transport space A, an accommodation space B is formed within each accommodation frame 8. The unit frame member 9 has a support frame portion 9*a* that incorporates a frame member and a plate-shaped frame portion 9*b* that is a substantially elongate plate-shaped member positioned below the support frame portion 9*a* and that is provided with air introduction openings 11 for introducing outside air into the transport space A. On a lower wall 8*b* of the accommodation frames 8 are provided an outside discharge opening 21 for discharging air within the accommodation space B to the outside and a sub-blowing unit 23 having a blowing function and a dust removal function that is provided such that it blocks the outside discharge opening 21. The air within the accommodation space B is discharged to the outside by the sub-blowing unit 23.

Figure 5:
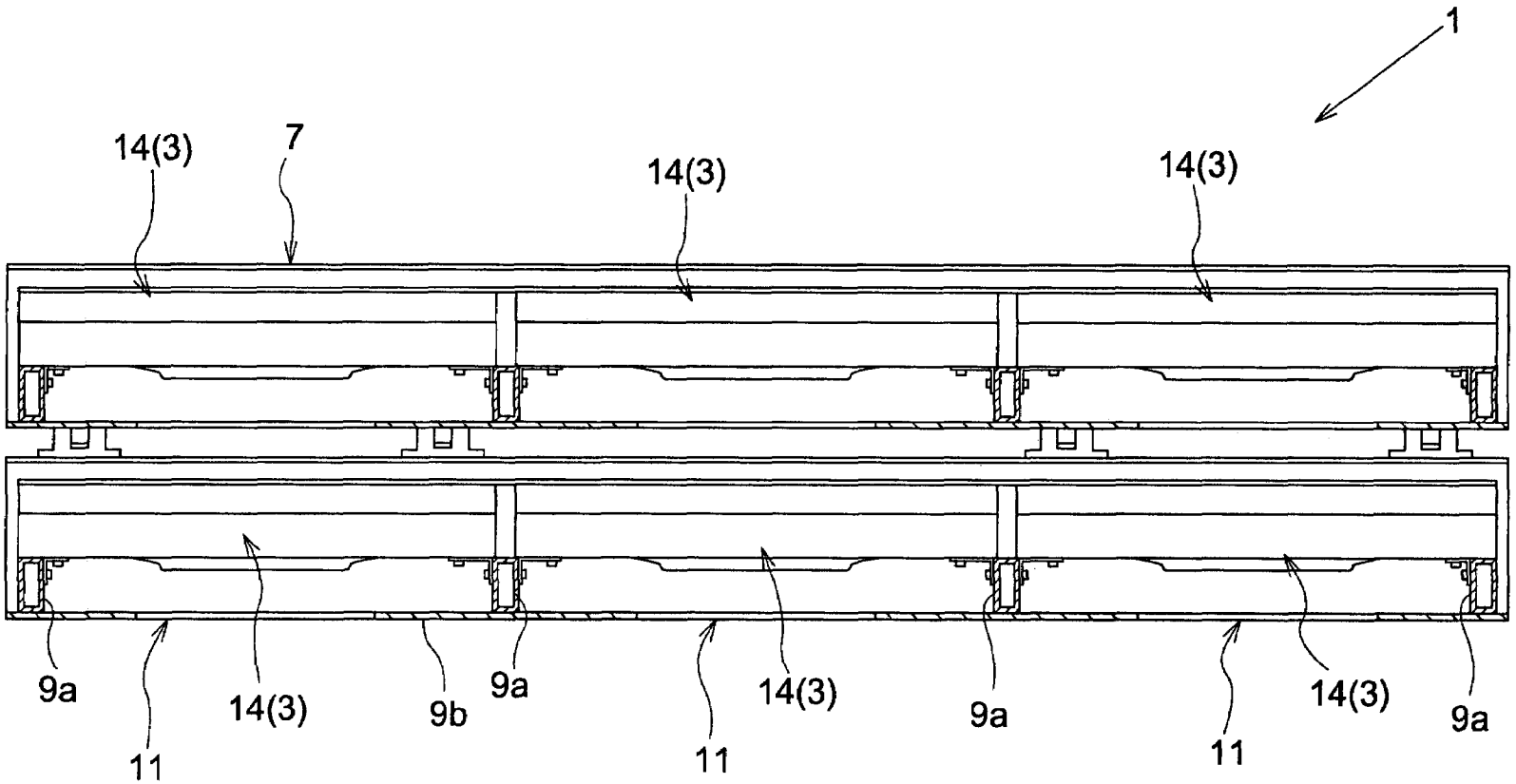
FIG. 5 is a lateral sectional view of the transport units according to the first embodiment.
Figure 6:
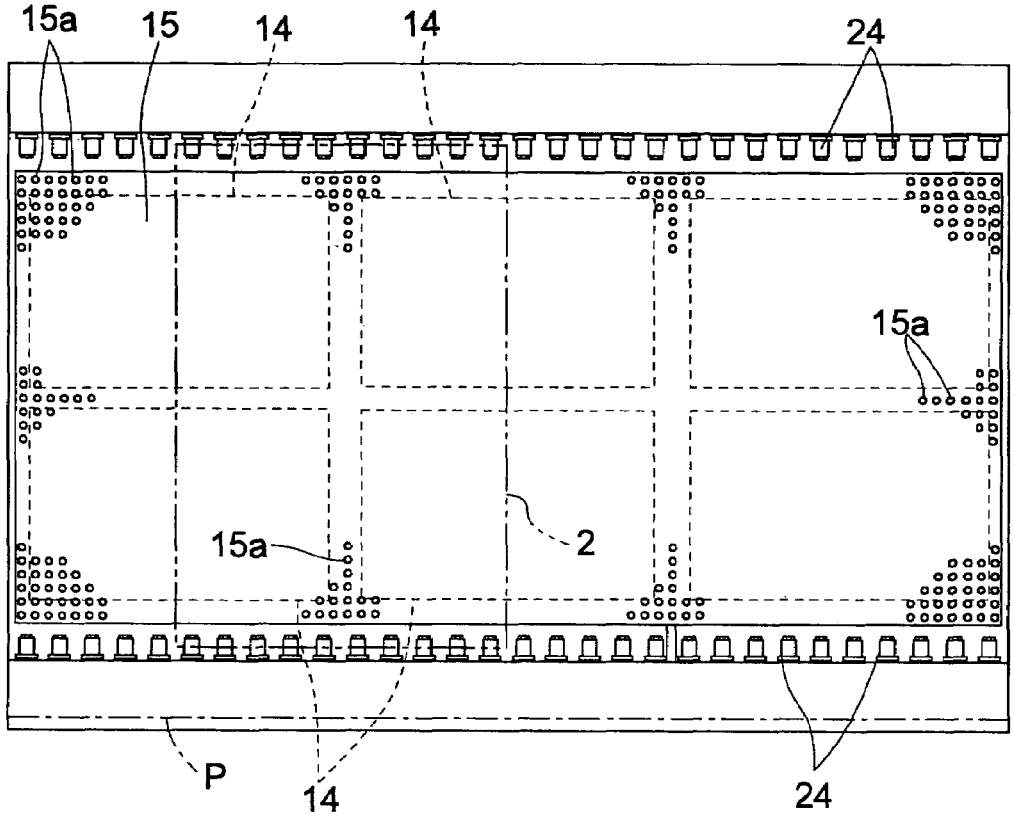
FIG. 6 is a plan view of the transport units according to the first embodiment.

As shown in FIGS. 3 to 5, the air-supplying-type support means 3 is provided in the transport space A in the transport units 1, and has fan filter units 14, in which a dust removal filter 12 for removing dust and a blower fan 13 serving as air-supplying means for supplying purified air toward the lower surface 2*a* of the glass substrate 2 through the dust removal filter 12 are incorporated into a single unit via a housing, are lined up in the transporting direction and in the width direction, which is perpendicular to the transporting direction. As shown in FIG. 6, two fan filter units 14 lined up in the width direction are lined up in three rows in the transporting direction for a total of six fan filter units 14 provided in the air-supplying-type support means 3.

To describe the air-supplying-type support means 3 in more detail, as shown in FIGS. 3 to 5, the fan-filter units 14 are made by integrally combining a single blower fan 13 and a single dust-removal filter 12 covering the area above the blower fan 13. An air rectifying plate (porous plate) 15 that is positioned on above the fan filter units 14 and that is for rectifying the purified air that is supplied to the lower surface 2*a* of the glass substrate 2 is provided covering the area above the six fan filter units 14 as shown in FIG. 1 and FIG. 5. That is, the air-supplying-type support means 3 has six fan filter units 14 and a single air rectifying plate 15. Here, air rectification means dispersing wind from the blower fans 13 over a wide range to deliver a substantially uniform air amount to transported objects.

The blower fans 13 are driven by electric motors. The air rectifying plate 15 is provided with through holes 15*a* formed by a punching press at spots located directly above the fan filter units. Also, the six blower fans 13 provided in the air-supplying-type support means 3 are configured such that they are driven at the same rotation velocity, and the amount of purified air that is supplied to the lower surface 2*a* of the glass substrate 2 through the air rectifying plate 15 is substantially the same amount in both the transporting direction and the width direction.

Figure 8:
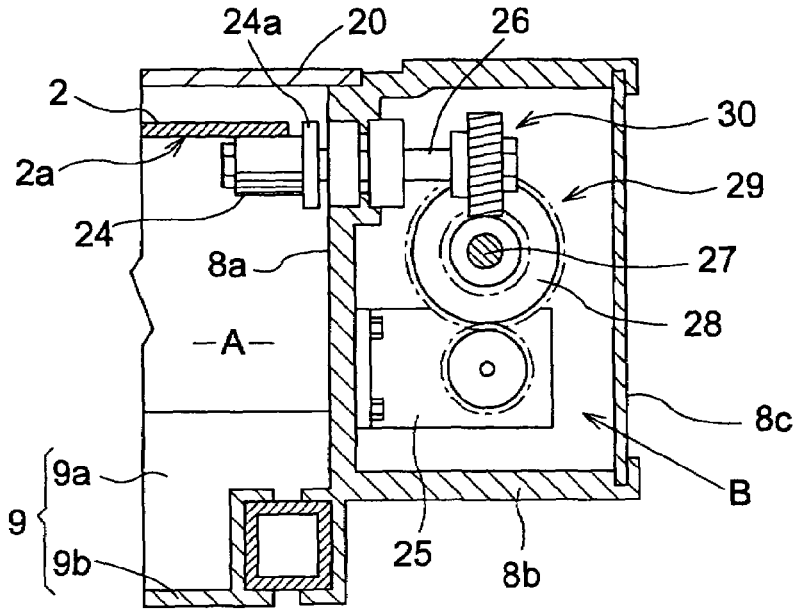
FIG. 8 is a front sectional view of the drive force application means according to the first embodiment.

The drive force application means 4 is described next. As shown in FIG. 3, the drive force application means 4 for applying a drive force in the transporting direction to the glass substrate 2 is for dual-side driving and applies a drive force to both end portions in the width direction of the glass substrate 2. The drive force application means 4 is provided with drive rollers 24 as contact-type drive portions for applying drive force to support the lower surface 2*a* of the glass substrate 2 in a contacting manner. As shown in FIG. 4 and FIG. 8, the drive rollers 24 are provided with a large diameter portion 24*a* serving as a stop portion that abuts against the lateral surface of both end portions in the width direction of the glass substrate 2 in order to stop the glass substrate 2 from moving in the width direction.

Figure 7:
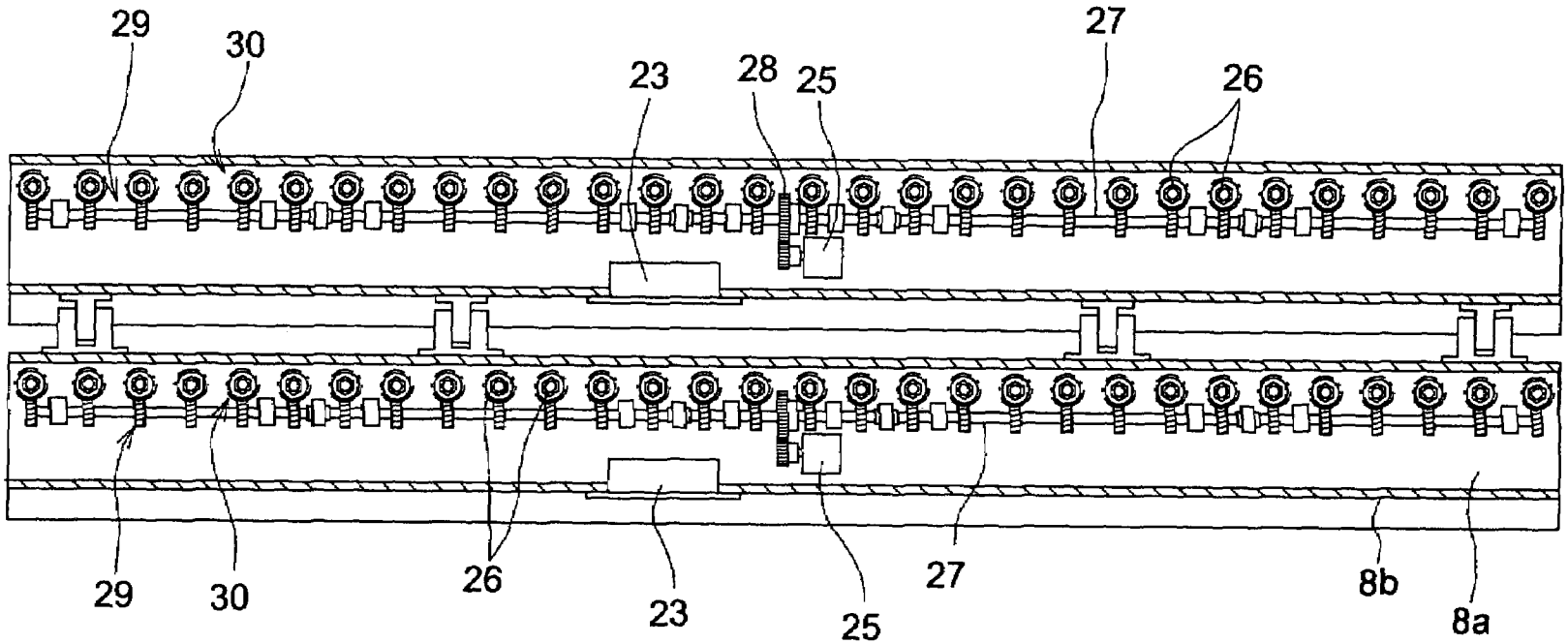
FIG. 7 is a sectional view of the accommodation frame according to the first embodiment.
Figure 9:
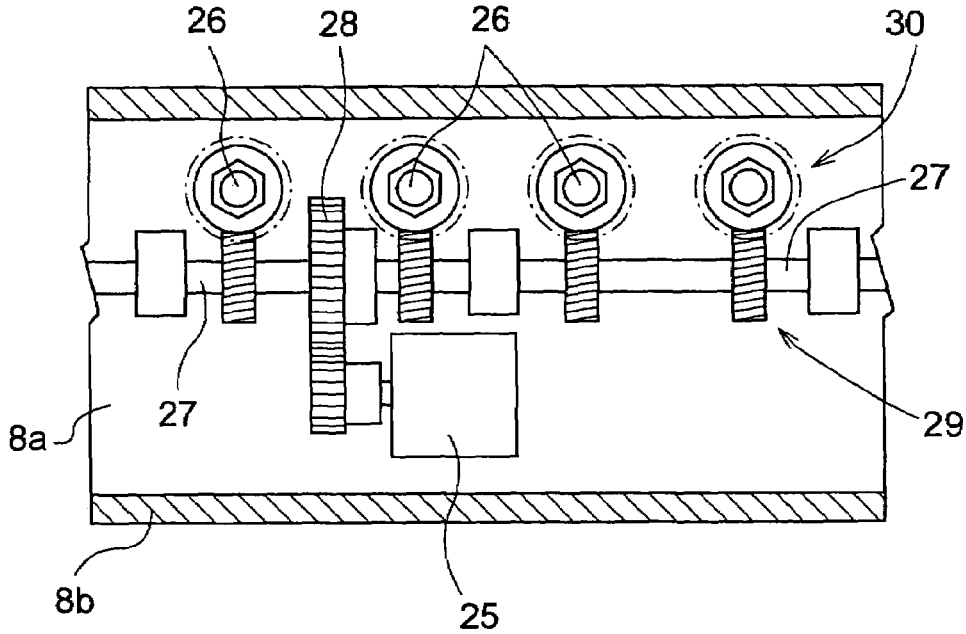
FIG. 9 is a partially magnified lateral view of the drive force application means according to the first embodiment.

To provide a more detailed description, a drive force application means 4 is provided in each of the pair of accommodation frames 8. As shown in FIGS. 7 to 9, each drive force application means 4 is provided with an electric motor 25, a power transmission shaft 27 provided with a spur gear 28 that meshes with the output gear of the electric motor 25, and numerous output shafts 26 provided with an input gear 30 that meshes with an output gear 29 provided on the power transmission shaft 27. Also, the electric motor 25 and the power transmission shaft 27 are provided within the accommodation spaces B, and the output shafts 26 are rotatively supported on the inner wall 8*a* in such a manner that each projects toward the accommodation space B and the transport space A. The input gears 30 are provided at portions where the output shafts 26 project into the accommodation space B, and the drive rollers 24 are provided at portions where the output shafts 26 project into the transport space A.

Consequently, in the air-supplying-type support means 3, the air sucked in from below the blower fans 13 is then sent through the dust removal filters 12 and supplied to the lower surface 2*a* of the glass substrate 2 as purified air after passing through the through holes 15*a* of the air rectifying plate 15 due to the action of the blower fans 13, supporting substantially the entire area of the lower surface 2*a* of the glass substrate 2 through this purified air that has been supplied. Also, the drive force application means 4 supports the lower surface of both end portions in the width direction of the glass substrate 2 in a contacting manner with the drive rollers 24. The drive rollers 24 supporting the glass substrate 2 in a contacting manner are rotatively driven by the electric motor 25 and apply a drive force in the transporting direction to both end portions in the width direction of the glass substrate 2, thereby transporting the glass substrate 2.

Figure 10:
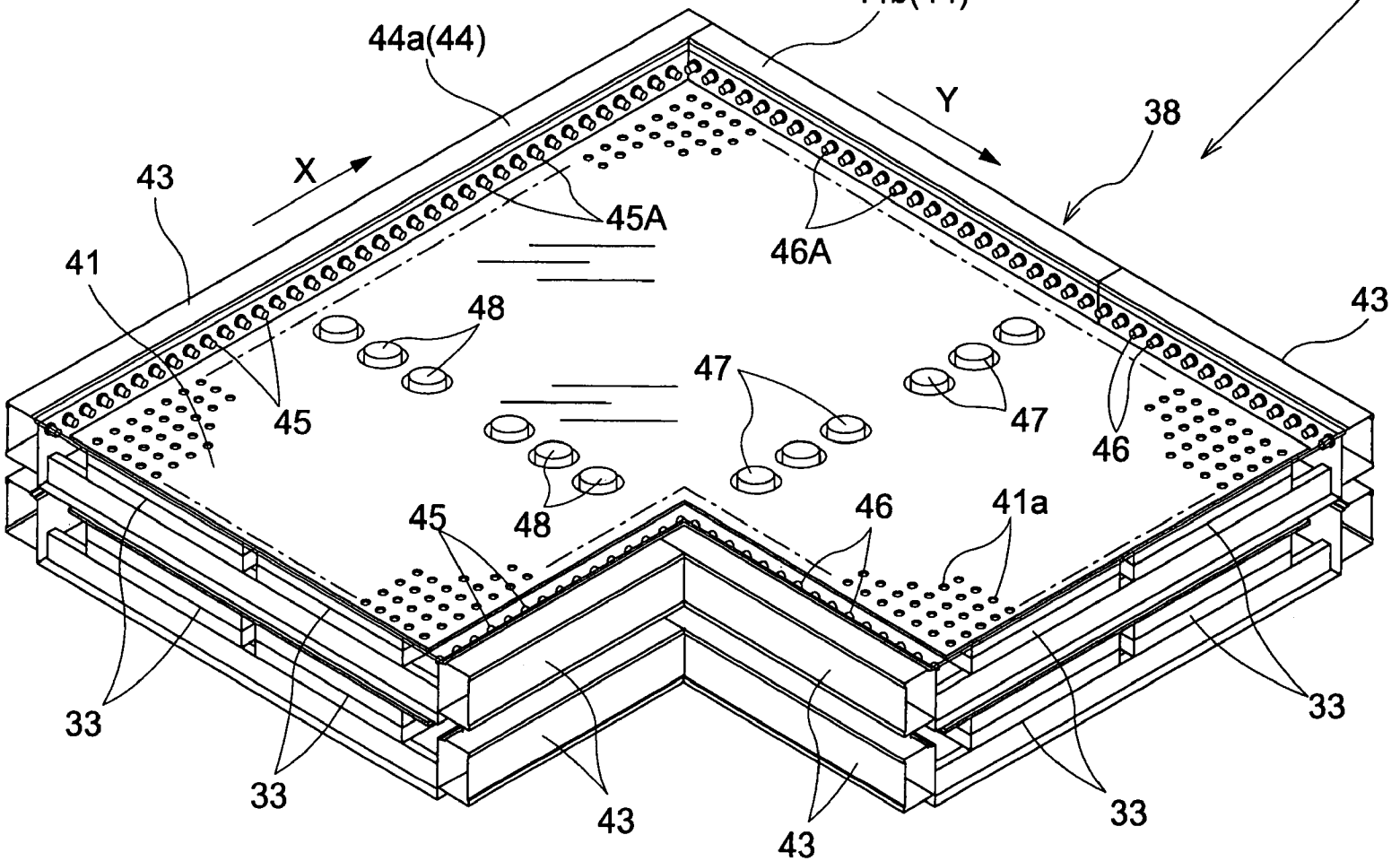
FIG. 10 is a perspective view of the L-shaped transport unit according to the first embodiment.
Figure 11:
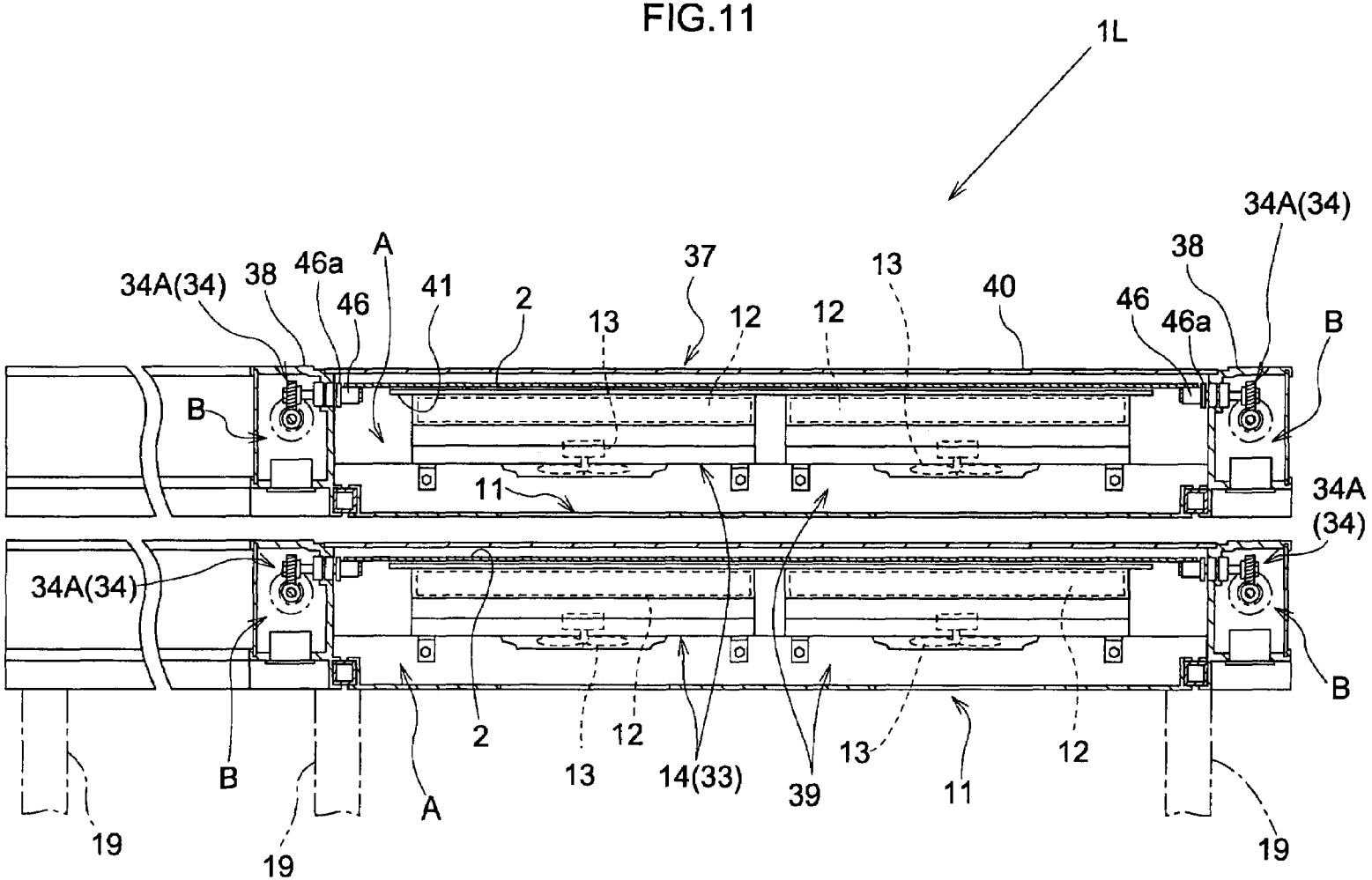
FIG. 11 is a right side view of the L-shaped transport unit according to the first embodiment.
Figure 13:
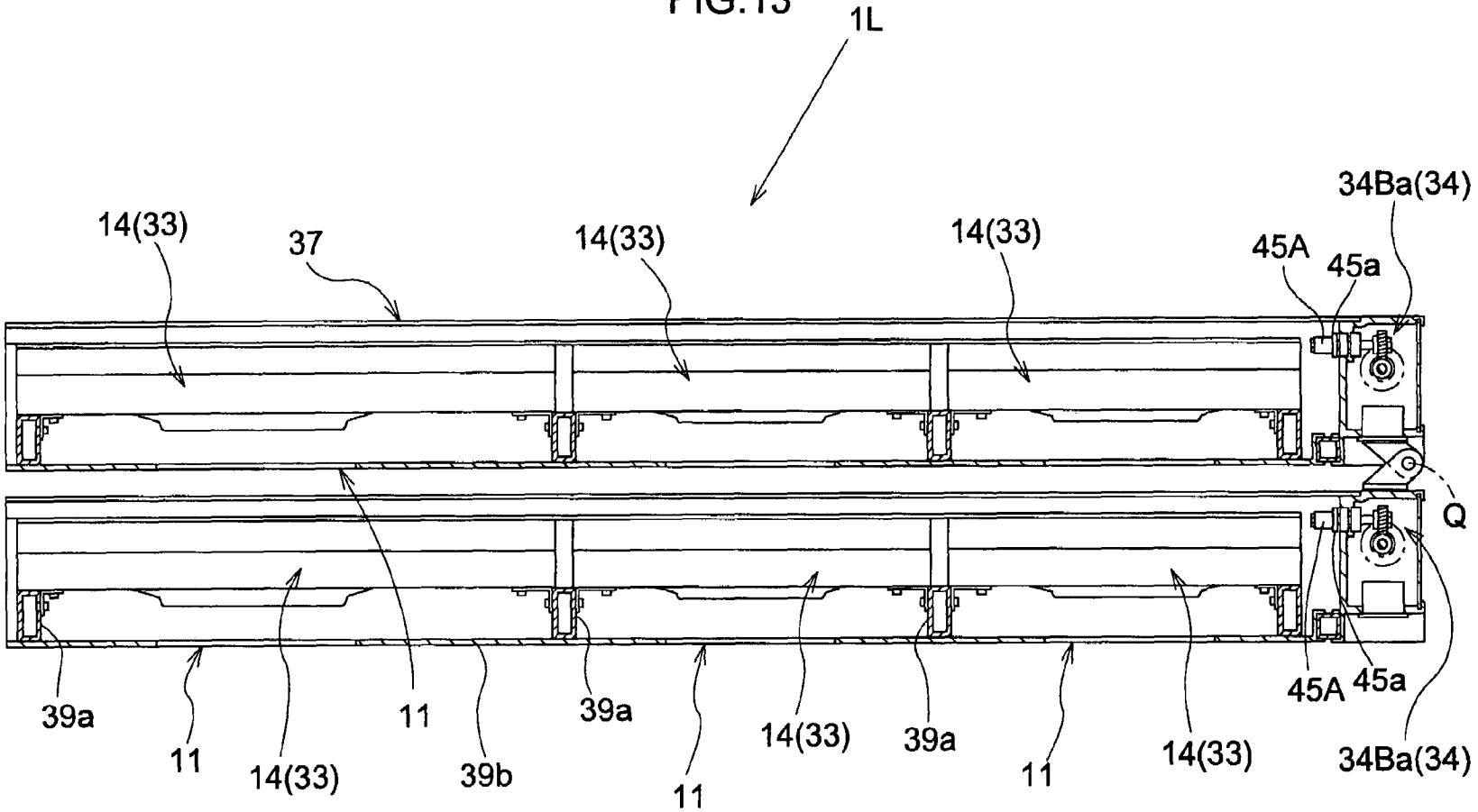
FIG. 13 is a rear sectional view of the L-shaped transport unit according to the first embodiment.

The L-shaped transport unit 1L is described in detail next. As shown in FIG. 10 and FIG. 11, the L-shaped transport unit 1L is disposed in two stages, an upper stage and a lower stage, and is provided with L-shaped air-supplying-type support means 33, which is the air-supplying-type support means for the L-shaped transport unit 1L, L-shaped drive force application means 34, which is the drive force application means for the L-shaped transport unit 1L, and an L-shaped casing member 37, which is the casing member for the L-shaped transport unit 1L. It should be noted that the L-shaped transport unit 1L also is supported in a horizontal state by the horizontal support frame 19. Also, the upper L-shaped transport unit 1L can freely swing about a transverse shaft Q in the first transporting direction X, as shown in FIG. 13.

As shown in FIG. 11, the L-shaped casing member 37 is provided with an L-shaped unit frame member 39 that is substantially elongate in a plan view and that is provided with the air introduction openings 11 for physically supporting the L-shaped air-supplying-type support means 33, L-shaped accommodation frames 38 provided on both sides along the transport route of the glass substrate 2 in the L-shaped unit frame member 39, and an L-shaped transport cover 40 provided spanning between the upper end portions of the L-shaped accommodation frames 388 on both sides.

Figure 14:
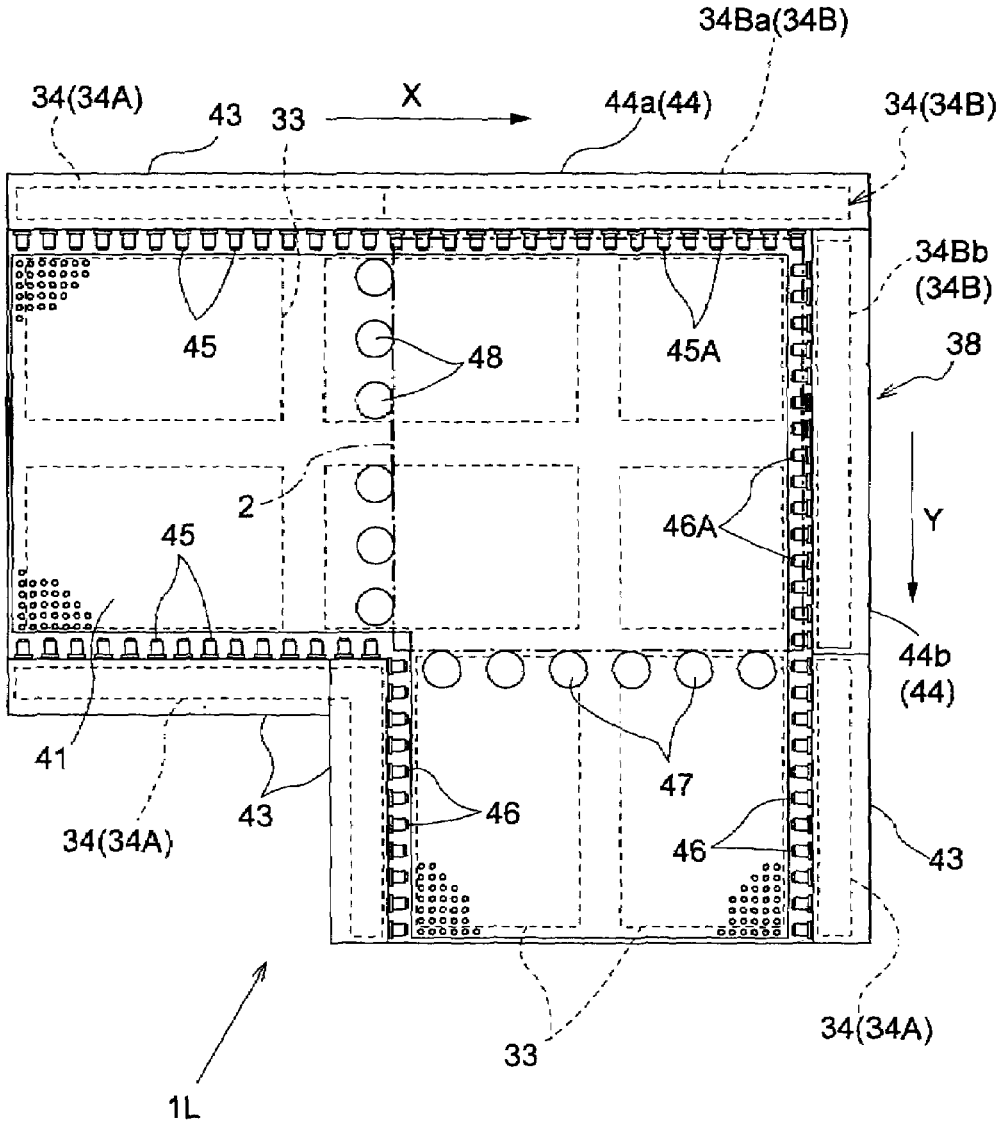
FIG. 14 is a plan view of the L-shaped transport unit according to the first embodiment.

The L-shaped accommodation frames 38, as shown in FIG. 10 and FIG. 14, have dual-side frame member portions 43 provided in opposition to one another sandwiching the L-shaped unit frame member 39 between them, and single-side frame member portions 44 provided only on the outer side of the L-shaped unit frame member 39 at a spot in opposition to the first transport member 1A and a spot in opposition to the second transport member 1B. Also, a first single-side frame member portion 44*a* provided at a spot in opposition to the second transport member 1B in the single-side frame member portion 44 is fixedly connected to the L-shaped unit frame member 39. Also, a second single-side frame member portion 44*b* provided at a spot in opposition to the first transport member 1A in the single-side frame member portion 44 can be freely raised up and down.

Figure 16:
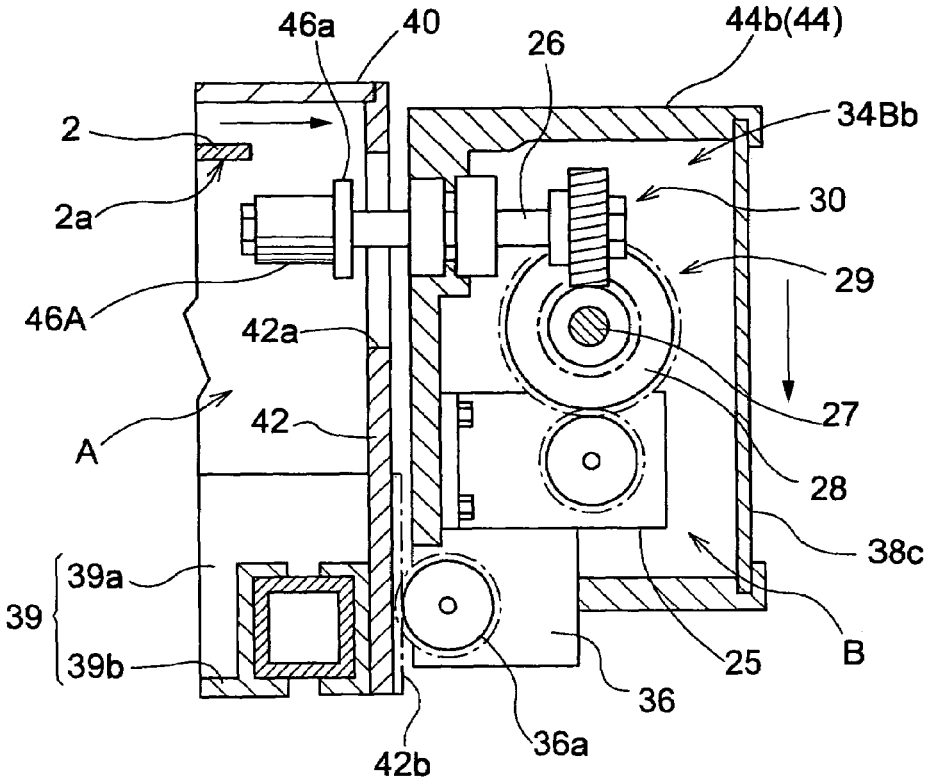
FIG. 16 is a sectional view of the second drive force application portion according to the first embodiment.

The second single-side frame member portion 44*b* is described next. As shown in FIG. 16, the portion of the L-shaped casing member 37 that is linked to the second single-side frame member portion 44*b* is fixedly connected to a fastening lateral wall 42 and shuts off the transport space A, and the second single-side frame member portion 44*b* is raised and lowered with respect to the fastening lateral wall 42. That is, a gear groove 42*b* is formed in the outer surface of the fastening lateral wall 42 and the output gear 36*a* of a raising and lowering motor 36 meshes with this gear groove, and by rotating the raising and lowering motor 36 in forward and reverse, the second single-side frame member portion 44*b* is raised and lowered. It should be noted that insertion holes 42*a* are formed in the fastening lateral wall 42 such that each of the output shafts 26 in the second single-side frame member portion 44*b* can be raised and lowered.

Figure 12:
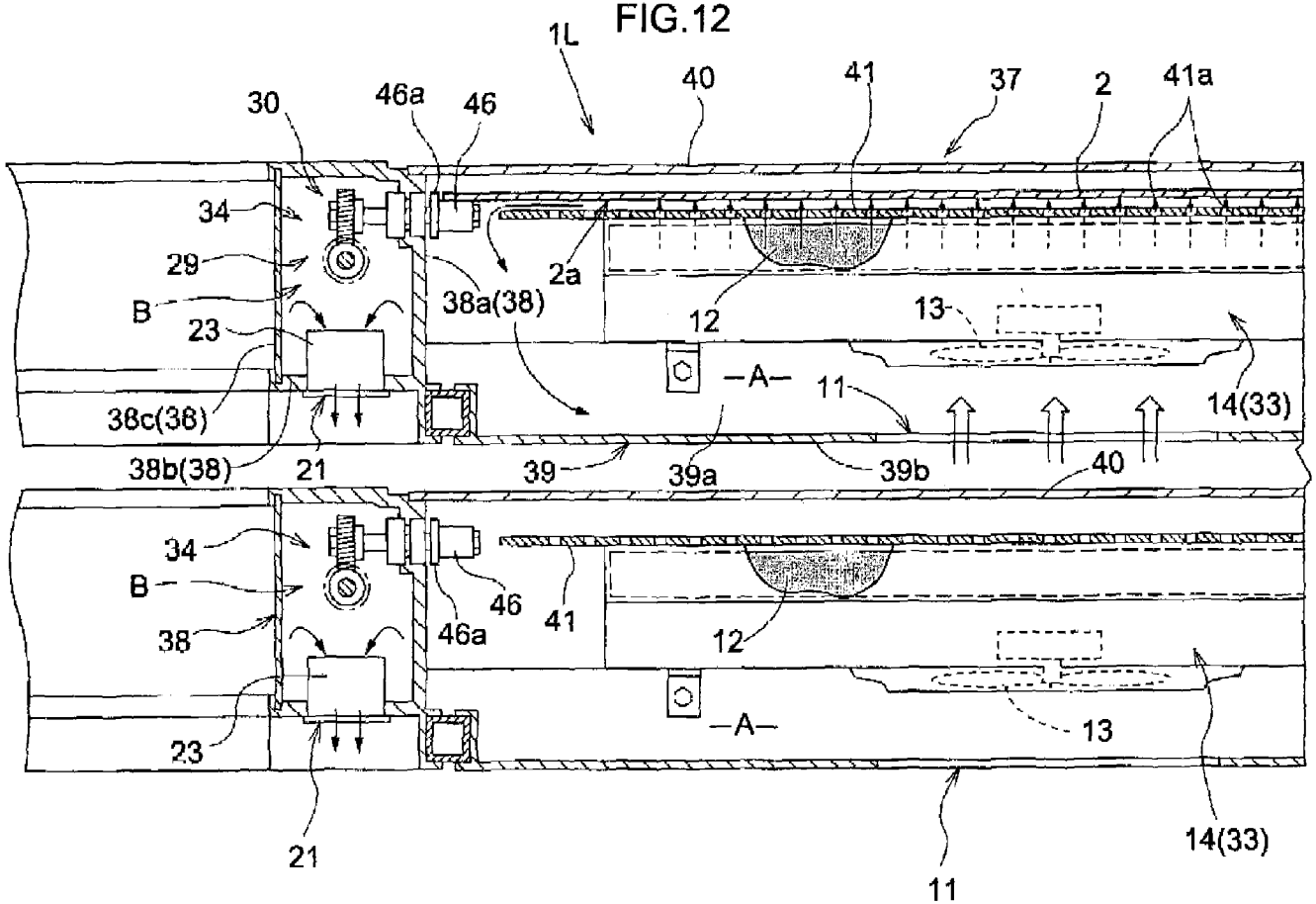
FIG. 12 is a partially magnified right side view of the L-shaped transport unit according to the first embodiment.

As shown in FIGS. 11 to 13, the L-shaped air-supplying-type support means 33 is provided in the transport space A in the L-shaped transport unit 1L. The fan filter units 14 in which a dust removal filter 12 and a blower fan 13 are integrally combined are disposed lined up in the first transporting direction X and the second transporting direction Y. Also, as shown in FIG. 14, a fan filter unit group in which three rows of two fan filter units 14 lined up in the width direction are provided in the transporting direction, and two fan filter units 14 provided on the second transporting direction downstream side of the fan filter unit group are provided, such that a total of eight fan filter units are provided in the L-shaped air-supplying-type support means 33. An L-shaped air rectifying plate 41 having the shape of the letter L when viewed in plan view that has the same structure as the air rectifying plate 15 is disposed such that it covers the area above the eight fan filter units 14. In other words, the L-shaped air-supplying-type support means 33 has eight fan filter units 14 and a single L-shaped air rectifying plate 41. Also, the eight blower fans provided in the L-shaped air-supplying-type support means 33 are configured such that they are driven at the same rotation velocity, and the L-type air-supplying-type support means 33 is configured such that the amount of purified air that is supplied to the lower surface 2*a* of the glass substrate 2 is substantially the same amount in both the width direction and the front-to-back direction. Through holes 41*a* are formed in the L-shaped air rectifying plate 41 like in the air rectifying plate 15.

The L-shaped drive force application means 34 are described next. As shown in FIG. 14, the L-shaped drive force application means 34 are provided with first contact-type drive rollers for transporting 45 for applying drive force in the first transporting direction X to support one end portion or another end portion in the width direction of the lower surface 2*a* of the glass substrate 2 in a contacting manner, and second contact-type drive rollers for transporting 46 for applying drive force in the second transporting direction Y to support one end portion or another end portion in the front-to-back direction of the lower surface 2*a* of the glass substrate 2 in a contacting manner. Also, the L-shaped drive force application means 34 has a dual-side drive force application portion 34A that is configured for dual-side driving that applies a drive force in the first transporting direction X or the second transporting direction Y to either both end portions in the width direction or both end portions in the front-to-back direction of the glass substrate 2 by cooperating with the pair of the opposing L-shaped drive force application means 34 provided in the pair of dual-side frame member portions 43, and a single-side drive force application portion 34B that is configured for single-side driving that applies a drive force in the first transporting direction X or the second transporting direction Y to either the one end portion in the width direction or the one end portion in the front-to-back of the glass substrate 2 through a single L-shaped drive force application means 34.

The single-side drive force application portion 34B has a first drive force application portion 34Ba and a second drive force application portion 34Bb. These single-side drive force application portion 34B and a second drive force application portion 34Bb are provided to the means for changing the transporting direction of the transported object. The first drive force application portion 34Ba is configured for single-side driving and applies a drive force in the first transporting direction X to the width end portion that is on the side away from the second transport member 1B in the width direction, which is perpendicular to the first transporting direction X, of the glass substrate 2. The second drive force application portion 34Bb is configured for single-side driving and applies a drive force in the second transporting direction Y to the front-to-back end portion that is on the side away from the first transport member 1A in the front-to-back direction, which is perpendicular to the second transporting direction Y, of the glass substrate 2. The transporting direction of the glass substrate 2 is changed such that a glass substrate 2 that has been transported in the first transporting direction X by a drive force applied thereto by the first drive force application portion 34Ba is then imparted with a drive force by the second drive force application portion 34Bb and transported in the second transporting direction Y.

Further, the first drive force application portion 34Ba is provided with first drive rollers 45A as contact-type first drive portions that apply a drive force to support one width end portion of the lower surface 2*a* of the glass substrate 2 in a contacting manner. The second drive force application portion 34Bb is provided with second drive rollers 45B as contact-type second drive portions that apply a drive force to support the lower surface 2*a* of the glass substrate 2 in a contacting manner. That is, the first drive rollers for transporting 45 that are provided in the first drive force application portion 34Ba correspond to the first drive rollers 45A, and the second drive rollers for transporting 46 that are provided in the second drive force application portion 34Bb correspond to the second drive rollers 46A. Also, the first drive force application portion 34Ba is provided in the first single-side frame member portion 44*a* and the second drive force application portion 34Bb is provided in the second single-side frame member portion 44*b*.

The first drive rollers 45A are provided with a first large diameter portion 45*a* (see FIG. 13) serving as a first stop portion that abuts against the lateral surface of the one end portion side in the width direction to which drive force is applied by the first drive force application portion 34Ba of the glass substrate 2 in order to stop the glass substrate 2 from moving in the width direction. The second drive rollers 46A are each provided with a second large diameter portion 46*a* (see FIG. 12) serving as a second stop portion that abuts against the lateral surface of the one end portion side in the front-to-back direction to which drive force is applied by the second drive force application portion 34Bb of the glass substrate 2 in order to stop the glass substrate 2 from moving in the front-to-back direction. The drive force application portion 34Ba and the second drive force application portion 34Bb are both configured in the same manner as the drive force application means 4.

The second drive force application portion 34Bb is structured such that it can be raised and lowered between a support position where the glass substrate 2 is supported in a contacting manner by the second drive rollers for transporting 46 and a retreated position where it is retreated downward so as to avoid contact between the glass substrate 2 and the second drive rollers 46. That is, as shown in FIG. 16, the second drive force application portion 34Bb is raised and lowered between the support position and the retreated position by raising and lowering the second single-side frame member portion 44*b*, which supports the second drive force application portion 34Bb.

As shown in FIG. 10, FIG. 14, and FIG. 15, the L-shaped transport unit 1L is provided with a plurality of first restricting rollers 47 as first restricting portions and a plurality of second restricting rollers 48 as second restricting portions. The first restricting rollers 47 restrict movement of the glass substrate 2 in the width direction by abutting against the lateral surface of the other end portion side in the width direction, which is on the side opposite the one end portion in the width direction to which drive force is applied by the first drive force application portion 34Ba, of the glass substrate 2. The second restricting rollers 48 restrict movement of the glass substrate 2 in the front-to-back direction by abutting against the lateral surface of the other end portion side in the front-to-back direction, which is on the side opposite the one end portion in the front-to-back direction to which drive force is applied by the second drive force application portion 34Bb, of the glass substrate 2.

Figure 17:
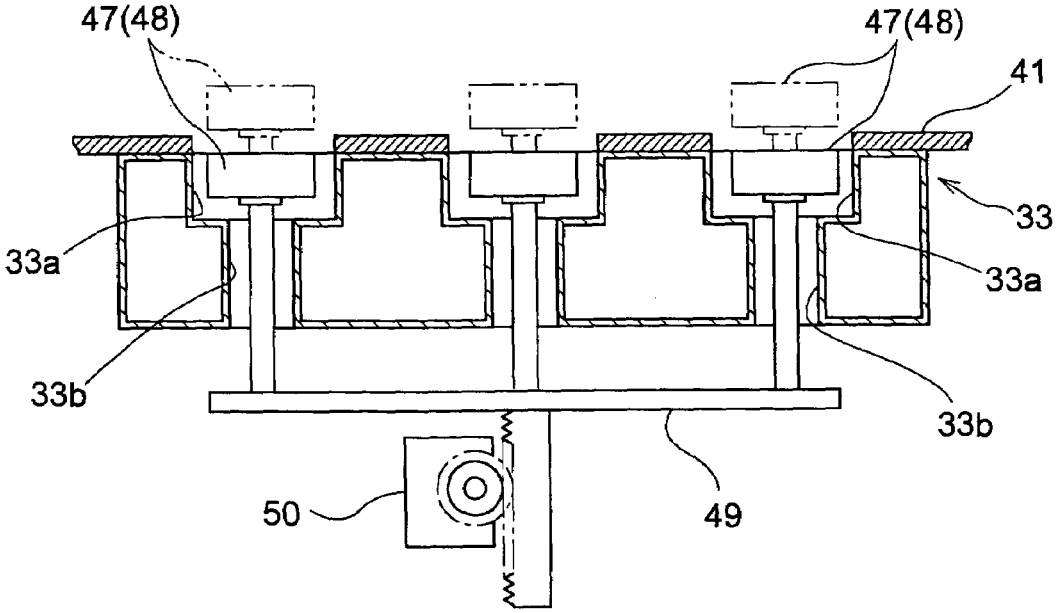
FIG. 17 is a diagram showing the position adjusting structure of the restricting portions according to the first embodiment.
Figure 18:
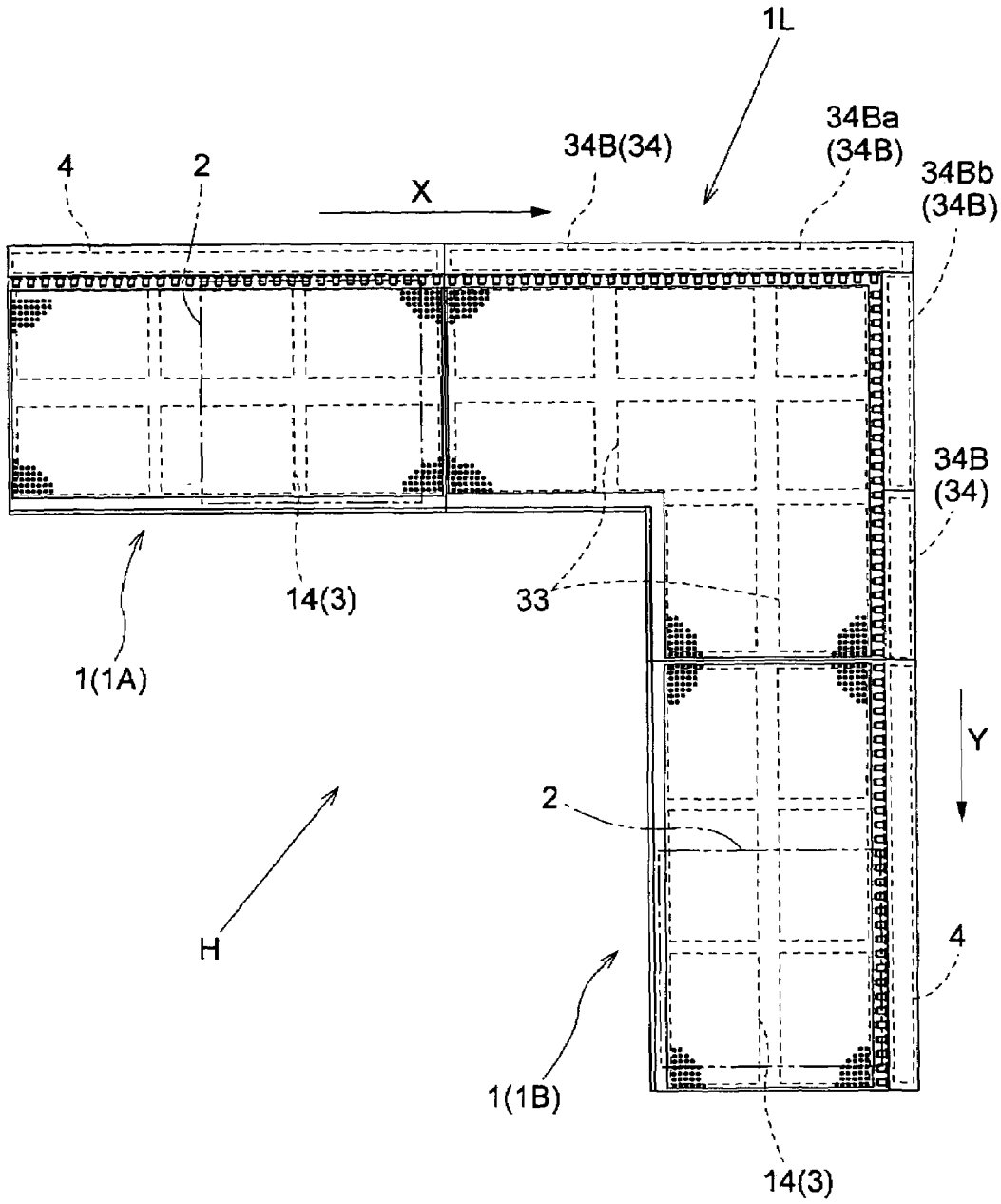
FIG. 18 is a plan view of the transporting apparatus according to the second embodiment.

Also, as shown in FIG. 15 and FIG. 17, the first restricting rollers 47 are structured such that their position can be altered between an action position in which the first restricting rollers 47 are positioned on the transport route of the glass substrate 2 that is transported in the second transporting direction and abut against the lateral surface on the other end portion side in the width direction, and a retreated position where the first restricting rollers 47 are lowered from this action position and thereby retreated away from the transport route of the glass substrate 2 that is transported in the second transporting direction. Also, the second restricting rollers 48 are structured such that their position can be altered between an action position in which the second restricting rollers 48 are positioned on the transport route of the glass substrate 2 that is transported in the first transporting direction and abut against the lateral surface on the other end portion side in the front-to-back direction, and a retreated position where the second restricting rollers 48 are lowered from this action position and thereby retreated away from the transport route of the glass substrate 2 that is transported in the first transporting direction.

The position altering structure of the first restricting rollers 47 and the second restricting rollers 48 is described next. However, because the position altering structure of the first restricting rollers 47 and the second restricting rollers 48 is the same, the position altering structure of the first restricting rollers 47 is described and the position altering structure of the second restricting rollers 48 is omitted from the description.

As shown in FIG. 17, each first restricting roller 47 is supported on the upper end portion of a roller support frame 49 in such a manner that it can freely rotate about a vertical shaft, and the roller support frame 49 can be raised and lowered vertically by an electric motor 50 supported on the L-shaped unit frame member 39.

Consequently, by vertically raising and lowering the roller support frame 49 using the motor 50, the positions of the first restricting rollers 47 are adjusted upward and downward, raising and lowering them between the action position and the retreated position.

Recessed portions 33*a* that the first restricting rollers 47 and the second restricting rollers 48 enter into when positioned in the retreated position, and through holes 33*b* through which the roller support members 34 pass, are formed in the L-shaped air-supplying-type support means 33. It should be noted that depending on the size of the fan filter units 14 and the size of the glass substrate 2 that is transported, for example, only some of the first restricting rollers 47 or second restricting rollers 48 may enter therein, and it may not be necessary to form the through holes 33*b*.

The procedure for transporting the glass substrate 2 with the L-shaped transport unit 1L is described next.

Figure 15A:
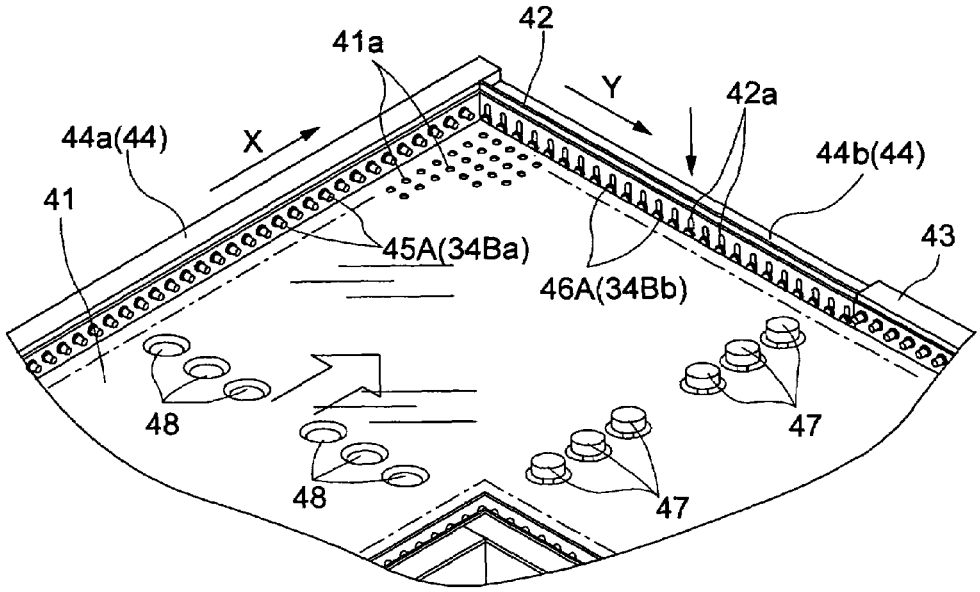
FIG. 15 is an action diagram of the L-shaped transport unit according to the first embodiment.

As shown in FIG. 15A, in advance, the second drive force application portion 34Bb is lowered to the retreated position such that the glass substrate 2 and the second drive force application portion 34Bb do not abut against one another, the first restricting rollers 47 are lifted to the action position in order to transport the glass substrate 2 in the first transporting direction X in a stable manner, and the second restricting rollers 48 are lowered to the retreated position so as not to be in the way when the glass substrate 2 is transported in the first transporting direction X.

Then, substantially the entire area of the lower surface 2*a* of the glass substrate 2 is supported by the purified air supplied by the L-shaped air-supplying-type support means 33, the lower surface 2*a* of both end portions in the width direction of the glass substrate 2 is supported in a contacting manner by the first drive rollers for transporting 45 due to the dual-side drive force application portion 34A of the L-shaped drive force application means 34, and the glass substrate 2 is transported in the first transporting direction X by the first drive rollers for transporting 45 being rotatively driven by the electric motor 25. When transported by the dual-side drive force application portion 34A, the glass substrate 2 is transported while being kept from shifting in the width direction thereof by the first large diameter portions 45*a* of the first drive rollers for transporting 45 on both sides in the width direction.

Next, the lower surface 2*a* on the one end portion side in the width direction of the glass substrate 2 is supported in a contacting manner by the first drive rollers 45A through the first drive force application portion 34Ba of the single-side drive force application portion 34B in the L-shaped drive force application means 34, and the glass substrate 2 is transported in the first transporting direction X by the first driving rollers 45A being rotatively driven by the electric motor 25. When transported by the first drive force application portion 34Ba, the glass substrate 2 is transported while being kept from shifting in the width direction of the glass substrate 2 due to cooperation between the first large diameter portions 45*a* of the first drive rollers 45A on one side in the width direction and the first restricting rollers 47 on the other side in the width direction.

Figure 15B:
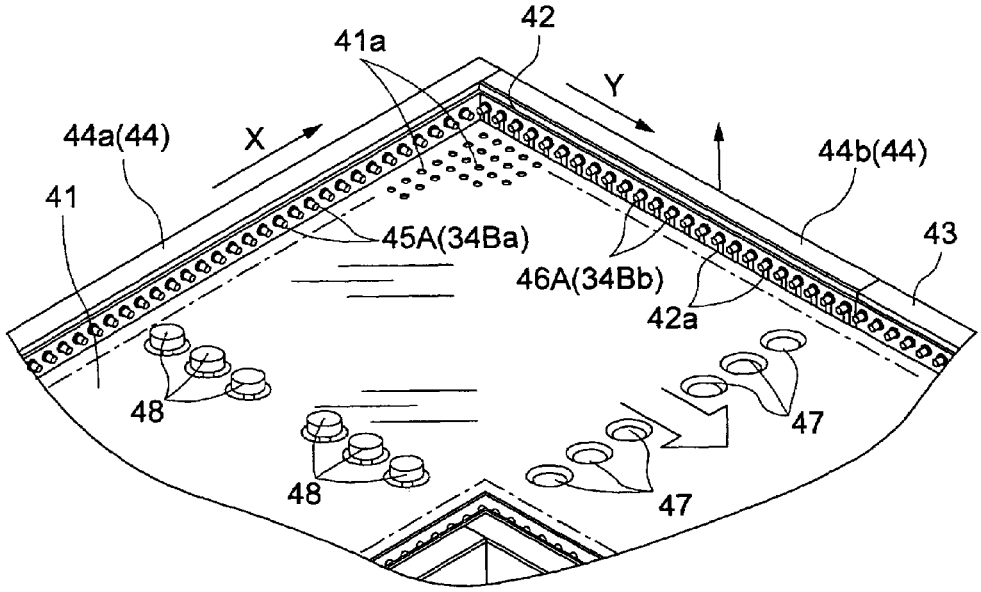

When the glass substrate 2 has been transported up to the last end in the first transporting direction, then, as shown in FIG. 15B, the second drive force application portion 34Bb is raised to the support portion such that the second drive rollers 46 support the lower surface 2*a* on the one end side in the front-to-back direction of the glass substrate 2 in a contacting manner, the first restricting rollers 47 are lowered to the retreated position such that they are not in the way when the glass substrate 2 is transported in the second transporting direction Y, and the second restricting rollers 48 are raised to the action position such that the glass substrate 2 is transported in the second transporting direction Y in a stable manner, thereby changing the transporting direction of the glass substrate 2 from the first transporting direction to the second transporting direction.

Then, substantially the entire area of the lower surface 2*a* of the glass substrate 2 is supported by the purified air supplied by the L-shaped air-supplying-type support means 33, the lower surface 2*a* on the one end portion side in the front-to-back direction of the glass substrate 2 is supported in a contacting manner by the second drive rollers 46A through the second drive force application portion 34Bb of the single-side drive force application portion 34B in the L-shaped drive force application means 34, and the glass substrate 2 is transported in the second transporting direction Y by the second drive rollers 46A being rotatively driven by the electric motor 25. When transported by the single-side drive force application portion 34Bb, the glass substrate 2 is transported while being kept from shifting in the front-to-back direction of the glass substrate 2 due to cooperation between the second large diameter portions 46*a* of the second drive rollers 46A on one side in the front-to-back direction and the second restricting rollers 48 on the other side in the front-to-back direction.

Next, the lower surface 2*a* of both end portions in the front-to-back direction of the glass substrate 2 is supported in a contacting manner by the second drive rollers for transporting 46 through the dual-side drive force application portion 34A in the L-shaped drive force application means 34, and the glass substrate 2 is transported in the second transporting direction Y by the second drive rollers for transporting 46 being rotatively driven by the electric motor 25. When transported by the dual-side drive force application portion 34A, the glass substrate 2 is transported while being kept from shifting in the width direction of the glass substrate 2 by the second large diameter portions 46*a* of the second drive rollers for transporting 46 on both sides in the front-to-back direction.

Second Embodiment

In the first embodiment, only part of the L-shaped drive force application means is configured for single-side driving, but it is also possible to configure the entire L-shaped drive force application means for single-side driving. It should be noted that structural elements that are identical to those of the first embodiment are assigned the same reference numerals as in the first embodiment and description thereof is omitted. The same is true with other embodiments described below.

Figure 19:
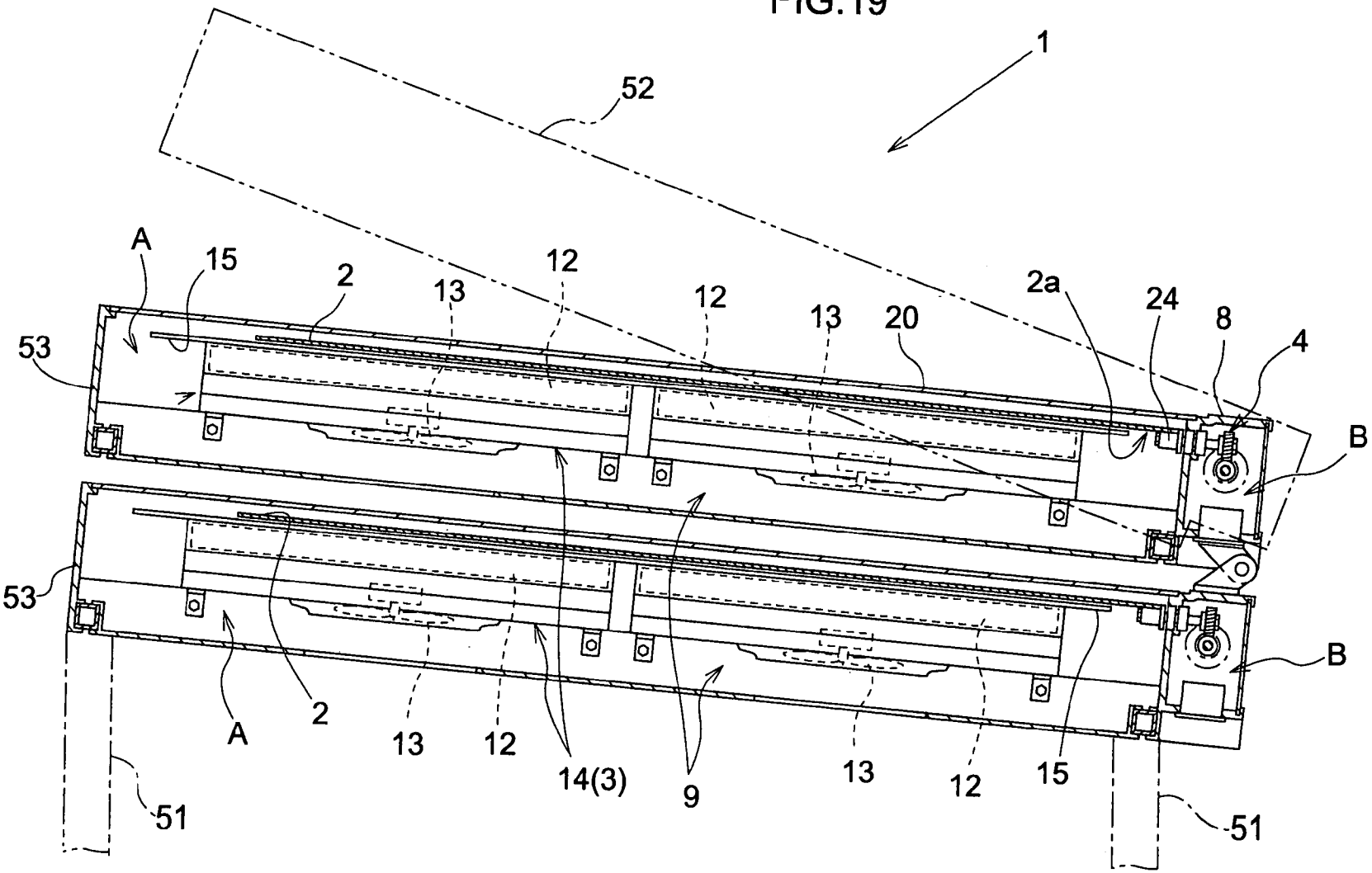
FIG. 19 is a front sectional view of the transport unit according to the second embodiment.

As shown in FIG. 19, a single-side casing member 52 in the transport unit 1 is provided with a unit frame member 9 that is substantially elongate in a plan view and that is for supporting the air-supplying-type support means 3, an accommodation frame 8 provided in the transporting direction on the transport route outer side in the width direction of the unit frame member 9, a casing lateral wall 53 provided along the transport route inner side in the width direction of the unit frame member 9, and a transport cover 20 provided spanning between the upper end portion of the accommodation frame 8 and the upper end portion of the casing lateral wall 53. Thus, the transport space A is formed by the unit frame member 9, the accommodation frame 8, the casing lateral wall 53, and the transport cover 20.

The transport unit 1 is supported in a sloped state by a sloped support member 51 such that it slopes downward toward the side on which the accommodation frame 8 is provided in the width direction, and by the transport unit 1 being supported in a sloped state, the air-supplying-type support means 3 also is supported on the unit frame member 9 in a sloped orientation. To facilitate understanding of the slope of the single-side casing member 52, in FIG. 19 the transport unit 1 is shown sloped by 5° downward toward the side on which the accommodation frame 8 is provided when viewed in the transporting direction, but when practicing the invention of the present application, the slope of the transport unit 1 can be a miniscule slope of about 0.50°.

The drive force application means 4 is described next. The drive force application means 4 is configured for single-side driving and is provided in the single accommodation frame 8. Substantially the entire area of the lower surface 2*a* of the glass substrate 2 is supported by the purified air that is supplied by the air-supplying-type support means 3. Due to the drive force application means 4, the lower surface 2*a* of the width one end side portion in the width direction of the glass substrate 2 is supported in a contacting manner by the drive rollers 24.

The L-shaped transport unit 1L is described next.

Figure 20:
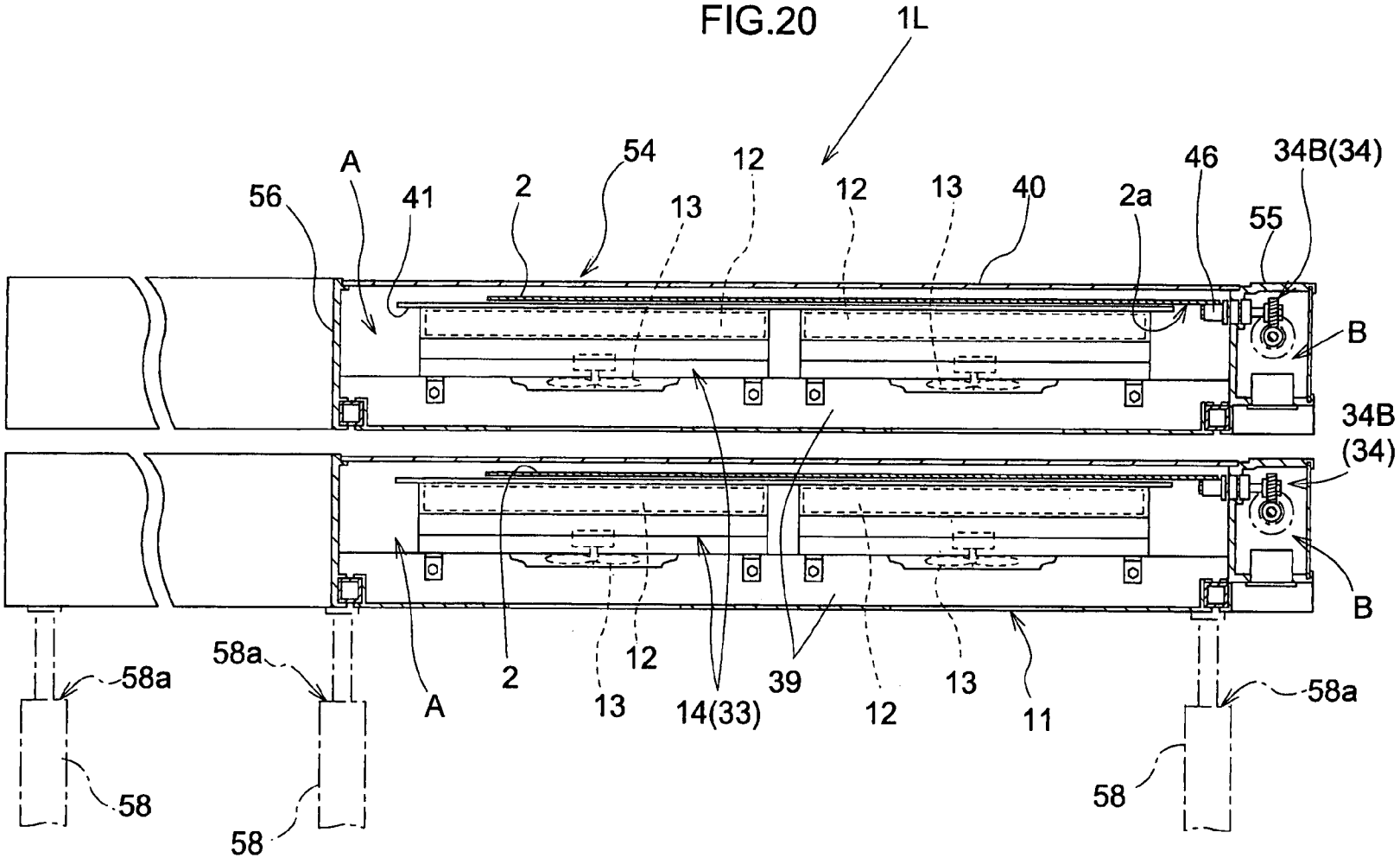
FIG. 20 is a right side view of the L-shaped transport unit according to the second embodiment.

As shown in FIG. 20, an L-shaped single-side casing member 54 of the L-shaped transport unit 1L is provided with the L-shaped unit frame member 39, an L-shaped single-side accommodation frame 55 provided on transporting direction outer side of the glass substrate 2 in the L-shaped unit frame member 39, an L-shaped casing lateral wall 56 provided on the transport route inner side of the glass substrate 2 in the L-shaped unit frame member 39, and an L-shaped transport cover 40 provided spanning between the upper end portion the L-shaped single-side accommodation frame 55 and the upper end portion of the L-shaped casing lateral wall 56.

Also, the L-shaped air-supplying-type support means 33 can be changed between a first transporting orientation in which the glass substrate 2 is in a sloped orientation where the width other end side is positioned higher than the width one end side to which drive force is applied by the first drive force application portion 34Ba, and a second transporting orientation in which the glass substrate 2 is in a sloped orientation where the front-to-back other end side is positioned higher than the front-to-back one end side to which drive force is applied by the second drive force application portion 34Bb.

Figure 23A:
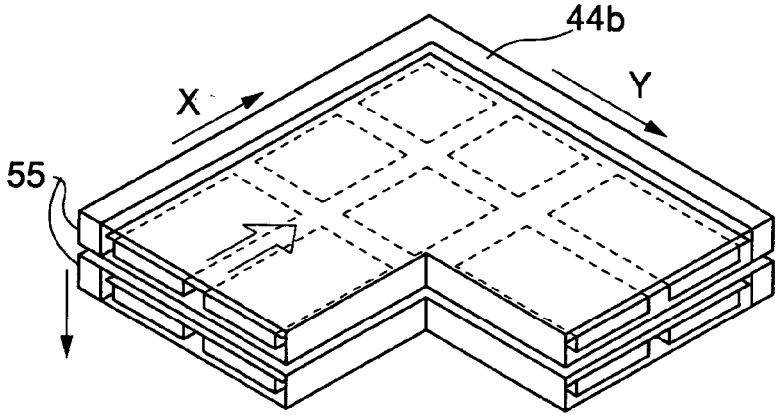
FIG. 23 is an action diagram of the L-shaped transport unit according to the second embodiment.
Figure 23B:
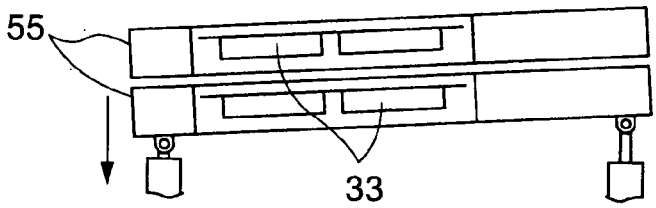

That is, the L-shaped transport unit 1L is supported in such a manner that its slope orientation can be changed by a frame member for changing slope orientation 58, a plurality of extension portions 58*a* in the frame member for changing slope orientation 58 can be extended and shortened, and as shown in FIG. 23B, the L-shaped air-supplying-type support means 33 is in a sloped state in which when viewed in the first transporting direction the side on which the L-shaped single-side accommodation frame 55 is provided is sloped downward, and to set it to a horizontal state when viewed in the direction opposite to the second transporting direction, the L-shaped air-supplying-type support means 33 can be set to the first transporting orientation by extending and shortening each of the extension portions 58*a*. Also, when in horizontal state when viewed in the first transporting direction, as shown in FIG. 24B, the L-shaped air-supplying-type support means 33 can be set to the second transporting orientation by extending and shortening each of the extension portions 58*a* so as to set the L-shaped transport unit 1L to a sloped state in which when viewed in the second transporting direction the side on which the L-shaped single-side accommodation frame 55 is provided is sloped downward.

Figure 21:
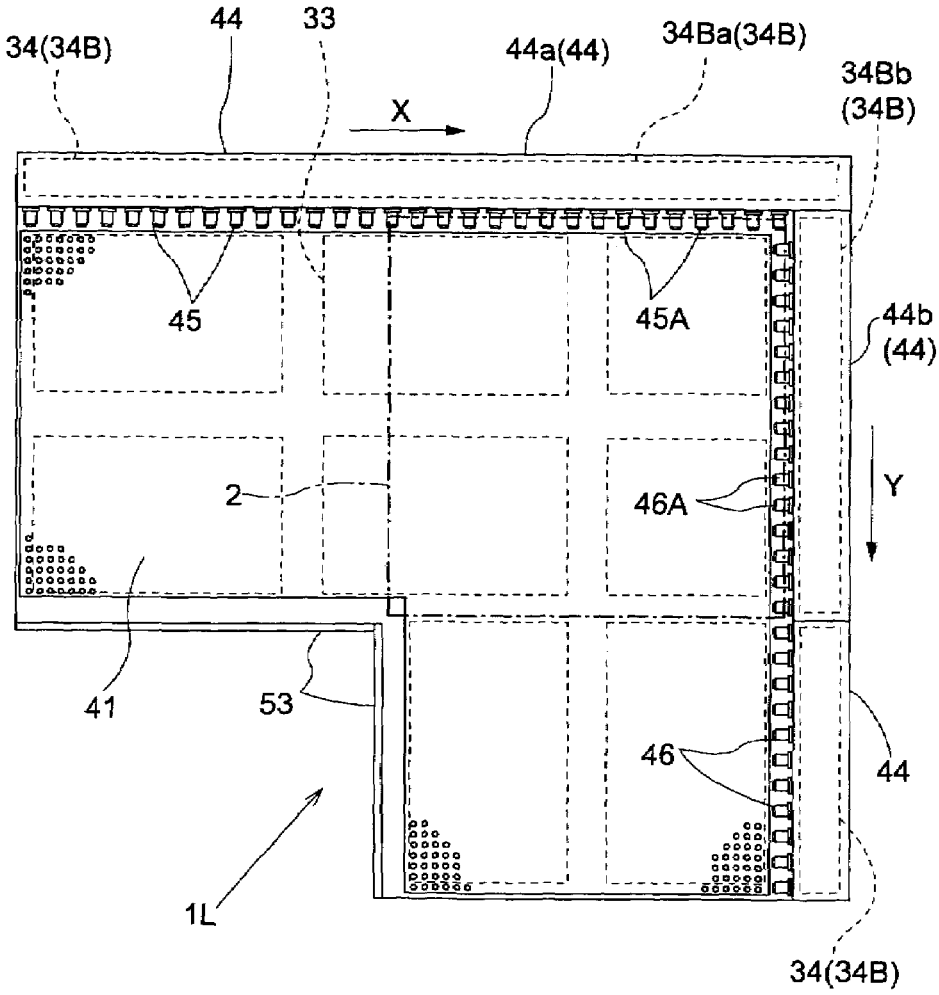
FIG. 21 is a plan view of the L-shaped transport unit according to the second embodiment.
Figure 22:
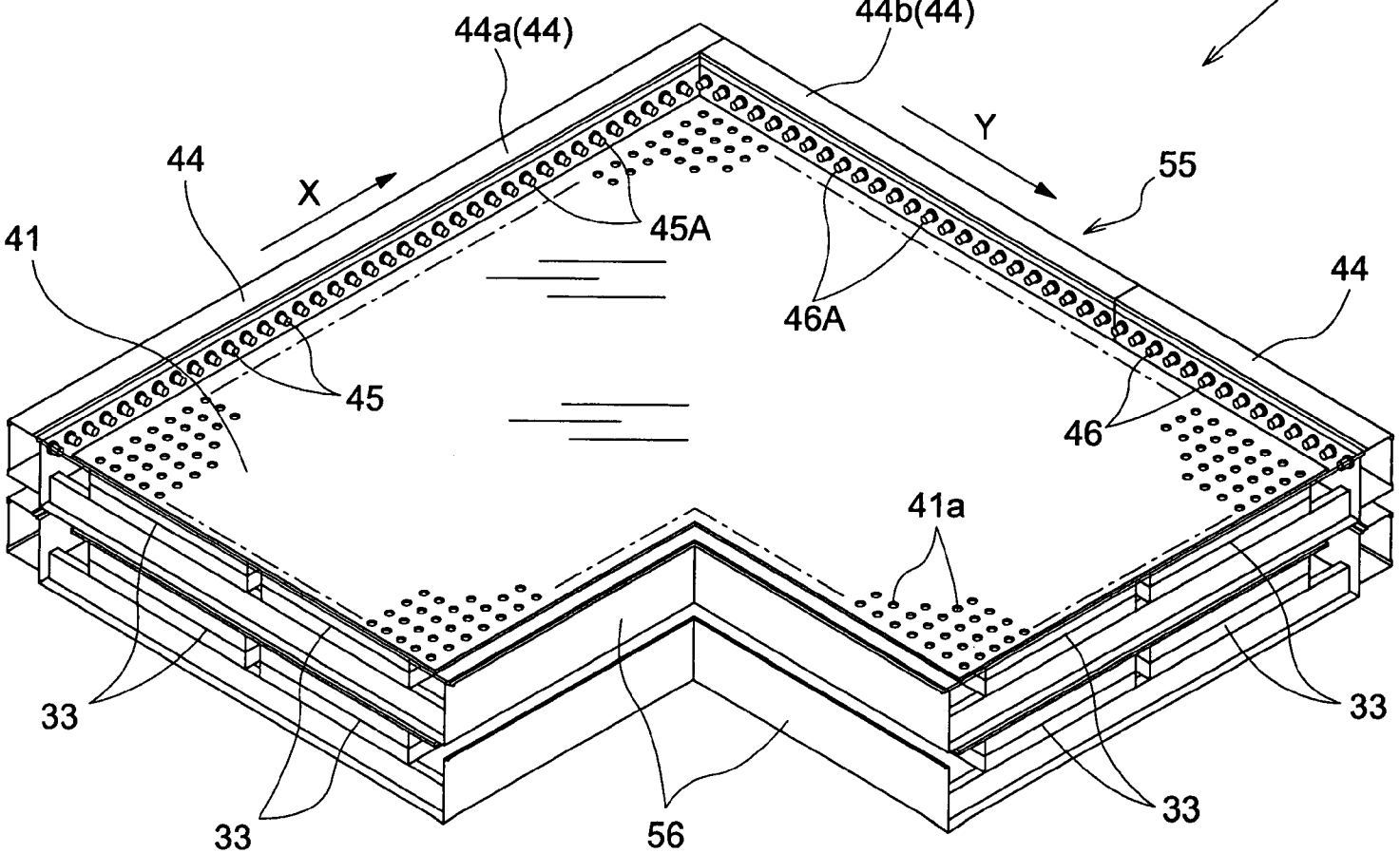
FIG. 22 is a perspective view of the L-shaped transport unit according to the second embodiment.

To describe the L-shaped single-side accommodation frame 55 in greater detail, as shown in FIG. 21 and FIG. 22, the L-shaped single-side accommodation frame 55 has only a single-side frame member portion 44 provided only on the outer side of the L-shaped unit frame member 39. Also, a second single-side frame member portion 44*b* positioned at a spot that is in opposition to the first transport member 1A in the single-side frame member portion 44 is structured such that it can be raised and lowered.

The L-shaped drive force application means 34 is described next. As shown in FIG. 21, the L-shaped drive force application means 34 has only a single-side drive force application portion 34B configured for single-side driving that is provided in the single-side frame member portion 44.

Further, the portion provided in the first single-side frame member portion 44*a* in the first transporting direction X in the single-side drive force application portion 34B is defined as the first drive force application portion 34Ba, and the portion provided in the second single-side frame member portion 44*b* in the second transporting direction Y in the single-side drive force application portion 34B is defined as the second drive force application portion 34Bb. The second drive force application portion 34Bb, like in the first embodiment, is structured such that it can be raised and lowered between a support position and a retreated position.

It should be noted that in the second embodiment, the L-shaped transport unit 1L is not provided with first restricting portions or second restricting portions. Thus, the recessed portions 33*a* and the through holes 33*b* are not formed in the L-shaped air-supplying-type support means 33.

The procedure for transporting the glass substrate 2 with the L-shaped transport unit 1L is described next.

As shown in FIG. 23A, in advance, the second drive force application portion 34Bb is lowered to the retreated position such that the glass substrate 2 and the second drive force application portion 34Bb do not abut against one another, and as shown in FIG. 23B, the L-shaped air-supplying-type support means 33 is changed to the first transporting orientation such that the glass substrate 2 is transported in the first transporting direction X in a stable manner.

Then, substantially the entire area of the lower surface 2*a* of the glass substrate 2 is supported by the purified air supplied by the L-shaped air-supplying-type support means 33, the lower surface 2*a* of both end portions in the width direction of the glass substrate 2 is supported in a contacting manner by the first drive rollers for transporting 45 through the first drive force application portion 34Ba of the L-shaped drive force application means 34, and the glass substrate 2 is transported in the first transporting direction X by the first drive rollers for transporting 45 being rotatively driven by the electric motor 25. When transported by the first drive force application portion 34Ba, movement of the glass substrate 2 to the one side in the width direction is restricted due to the first large diameter portions 45*a* of the first drive rollers for transporting 45, and movement of the glass substrate 2 to the other side in the width direction is difficult due to the force of gravity on the glass substrate 2.

Figure 24A:
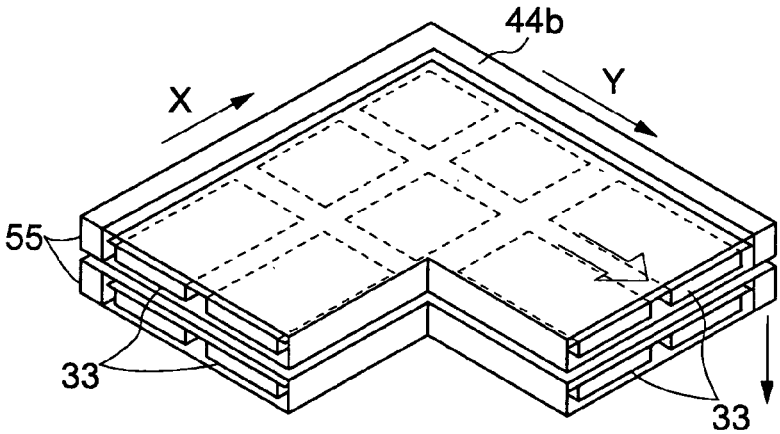
FIG. 24 is an action diagram of the L-shaped transport unit according to the second embodiment.
Figure 24B:
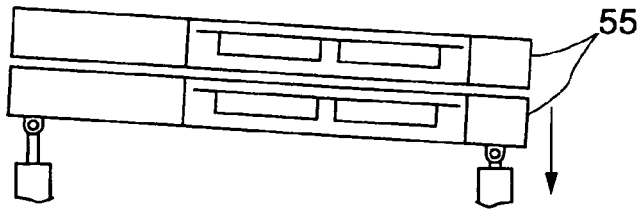

When the glass substrate 2 has been transported up to the last end in the first transporting direction, then, as shown in FIG. 24A, the second drive force application portion 34Bb is raised to the support position such that the lower surface 2*a* on the one end side in the front-to-back direction of the glass substrate 2 is supported in a contacting manner by the second drive rollers 46, and as shown in FIG. 24B, the L-shaped air-supplying-type support means 33 is changed to the second transporting orientation in order to transport the glass substrate 2 in the second transporting direction Y in a stable manner, thereby changing the transporting direction of the glass substrate 2 from the first transporting direction to the second transporting direction.

Then, substantially the entire area of the lower surface 2*a* of the glass substrate 2 is supported by the purified air supplied by the L-shaped air-supplying-type support means 33, the lower surface 2*a* of the one end portion side in the front-to-back direction of the glass substrate 2 is supported in a contacting manner by the second drive rollers for transporting 46 through the second drive force application portion 34Bb of the L-shaped drive force application means 34, and the glass substrate 2 is transported in the second transporting direction Y by the second drive rollers 46 being rotatively driven by the electric motor 25. When transported by the second drive force application portion 34Bb, movement of the glass substrate 2 to the one side in the front-to-back direction is restricted by the second large diameter portions 46*a* of the second drive rollers 46, and movement of the glass substrate 2 to the other side in the front-to-back direction is difficult due to the force of gravity on the glass substrate 2.

Third Embodiment

In the first embodiment and the second embodiment, the second drive force application portion can be lowered to a retreated position so as to avoid contact between the glass substrate being transported in the first transporting direction and the second drive force application portion, but it is also possible to adopt a configuration in which the second drive force application portion is not lowered and the glass substrate is raised up instead. It should be noted that the transport units have the same configuration as in the second embodiment and thus description thereof is omitted, and the L-shaped transport unit has the same configuration as in the first embodiment and the second embodiment and thus is assigned the same reference numerals as in the first embodiment and the second embodiment and description thereof is omitted.

Figure 25:
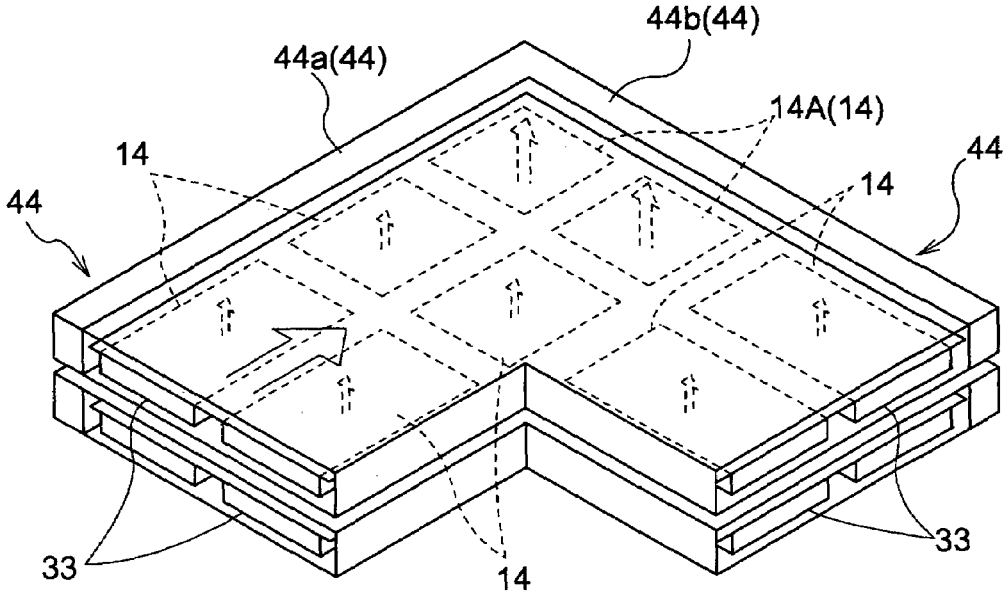
FIG. 25 is a perspective view of the L-shaped transport unit according to the third embodiment.

As shown in FIG. 25, the L-shaped transport unit 1L basically has the same configuration as in the second embodiment, and differs from the second embodiment in the following two aspects.

The two fan filter units 14 on the downstream side in the first transporting direction of the fan filter unit group in which three rows of two fan filter units 14 lined up in the width direction are lined in the transporting direction are structured as variable fan filter units 14A that are capable of supplying a greater amount of purified air to the lower surface 2*a* of the glass substrate 2 than the other six fan filter units.

The second single-side frame member portion 44*b*, which is provided at a position that is in opposition to the first transport member 1A in the single-side frame member portion 44, can be raised and lowered with respect to the L-shaped unit frame member 39.

The L-shaped transport unit 1L is supported in a horizontal state by the horizontal support frame 19.

To describe the variable fan filter units 14A in greater detail, they are structured such that a variable blower fan 13*a* provided in the variable fan filter units 14A can be altered between an equal rotation velocity that is the same as that of the blower fans 13 of the other six fan filter units 14, including the two fan filter units 14 provided on the downstream side in the second transporting direction of the fan filter unit group, and a fast rotation velocity that is faster than the rotation velocity of the blower fans 13 of these six fan filter units 14. Consequently, by setting the variable blower fans 13*a* to the equal rotation velocity, the variable fan filter units 14A can supply the same amount of purified air to the lower surface 2*a* of the glass substrate 2 as the other fan filter units 14, and by setting the variable blower fans 13*a* to the fast rotation velocity, the variable fan filter units 14A can supply a greater amount of purified air to the lower surface 2*a* of the glass substrate 2 than the other fan filter units 14.

The procedure for transporting the glass substrate 2 with the L-shaped transport unit 1L is described next.

In advance, the variable blower fans 13*a* in the variable fan filter units 14A are set to the fast rotation velocity such that the glass substrate 2 and the second drive force application portion 34Bb do not abut against one another, and the L-shaped air-supplying-type support means 33 is changed to the first transporting orientation such that the glass substrate 2 is transported in the first transporting direction X in a stable manner.

Then, substantially the entire area of the lower surface 2*a* of the glass substrate 2 is supported by the purified air supplied by the L-shaped air-supplying-type support means 33, the lower surface 2*a* of both end portions in the width direction of the glass substrate 2 is supported in a contacting manner by the first drive rollers for transporting 45 through the first drive force application portion 34Ba of the L-shaped drive force application means 34, and the glass substrate 2 is transported in the first transporting direction X by the first drive rollers 45 being rotatively driven by the electric motor 25. When transported by the first drive force application portion 34Ba, movement of the glass substrate 2 to the one side in the width direction is restricted by the first large diameter portions 45*a* of the first drive rollers 45, and movement of the glass substrate 2 to the other side in the width direction is difficult due to the force of gravity on the glass substrate 2.

Near the last end portion in the first transporting direction X, a larger amount of purified air is supplied to the lower surface 2*a* of the glass substrate 2 by the variable fan filter units 14A, significantly lifting up the end portion on the downstream side in the transporting direction, which is the one end side in the front-to-back direction of the glass substrate 2. Thus, as shown in FIG. 24B, the glass substrate 2 can be transported in the first transporting direction up to a position where the one end portion side in the front-to-back direction of the glass substrate is above the second drive rollers 46 of the second drive force application portion 34Bb while abutment between the glass substrate 2 and the second drive force application portion 34Bb is avoided by significantly raising up the end portion on the downstream side in the transporting direction of the glass substrate 2.

Figure 26A:
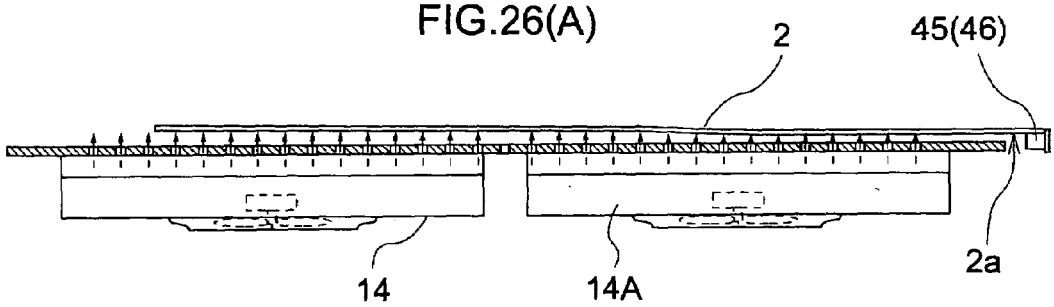
FIG. 26 is a diagram showing the manner in which the glass substrate is supported in the third embodiment.
Figure 26B:
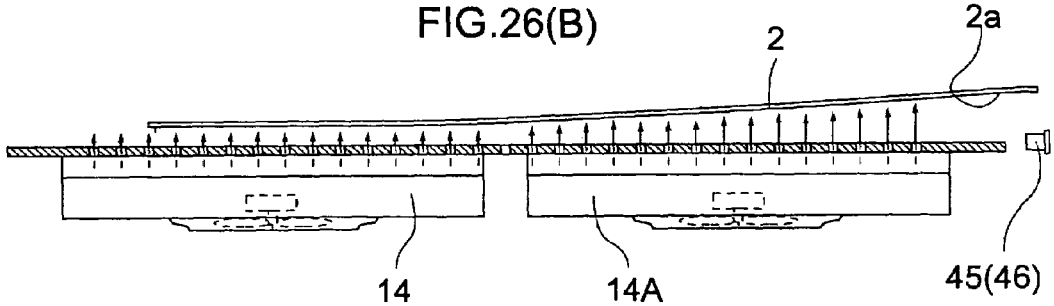

As shown in FIG. 23, when the glass substrate 2 has been transported to the last end in the first transporting direction, then, as shown in FIG. 26A, the variable blower fans 13*a* in the variable fan filter units 14A are set to the equal rotation velocity such that the lower surface 2*a* on the one end side in the front-to-back direction of the glass substrate 2 is supported in a contacting manner by the second drive rollers 46 and the orientation of the L-shaped air-supplying-type support means 33 is changed to the second transporting orientation in order to transport the glass substrate 2 in the second transporting direction Y in a stable manner, thereby switching the transporting direction of the glass substrate 2 from the first transporting direction to the second transporting direction.

Then, substantially the entire area of the lower surface 2*a* of the glass substrate 2 is supported by the purified air supplied by the L-shaped air-supplying-type support means 33, the lower surface 2*a* of the one end portion side in the front-to-back direction of the glass substrate 2 is supported in a contacting manner by the second drive rollers 46 due to the second drive force application portion 34Bb of the L-shaped drive force application means 34, and the glass substrate 2 is transported in the second transporting direction Y by the second drive rollers 46 being rotatively driven by the electric motor 25. When transported by the second drive force application portion 34Bb, movement of the glass substrate 2 to the one side in the front-to-back direction is restricted by the second large diameter portions 46*a* of the second drive rollers 46, and movement of the glass substrate 2 to the other side in the front-to-back direction is difficult due to the force of gravity on the glass substrate 2.

Fourth Embodiment

A fourth embodiment is described next.

Figure 33:
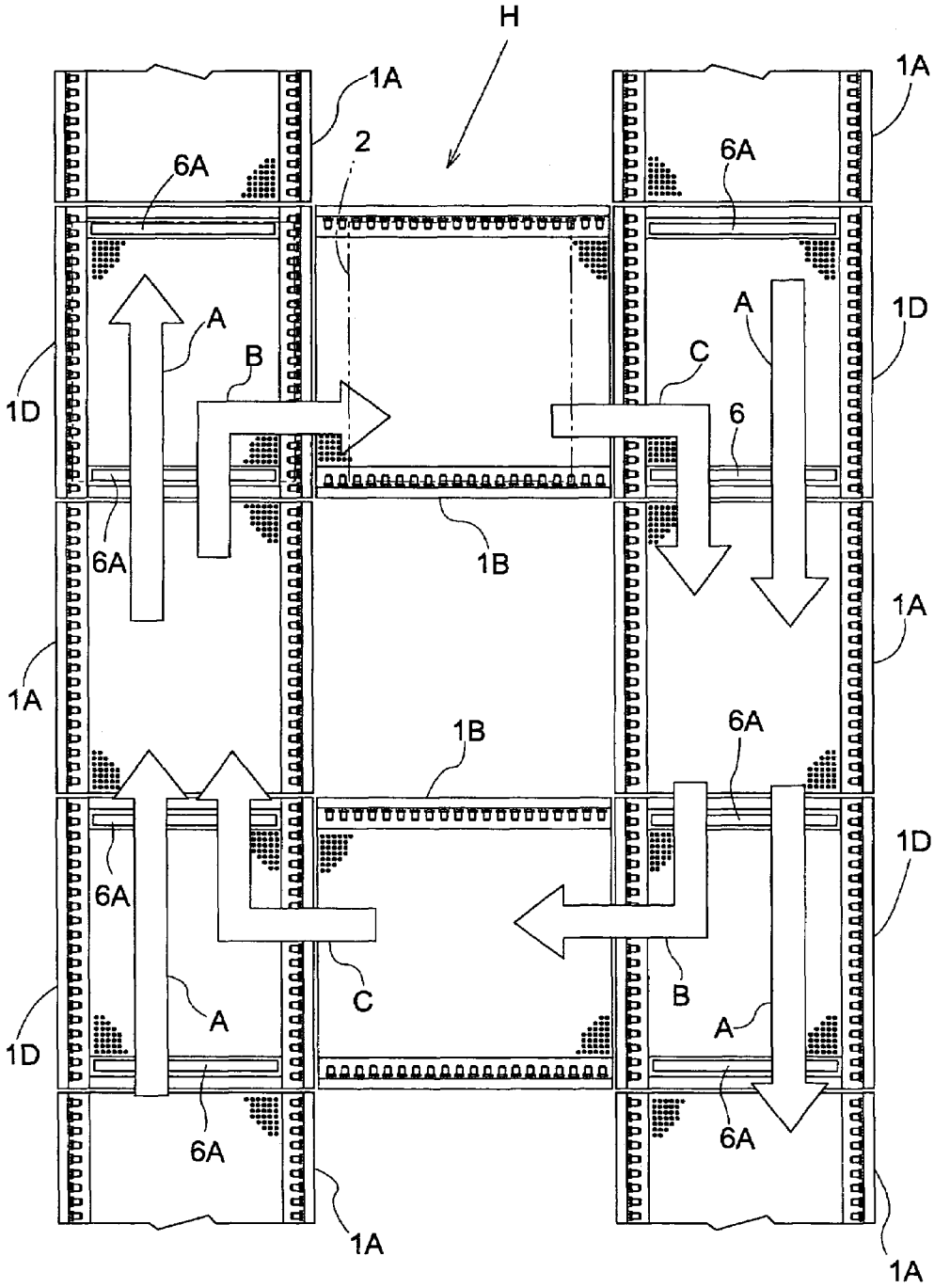
FIG. 33 is a plan view of the transporting apparatus according to the fourth embodiment.

As shown in FIG. 33, a transporting apparatus H is provided with first transport members 1A for transporting the glass substrate 2 in a first transporting direction, second transport members 1B for transporting the glass substrate 2 in a second transporting direction that is perpendicular to the first transporting direction, and relay transport members 1D that are located where the first transport members 1A and the second transport members 1B are connected, and that transport the glass substrate 2 between itself and a first transport member 1A by transporting the glass substrate 2 in the first transporting direction and that transport the glass substrate 2 between itself and a second transport member 1B by transporting the glass substrate 2 in the second transporting direction.

Figure 34:
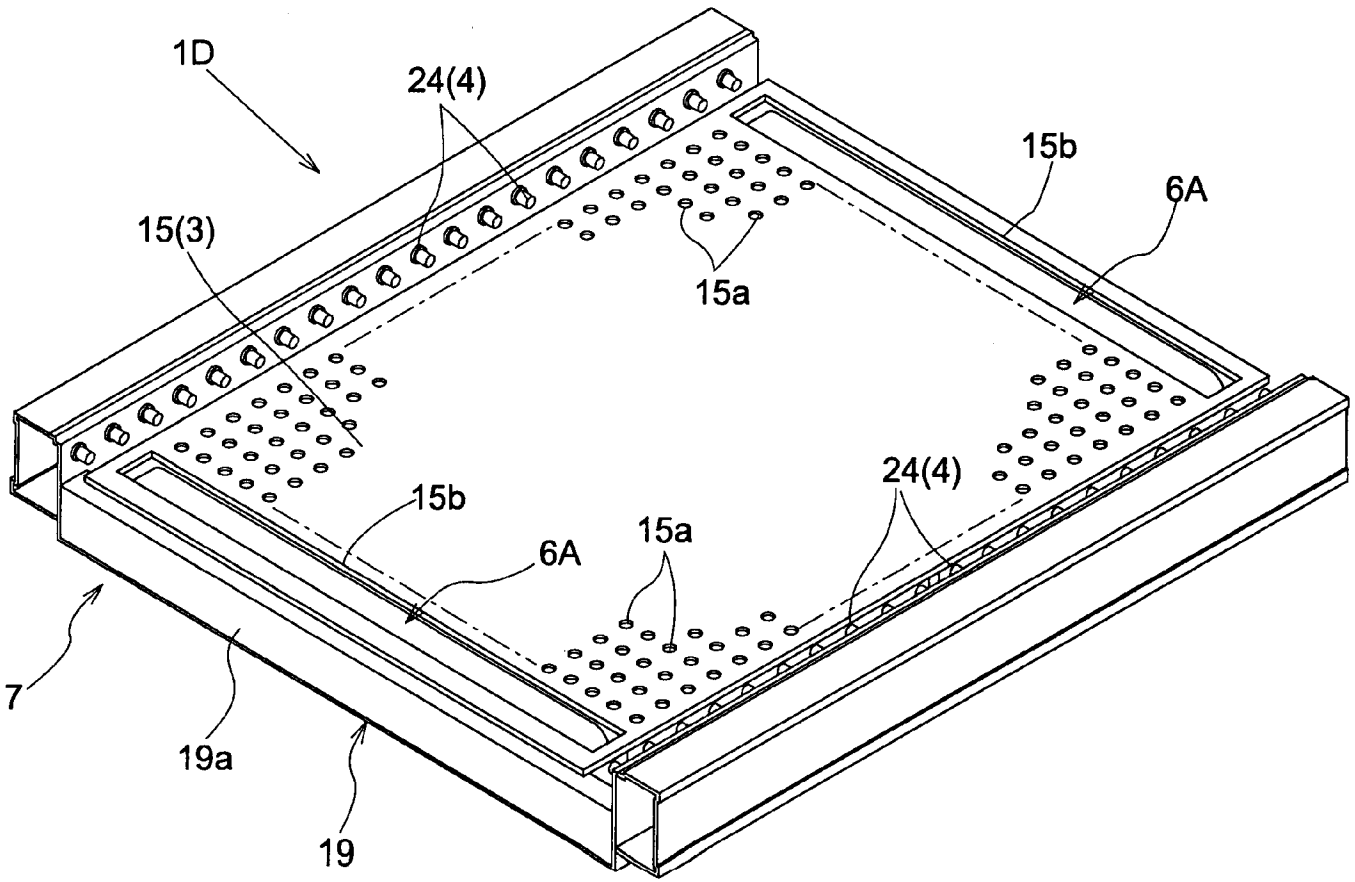
FIG. 34 is a perspective view of the relay transport member according to the fourth embodiment.
Figure 39:
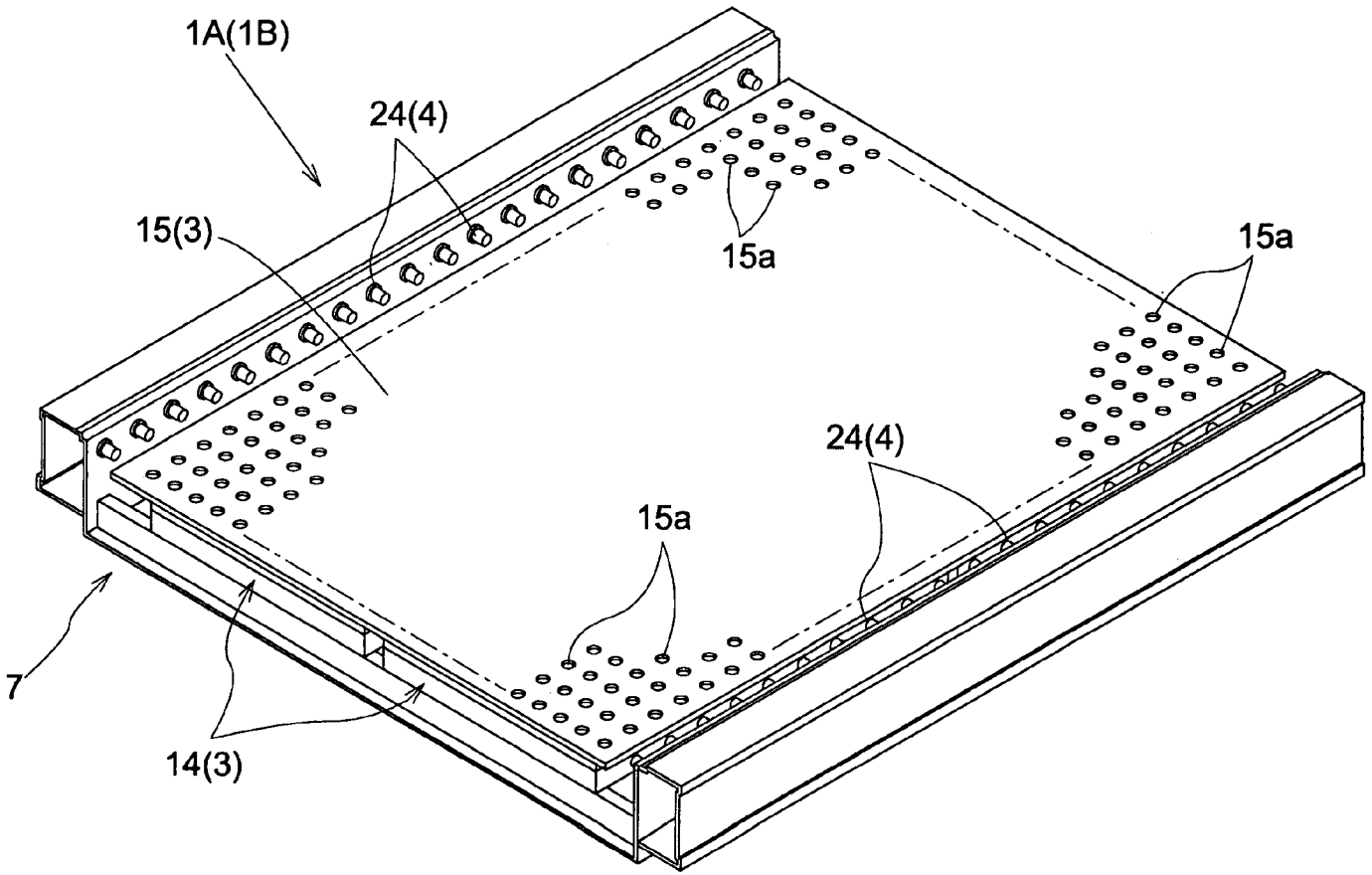
FIG. 39 is a perspective view of the first transport member according to the fourth embodiment.

Also, as shown in FIG. 34 and FIG. 39, each transport portion is structured such that the glass substrate 2 is supported by the air-supplying-type support means 3 in a contactless manner and by the drive force application means 4 in a contacting manner, and the supported glass substrate 2 is given a drive force in the transporting direction by the drive force application means 4 and thereby transported in the transporting direction. The air-supplying-type support means 3 and the drive force application means 4 are accommodated in the casing member 7.

The first transport members 1A have a single or a plurality of first transport units provided in the first transporting direction, the second transport members 1B have a single or a plurality of second transport units provided in the second transporting direction, and the relay transport member 1D has a single relay transport unit. That is, the transporting apparatus H has a combination of first transport units, second transport units, and a relay transport unit.

The relay transport member 1D is described below.

Figure 35:
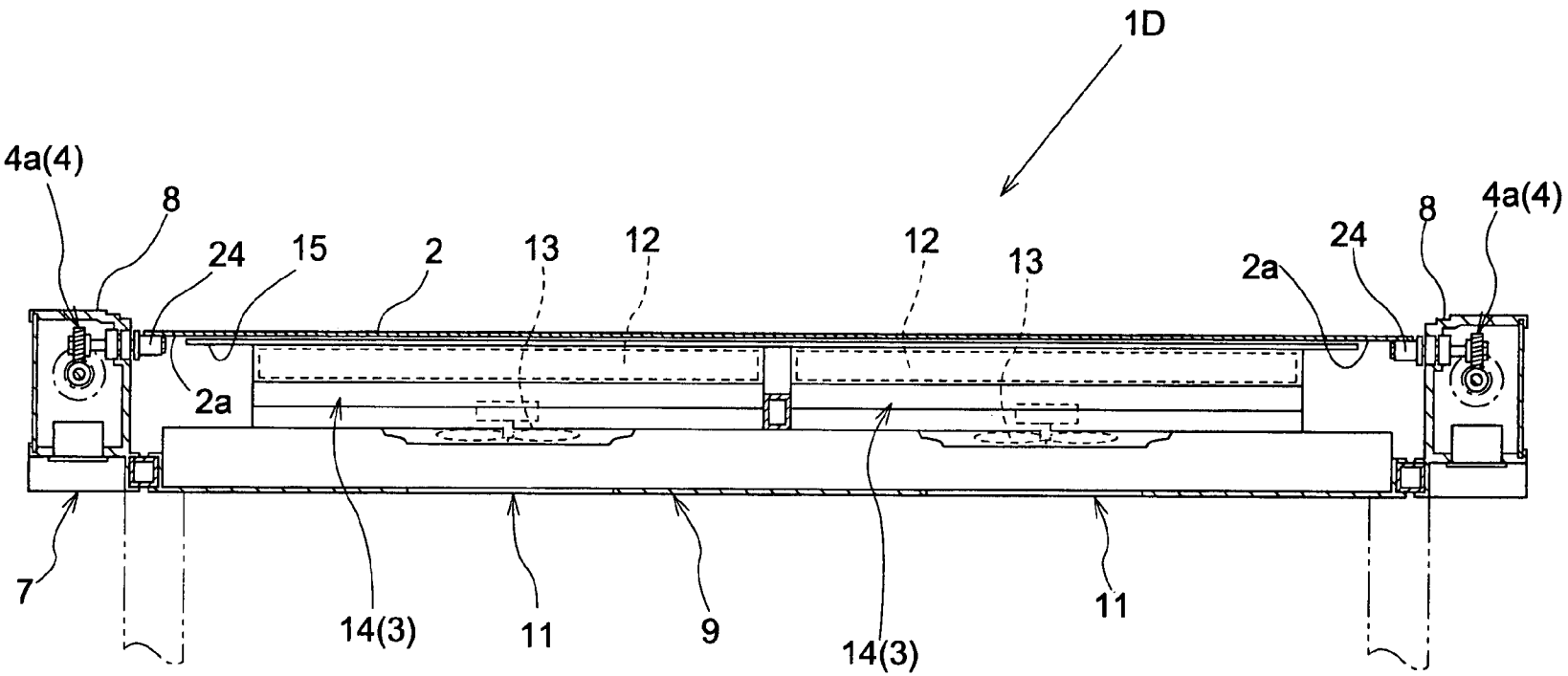
FIG. 35 is a front view of the relay transport unit according to the fourth embodiment.

As shown in FIGS. 34 and 35, the relay transport member 1D is constituted by the air-supplying-type support means 3 provided in the relay transport member 1D, the drive force application means 4 provided in the relay transport member 1D for applying a drive force in the first transporting direction to the glass substrate 2, an auxiliary drive means 6A for applying a drive force in the second transporting direction to the glass substrate 2, and the casing member 7 provided in the relay transport member 1D for accommodating the air-supplying-type support means 3, the drive force application means 4, and the auxiliary drive means 6A.

Figure 36:
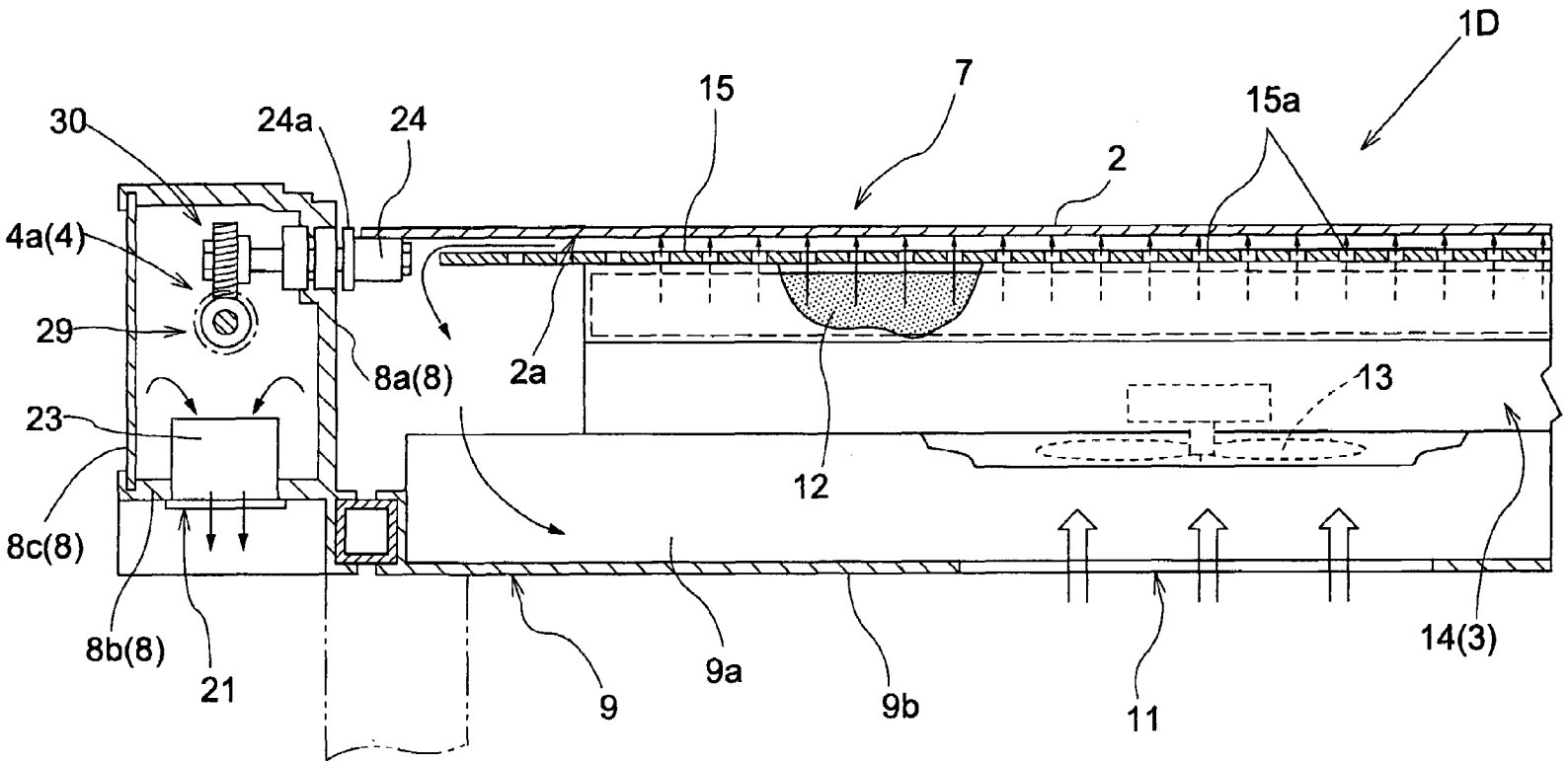
FIG. 36 is a partially magnified view of the relay transport member according to the fourth embodiment.

As shown in FIGS. 35 and 36, the casing member 7 provided in the relay transport member 1D is provided with a unit frame member 9 that is substantially rectangular in plan view and that supports the air-supplying-type support means 3 resting thereon, and the accommodation frames 8 provided in a fastened manner in the transporting direction to both ends in the width direction of the unit frame member 9.

The relay transport member 1D is provided with four fan filter units. Also, in its air rectifying plate (porous plate) 15 are formed through holes 15*a* by punch press and apertures for raising and lowering 15*b* formed such that the auxiliary drive means 6A can protrude above air-supplying-type support means 3.

Figure 37A:
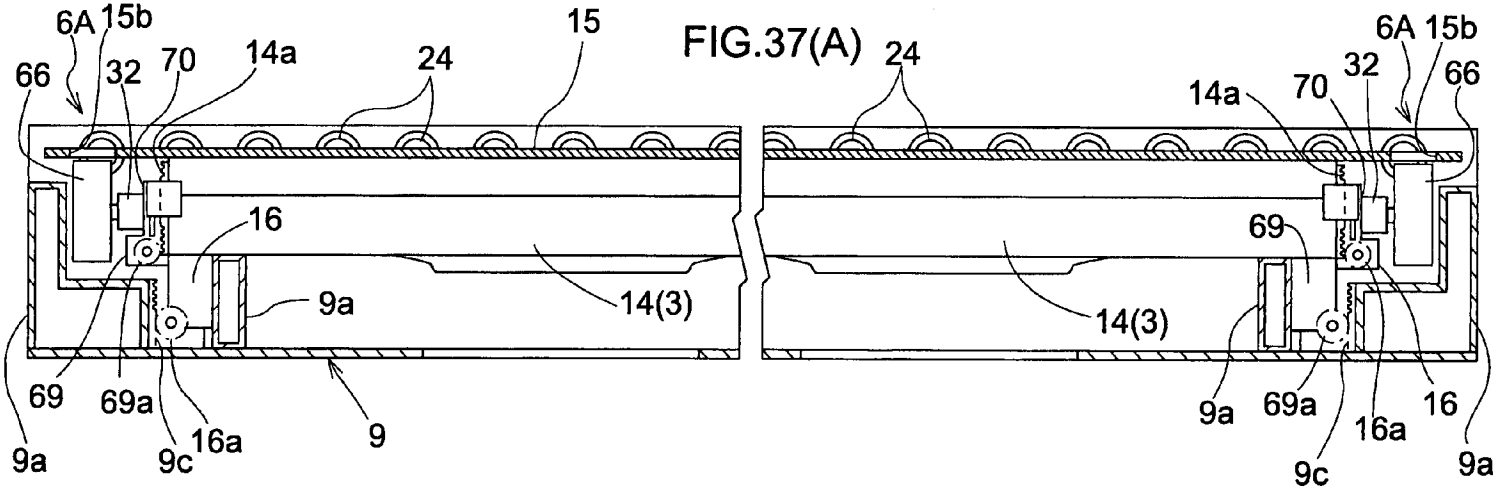
FIG. 37 is a lateral view of the relay transport member according to the fourth embodiment.
Figure 37B:
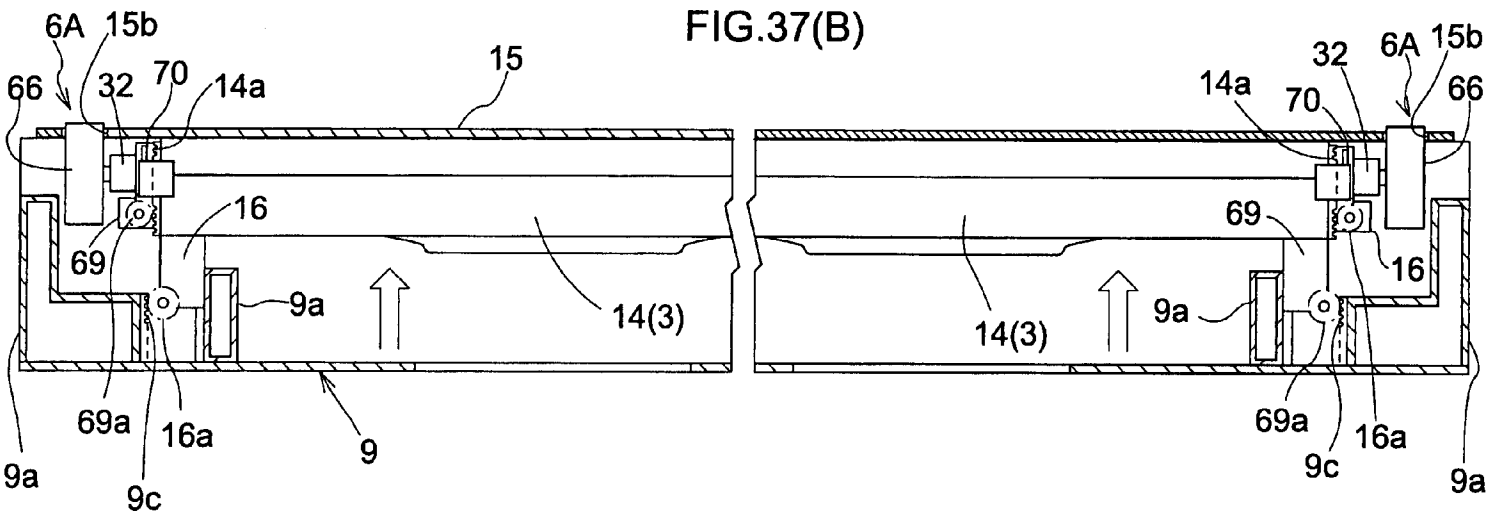

As shown in FIG. 37, electric support means motors 16 for raising and lowering the fan filter units 14 are provided on the lower surface of the fan filter units 14, and an output gear 16*a* of the support means motors 16 meshes with a gear groove 9*c* formed in the lateral surface of a support frame portion 9*a* of the unit frame member 9. Consequently, by rotatively driving the support means motors 16 forward and in reverse, the air-supplying-type support means 3 provided in the relay transport member 1D is raised and lowered.

As shown in FIGS. 34 and 35, the drive force application means 4 of the relay transport member 1D is configured for dual-side driving, being provided with a pair of drive force application portions 4*a* for supporting both end portions in the width direction of the glass substrate 2 in a contacting manner, and one drive force application portion 4*a* is provided in one of the pair of accommodation frames 8.

Figure 38:
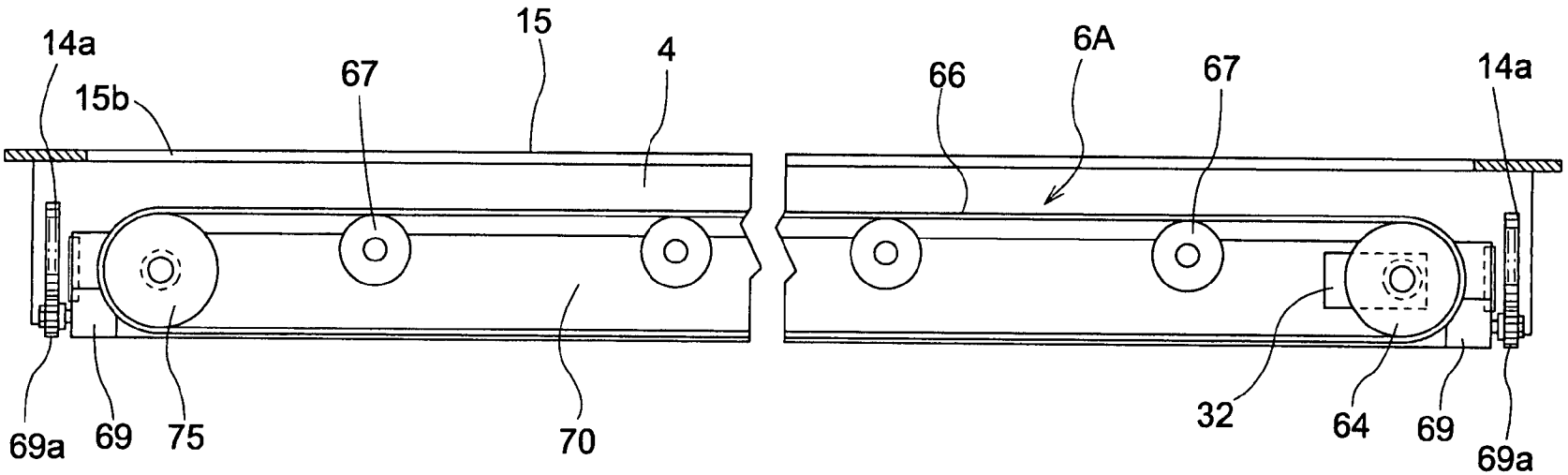
FIG. 38 is a lateral view of the auxiliary drive means according to the fourth embodiment.

The auxiliary drive means 6A is described next. As shown in FIGS. 37 and 38, the auxiliary drive means 6A has a drive wheel 64 that is positioned on the upstream side in the second transporting direction and that is rotated by an electric drive motor 32, a driven wheel 65 that is positioned on the transporting upstream side and that is can freely rotate, a timing belt 66 (one example of the drive rotor) wound between the drive wheel 64 and the driven wheel 65, inner support wheels 67 for supporting the send route portion of the timing belt 66 from its inner circumferential surface side, and a support frame 70 for supporting these.

The support frame 70 is provided with an electric drive means motor 69 for raising and lowering the auxiliary drive means 6A, and the output gear 69*a* of the drive means motor 69 and a gear groove 14*a* formed in the lateral surface of the fan filter units 14 mesh with one another. Consequently, the auxiliary drive means 6A is raised and lowered by rotatively driving the drive means motor 69 forward and in reverse.

The first transport member 1A is described below, and as shown in FIG. 39, it has the air-supplying-type support means 3 provided in the first transport member 1A, the drive force application means 4 provided in the first transport member 1A that is for applying a drive force in the first transporting direction to the glass substrate 2, and the casing member 7 provided in the first transport member for accommodating the air-supplying-type support means 3 and the drive force application means 4.

As shown in FIG. 40, the first transport member 1A is not provided with the auxiliary drive means 6A that is provided in the relay transport member 1D, and the air-supplying-type support means 3 provided in the first transport member 1A is fixedly supported on the support frame portion of the unit frame member 9 and cannot be raised and lowered.

It should be noted that due to the fact that the drive force application means 4 of the first transport member 1A supports both end portions in the width direction of the glass substrate 2 in a contacting manner and the drive force application means 4 of the second transport member 1B supports both end portions in the front-to-back direction of the glass substrate 2 in a contacting manner, the first transport member 1A and the second transport member 1B are structured to have different widths, but in other regards they are the same and thus description thereof is omitted.

Also, as shown in FIG. 40, the relay transport member 1D and the first transport member 1A are provided at the same or substantially the same height, and as shown in FIG. 41, the second transport member 1B is provided at a higher position than the relay transport member 1D.

Figure 40A:
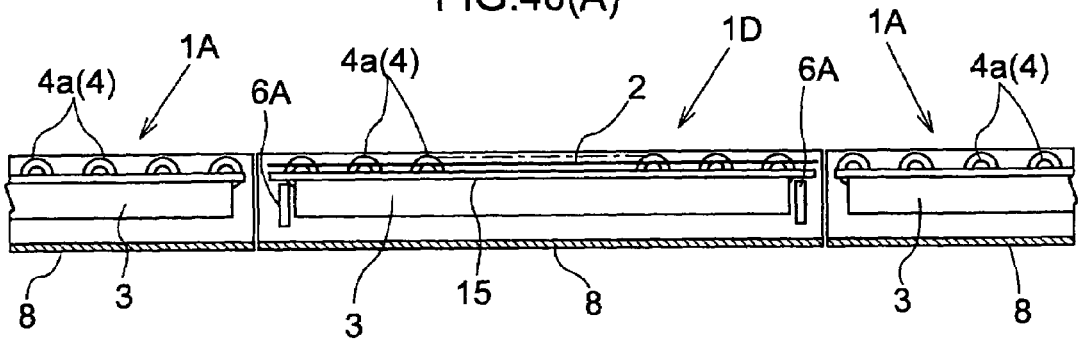
FIG. 40 is a lateral view showing the first transporting state and the second transporting state of the relay transport member according to the fourth embodiment.
Figure 40B:
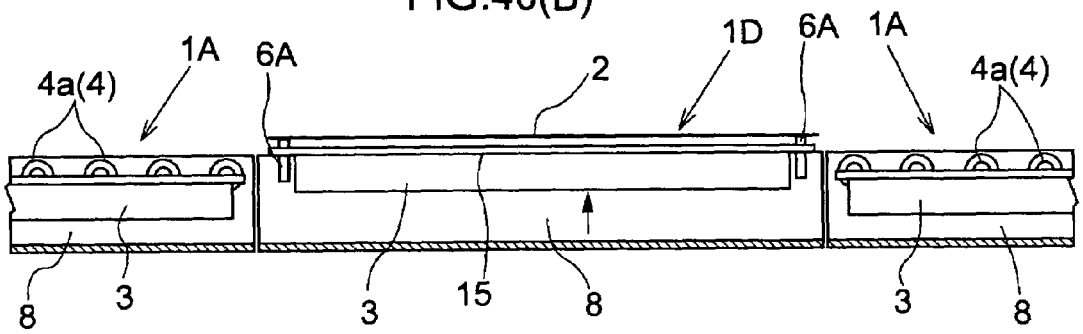
Figure 41A:
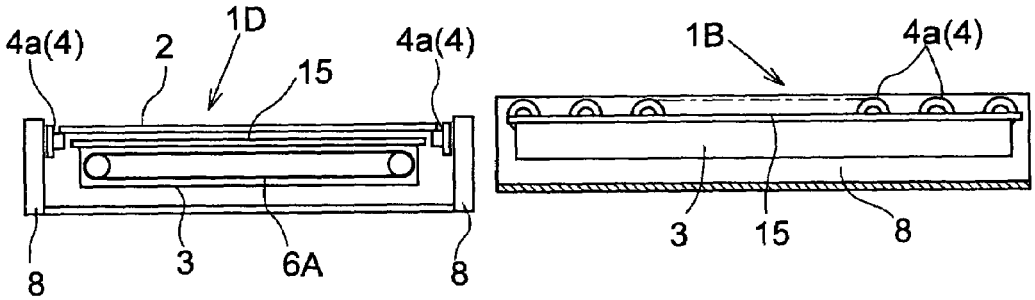
FIG. 41 is a front view showing the first transporting state and the second transporting state of the relay transport member according to the fourth embodiment.
Figure 41B:
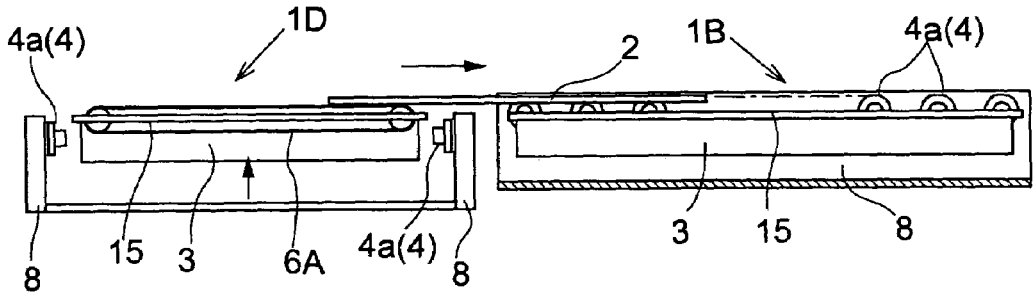

That is, the drive force application means 4 provided in the relay transport member ID, as shown in FIG. 40, is provided at the same or substantially the same height as the drive force application means 4 provided in the first transport member 1A, and as shown in FIG. 41, it is fixedly provided at a height that is lower than the drive force application means 4 provided in the second transport member 1B. Also, the air-supplying-type support means 3 provided in the relay transport member 1D is provided such that it can be raised and lowered between a lower position, such as that shown in FIG. 40A and FIG. 41A, where it supports the glass substrate 2 at the same or substantially the same height as the air-supplying-type support means 3 provided in the first transport member 1A, and an upper position, such as that shown in FIG. 40B and FIG. 41B, where it supports the glass substrate 2 at the same or substantially the same height as the air-supplying-type support means 3 provided in the second transport member 1B.

The transporting apparatus H is also provided with a detection sensor that is not shown for detecting whether or not the glass substrate is present, and control means that is not shown for controlling, based on the detection results of the detection sensor, the operations of the electric motor 25 in the drive force application means 4, the drive motor 32 in the auxiliary drive means 6A, the drive means motor 69 for raising and lowering the air-supplying-type support means 3, and the support means motor 16 for raising and lowering the auxiliary drive means 6A.

The manner in which the relay transport member 1D is switched between a first transporting state and a second transporting state is described next.

As discussed earlier, the air-supplying-type support means 3 provided in the relay transport member 1D is supported on the unit frame member 9 in such a manner that it can be raised and lowered, and the relay transport member 1D, by lowering the air-supplying-type support means 3 provided in the relay transport member 1D to the lower position, is put into the first transporting state in which the glass substrate 2 that is similarly lowered is brought into contact with and supported by the drive force application means 4 provided in the relay transport member 1D, and by raising the air-supplying-type support means 3 provided in the relay transport member 1D to the upper position, is put into the second transporting state in which the glass substrate 2 that is similarly raised is not in contact with the drive force application means 4 provided in the relay transport member 1D.

The relay transport member 1D is structured such that in the first transporting state, the glass substrate 2 is transported between the relay transport member 1D and the first transport member 1A by the drive force from the drive force application means 4 provided in the relay transport member 1D, and in the second transporting state, the glass substrate 2 is transported between the relay transport member 1D and the second transport member 1B by the drive force in the second transporting direction from the auxiliary drive means 6A.

As mentioned above, the auxiliary drive means 6A also is supported on the unit frame member 9 in such a manner that it can be raised and lowered, and the auxiliary drive means 6A is structured so that it can be raised and lowered such that it is raised to support the lower surface 2*a* of the glass substrate 2 in the second transporting state in a contacting manner with the timing belt 66, and is lowered to cancel contacting support of the lower surface 2*a* of the glass substrate 2 in the first transporting state.

It should be noted that in the second transporting state, the lower surface 2*a* of the glass substrate 2 supported by the air-supplying-type support means 3 provided in the relay transport member 1D is positioned higher than the upper end of the drive force application means 4 provided in the relay transport member 1D and the upper end of the accommodation frames 8 provided in the relay transport member 1D so that the drive force application means 4 and the accommodation frames 8 do no interfere with the glass substrate 2 even if the glass substrate 2 is transported unchanged horizontally in the second transporting direction.

The following description regards the cases of performing a first transport, as shown by the arrow A in FIG. 33, in which a glass substrate 2 is delivered from the first transport member 1A on the transporting upstream side to a relay transport member 1D, and without changing the transporting direction of the glass substrate 2 that has been delivered, transporting it to the first transport member 1A on the transporting downstream side, a branching transport, as shown by the arrow B, in which a glass substrate 2 is delivered from a first transport member 1A to a relay transport member 1D, the transporting direction of the glass substrate 2 that has been delivered is switched from the first transporting direction to the second transporting direction, and the glass substrate 2 is transported to a second transport member 1B, and a merging transport, as shown by the arrow C, in which a glass substrate 2 is delivered from a second transport member 1B to a relay transport member 1D, the transporting direction of the glass substrate 2 that has been delivered is switched from the second transporting direction to the first transporting direction, and the glass substrate 2 is transported to a first transport member 1A.

First, in the case of performing a first transport as indicated by the arrow A, in FIGS. 40A and 41A, the air-supplying-type support means 3 provided in the relay transport member 1D is lowered to the lower position to set the relay transport member 1D to the first transporting state, and the auxiliary drive means 6A is lowered to cancel contacting support of the lower surface 2*a* of the glass substrate 2. By activating the drive force application means 4 provided in the first transport member 1A and the drive force application means 4 provided in the relay transport member 1D in this state to apply a drive force in the first transporting direction to the glass substrate 2, the glass substrate 2 is delivered from a first transport member 1A on the transporting upstream side to the relay transport member 1D, and the glass substrate 2 that has been delivered is transported to a first transport member 1A on the transporting downstream side without changing its transporting direction.

In the case of performing a branching transport as indicated by the arrow B, in FIGS. 40A and 41A, the air-supplying-type support means 3 provided in the relay transport member 1D is lowered to the lower position to set the relay transport member 1D to the first transporting state, and the auxiliary drive means 6A is lowered to release contacting support of the lower surface 2*a* of the glass substrate 2 in the first transporting state. The drive force application means 4 provided in the first transport member 1A and the drive force application means provided in the relay transport member 1D are activated in this state to apply a drive force in the first transporting direction to the glass substrate 2 to deliver the glass substrate 2 from the first transport member 1A to the relay transport member 1D, and when the detection sensor detects that the glass substrate 2 that has been delivered has been transported up to a predetermined position of the relay transport member 1D, actuation of the drive force application means 4 is stopped.

Then, as shown in FIG. 40B and FIG. 41B, the air-supplying-type support means 3 provided in the relay transport member 1D is raised to the upper position to set the relay transport member 1D to the second transporting state. The auxiliary drive means 6A at this time is raised up before the air-supplying-type support means 3 is raised so as to support the glass substrate 2, which is contactlessly supported by the air-supplying-type support means 3 in the first transporting state, in a contacting manner in cooperation with the drive force application means 4. The auxiliary drive means 6A also is raised up in coordination with the raising of the air-supplying-type support means 3 in order to maintain contacting support of the lower surface 2*a* of the glass substrate 2, thereby supporting, in a contacting manner, the glass substrate 2, which was contactlessly supported by the air-supplying-type support means 3 in the second transporting state, with only the auxiliary drive means 6A.

In the second transporting state, the auxiliary drive means 6A and the drive force application means 4 provided in the first transport member 1A are actuated to apply a drive force in the second transporting direction to the glass substrate 2, thereby transporting the glass substrate 2 from the relay transport member 1D to the second transport member 1B.

Lastly, in the case of performing a merging transport as indicated by the arrow C, in FIG. 40B and FIG. 41B, the air-supplying-type support means 3 provided in the relay transport member 1D is raised to the upper position to set the relay transport member 1D to the second transporting state, and the auxiliary drive means 6A is raised to support the lower surface 2*a* of the glass substrate 2 in the second transporting state in a contacting manner. The auxiliary drive means 6A and the drive force application means 4 provided in the second transport member 1B are actuated in this state to apply a drive force in the second transporting direction to the glass substrate 2 to deliver the glass substrate 2 from the second transport member 1B to the relay transport member 1D, and when the detection sensor detects that the glass substrate 2 that has been delivered has been transported up to a predetermined position of the relay transport member 1D, actuation of the auxiliary drive means 6A is stopped.

Then, as shown in FIG. 40A and FIG. 41A, the air-supplying-type support means 3 provided in the relay transport member 1D is lowered to the lower position to set the relay transport member 1D to the first transporting state. The auxiliary drive means 6A at this time is lowered in conjunction with lowering of the air-supplying-type support means 3 in order to maintain contacting support of lower surface 2*a* of the glass substrate 2, thereby supporting the glass substrate 2 that is contactlessly supported by the air-supplying-type support means 3 in the first transporting state in a contacting manner in cooperation with the drive force application means 4. The auxiliary drive means 6A is further lowered to release supporting contact of the lower surface 2*a* of the glass substrate 2 by the auxiliary drive means 6A, so that the glass substrate 2 that is contactlessly supported by the air-supplying-type support means 3 in the first transporting state is supported in a contacting manner by only the drive force application means 4.

In the first transporting state, the drive force application means 4 provided in the first transport member 1A and the drive force application means 4 provided in the relay transport member 1D are actuated to apply a drive force in the first transporting direction to the glass substrate 2, thereby transporting the glass substrate 2 from the relay transport member 1D to the second transport member 1B.

Fifth Embodiment

A case in which the relay transport member 1D is switched between the first transporting state and the second transporting state by raising and lowering the drive force application means provided in the relay transport member 1D is described next with reference to the drawings.

Figure 43:
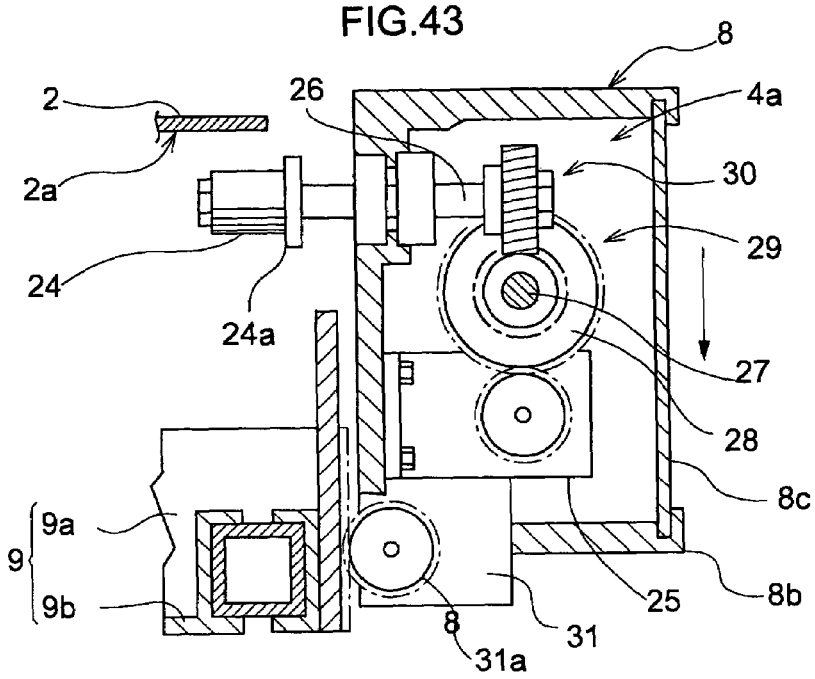
FIG. 43 is a front view of the drive force application means according to the fifth embodiment.

As shown in FIG. 43, the accommodation frame 8 of the two accommodation frames 8 that is positioned on the downstream side in the second transporting direction is supported on the unit frame member 9 in such a manner that can be raised and lowered. That is, an electric frame motor 31 for raising and lowering the accommodation frame 8 is provided on the lower surface of one of the accommodation frames 8, and the output gear 31*a* of the frame motor 31 meshes with a gear groove formed in the lateral surface of the support frame portion 9*a* in the unit frame member 9. Consequently, that accommodation frame 8 is raised and lowered by rotatively driving the frame motor 31 forward and in reverse, thereby raising and lowering the one drive force application portion 4*a* in the drive force application means 4 provided in that accommodation frame 8.

Figure 42A:
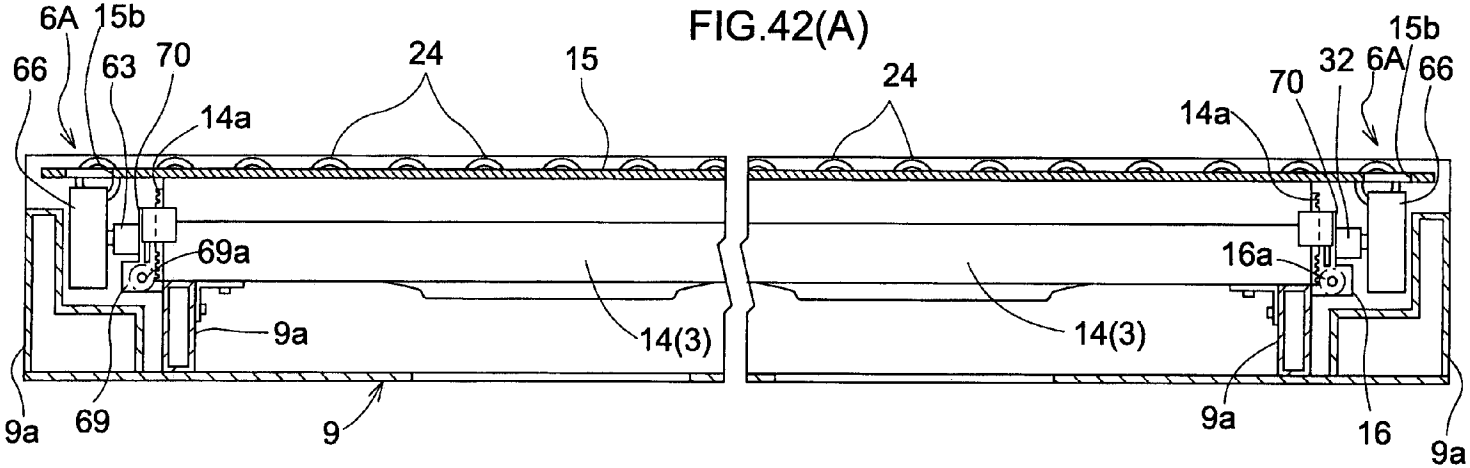
FIG. 42 is a lateral view of the relay transport member according to the fifth embodiment.
Figure 42B:
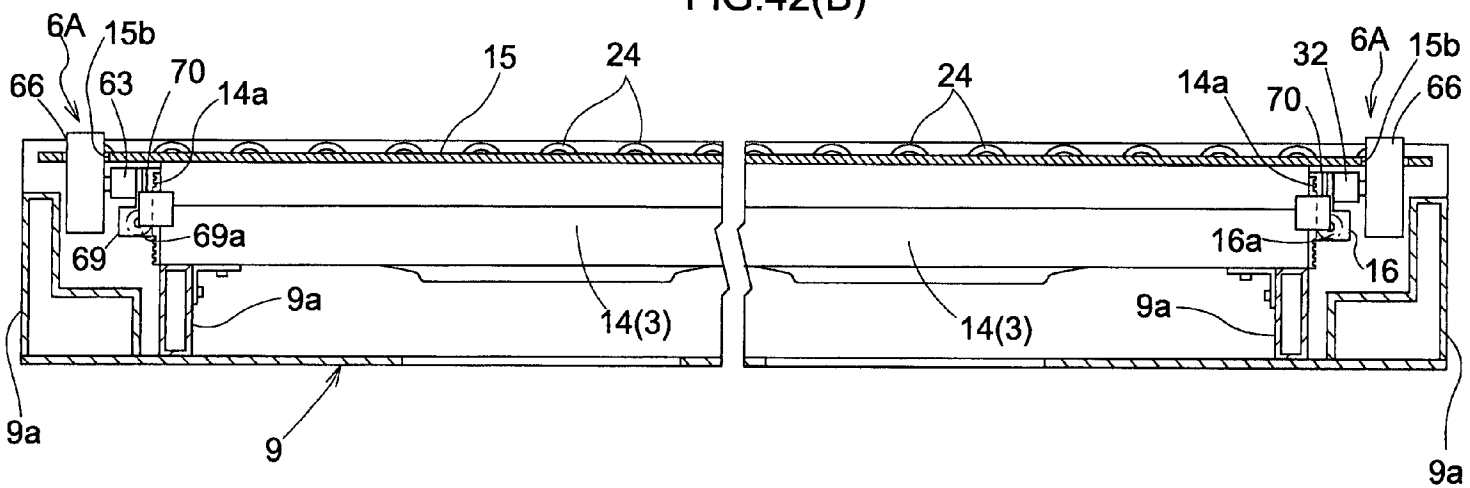

As shown in FIG. 42, the air-supplying-type support means 3 in the relay transport member 1D is fixedly supported on the unit frame member 9.

Also, as shown in FIG. 44 and FIG. 45, the relay transport member 1D, the first transport member 1A, and the second transport member 1B are provided at the same or substantially the same height.

Figure 44A:
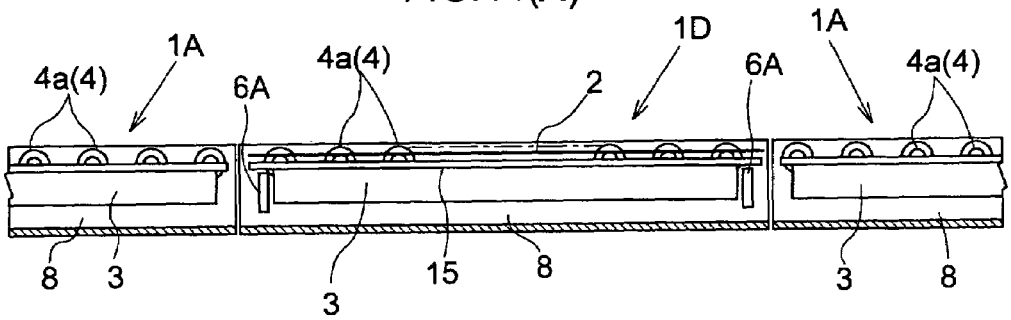
FIG. 44 is a lateral view showing the first transporting state and the second transporting state of the relay transport member according to the fifth embodiment.
Figure 44B:
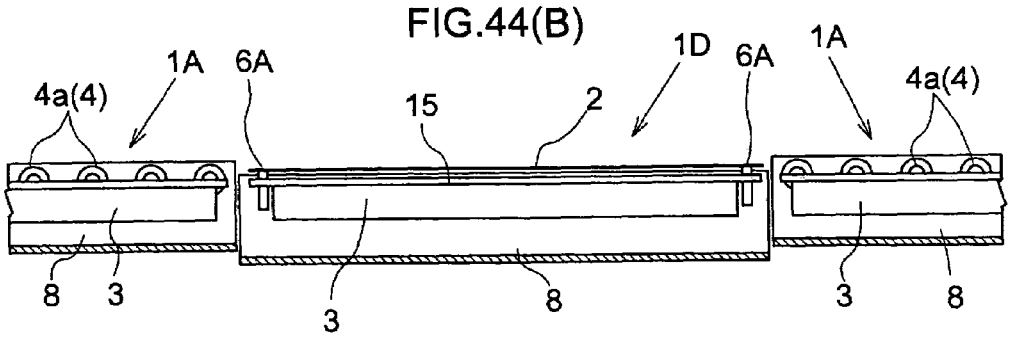
Figure 45A:
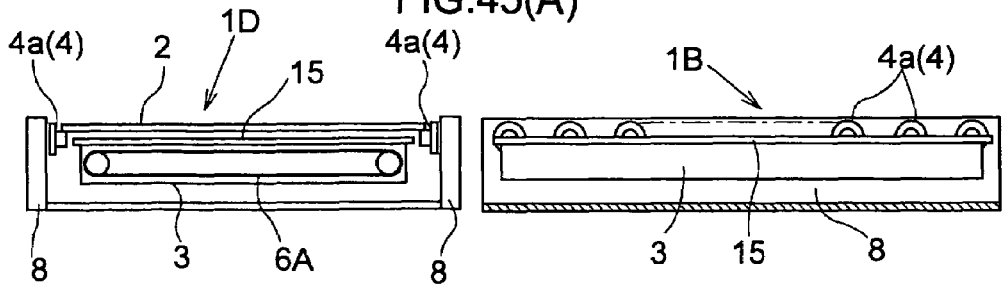
FIG. 45 is a front view showing the first transporting state and the second transporting state of the relay transport member according to the fifth embodiment.
Figure 45B:
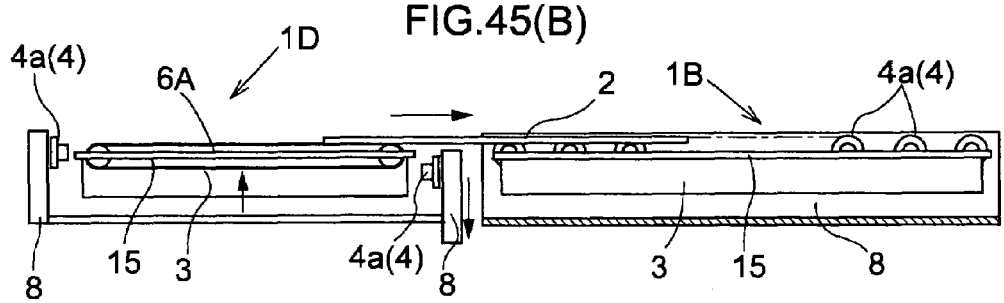
Figure 46:
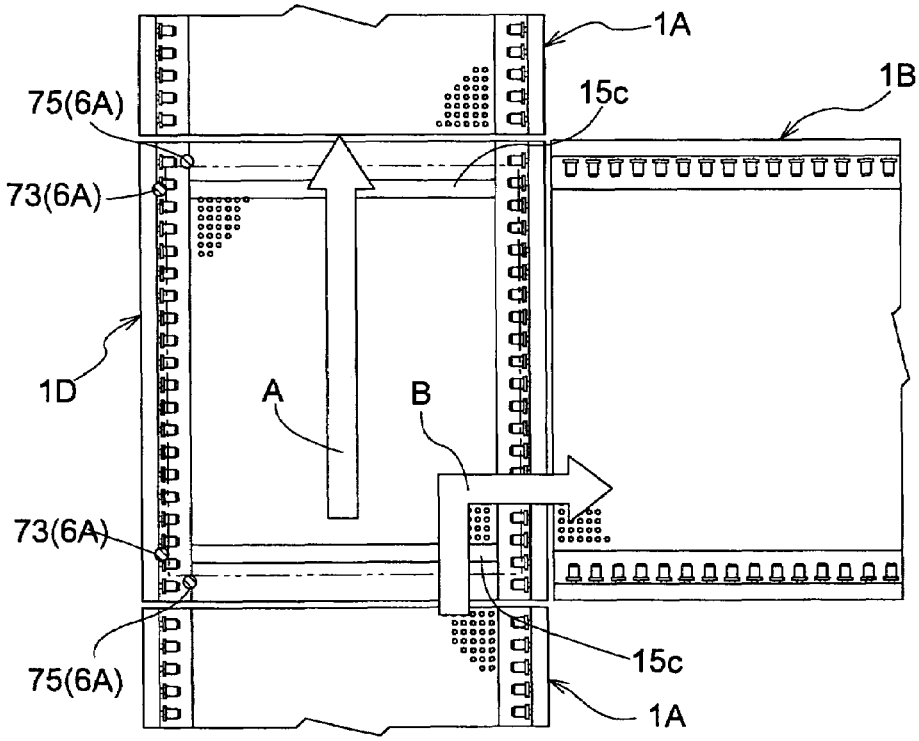
FIG. 46 is a plan view of the transporting apparatus according to the other embodiment (7)

That is, as shown in FIG. 44 and FIG. 45, the air-supplying-type support means 3 provided in the relay transport member 1D is provided at a height where it supports the glass substrate 2 at the same or substantially the same height as the air-supplying-type support means 3 provided in the first transport member 1A and the air-supplying-type support means 3 provided in the second transport member 1B, and the drive force application means 4 (one of the drive force application portions 4*a*) is provided in the relay transport member such that it can be freely raised and lowered, such that in the first transporting state it is in an upper position where it is positioned at the same or substantially the same height as the drive force application means 4 provided in the first transport member 1A as shown in FIG. 44A, and in the second transporting state it is in a lower position where it is located lower than the drive force application means 4 provided in the second transport member 1B as shown in FIG. 45B.

The manner in which the relay transport member 1D is switched between the first transporting state and the second transporting state is described below.

As discussed above, the drive force application means 4 provided in the relay transport member 1D is provided such that it can be raised and lowered, and the relay transport member 1D, by raising the one drive force application portion 4*a* in the drive force application means 4 to the upper position, is put into a first transporting state in which it supports the lower surface 2*a* of the glass substrate 2 that is supported by the air-supplying-type support means 3 provided in the relay transport member 1D in a contacting manner, and by lowering the drive force application means 4 to the lower position, the relay transport member is put into a second transporting state in which the drive force application means 4 does not contact the lower surface of the glass substrate 2 supported by the air-supplying-type support means 3 provided in the relay transport member 1D (the one drive force application portion 4*a* is not in contact but the other drive force application portion is in contact).

A first transport as indicated by the arrow A, a branching transport as indicated by the arrow B, and a merging transport as indicated by the arrow C in FIG. 33 are performed as described below.

First, in the case of transporting the glass substrate as indicated by the arrow A, in FIGS. 44A and 45A, the drive force application means 4 provided in the relay transport member 1D is raised to the upper position to set the relay transport member 1D to the first transporting state, and the auxiliary drive means 6A is lowered to cancel contacting support of the lower surface 2*a* of the glass substrate 2. In this state a drive force is applied in the first transporting direction to the glass substrate 2 by actuating the drive force application means 4 to deliver the glass substrate 2 from the first transport member 1A on the transporting upstream side to the relay transport member 1D, and without changing the transporting direction of the glass substrate 2 that has been delivered, it is transported to the first transport member 1A on the transporting downstream side.

In the case of transporting the glass substrate 2 as indicated by the arrow B, in FIGS. 44A and 45A, the drive force application means 4 provided in the relay transport member 1D is raised to the upper position to set the relay transport member 1D to the first transporting state, and the auxiliary drive means 6A is lowered to cancel contacting support of the lower surface 2*a* of the glass substrate 2 in the first transporting state. In this state a drive force is applied in the first transporting direction to the glass substrate 2 by actuating the drive force application means 4 provided in the first transport member 1A and the drive force application means 4 provided in the relay transport member 1D to deliver the glass substrate 2 from a first transport member 1A to the relay transport member 1D, and when the detection sensor detects that the glass substrate 2 that has been delivered has been transported up to a predetermined position of the relay transport member 1D, actuation of the drive force application means 4 is stopped.

Then, the auxiliary drive means 6A is raised up to support the lower surface of the glass substrate 2 in the first transporting state in a contacting manner with the auxiliary drive means 6A, so that the glass substrate 2 that is contactlessly supported by the air-supplying-type support means 3 in the first transporting state is supported in a contacting manner by the drive force application means 4 and the auxiliary drive means 6A. The drive force application means 4 provided in the relay transport member 1D is then lowered to the lower position to release contacting support of the lower surface 2*a* of the glass substrate 2 by the drive force application means 4, putting the relay transport member 1D in the second transporting state shown in FIG. 44B and FIG. 45B, in which the lower surface 2*a* of the glass substrate 2 that is contactlessly supported by the air-supplying-type support means 3 in the first transporting state is supporting in a contacting manner by the other drive force application portion 4*a* and the auxiliary drive means 6A.

In this second transporting state, the auxiliary drive means 6A and the drive force application means 4 provided in the first transport member 1A are actuated to apply a drive force in the second transporting direction to the glass substrate 2, thereby transporting the glass substrate 2 from the relay transport member 1D to the second transport member 1B.

Lastly, in the case of transporting the glass substrate 2 as shown by the arrow C, in FIGS. 44B and 45B, the drive force application means 4 provided in the relay transport member 1D is lowered to the lower position to set the relay transport member 1D to the second transporting state, and the auxiliary drive means 6A is raised to support the glass substrate 2 in a contacting manner in the second transporting state. In this state a drive force is applied in the second transporting direction to the glass substrate 2 by actuating the auxiliary drive means 6A and the drive force application means 4 provided in the second transport member 1B to deliver the glass substrate 2 from the second transport member 1B to the relay transport member 1D, and when the detection sensor detects that the glass substrate 2 that has been delivered has been transported up to a predetermined position of the relay transport member 1D, actuation of the auxiliary drive means 6A is stopped.

Then, as shown in FIGS. 44A and 45A, the drive force application means 4 provided in the relay transport member 1D is raised to the upper position to set the relay transport member 1D to the first transporting state so that the glass substrate 2 that is contactlessly supported by the air-supplying-type support means 3 is supported in a contacting manner by the drive force application means 4 and the auxiliary drive means 6A. The auxiliary drive means 6A is then lowered to cancel supporting contact of the lower surface 2*a* of the glass substrate 2 by the auxiliary drive means 6A, such that the glass substrate 2 that is contactlessly supported by the air-supplying-type support means 3 in the first transporting state is supported in a contacting manner by only the drive force application means 4.

In the first transporting state, the drive force application means 4 provided in the first transport member 1A and the drive force application means 4 provided in the relay transport member 1D are actuated to apply a drive force in the first transporting direction to the glass substrate 2, thereby transporting the glass substrate 2 from the relay transport member 1D to the second transport member 1B.

Sixth Embodiment

A sixth embodiment of the present invention, in which means for changing the transporting orientation of the transported object is provided, is described next.

Figure 51:
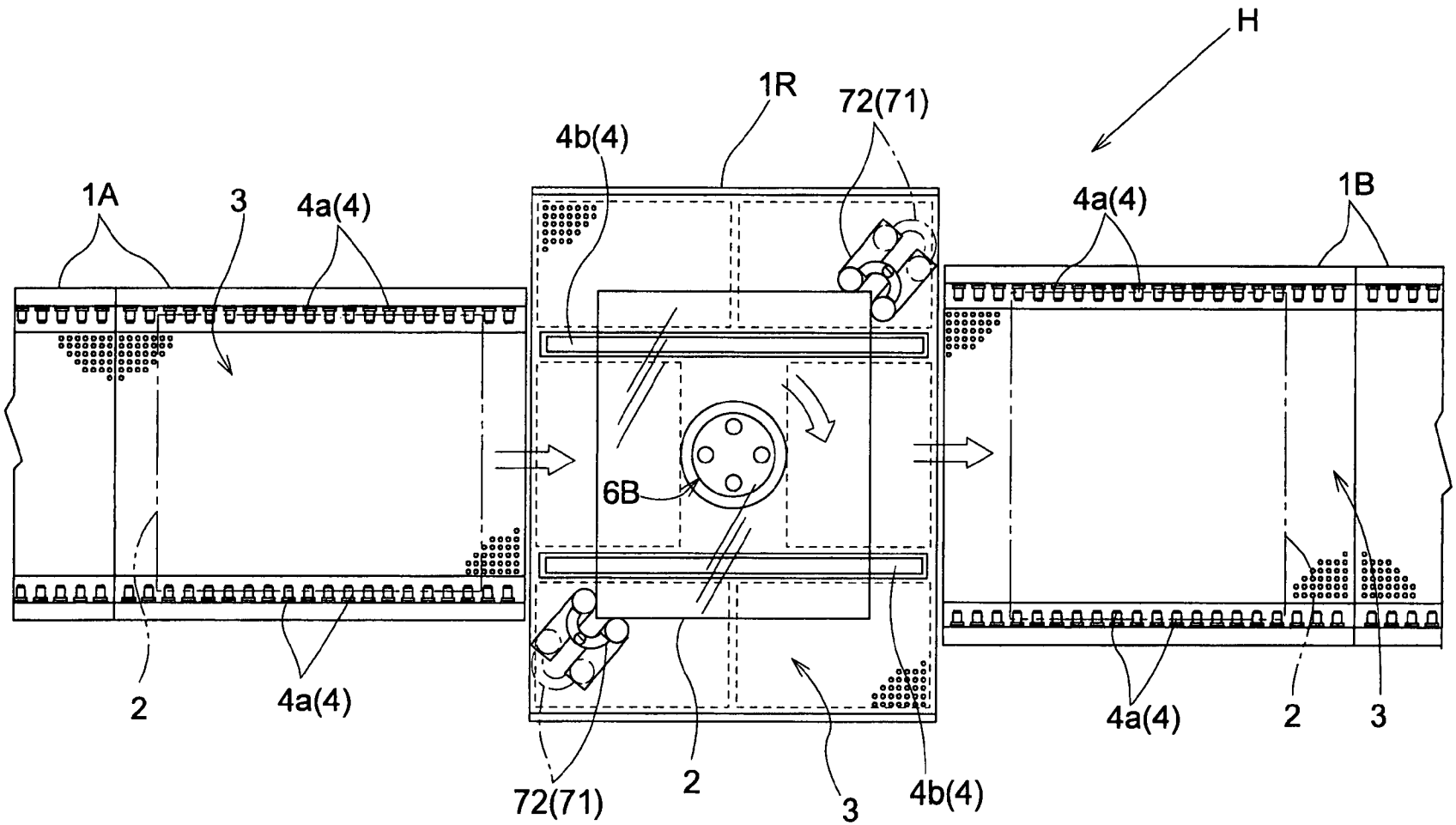
FIG. 51 is a plan view of the transporting apparatus according to the sixth embodiment.

As shown in FIG. 51, a transporting apparatus H is provided with a first transport member 1A for transporting the glass substrate 2 in a first transporting orientation with its lengthwise direction in the transporting direction, a second transport member 1B for transporting the glass substrate 2 in a second transporting orientation that is rotated by a predetermined angle, such as 90°, about a vertical axis from the first transporting orientation, and a relay transport member 1R positioned at a spot where it connects the first transport member 1A and the second transport member 1B and transports the glass substrate 2 to and from the first transport member 1A and the second transport member 1B, as transport portions.

Figure 52:
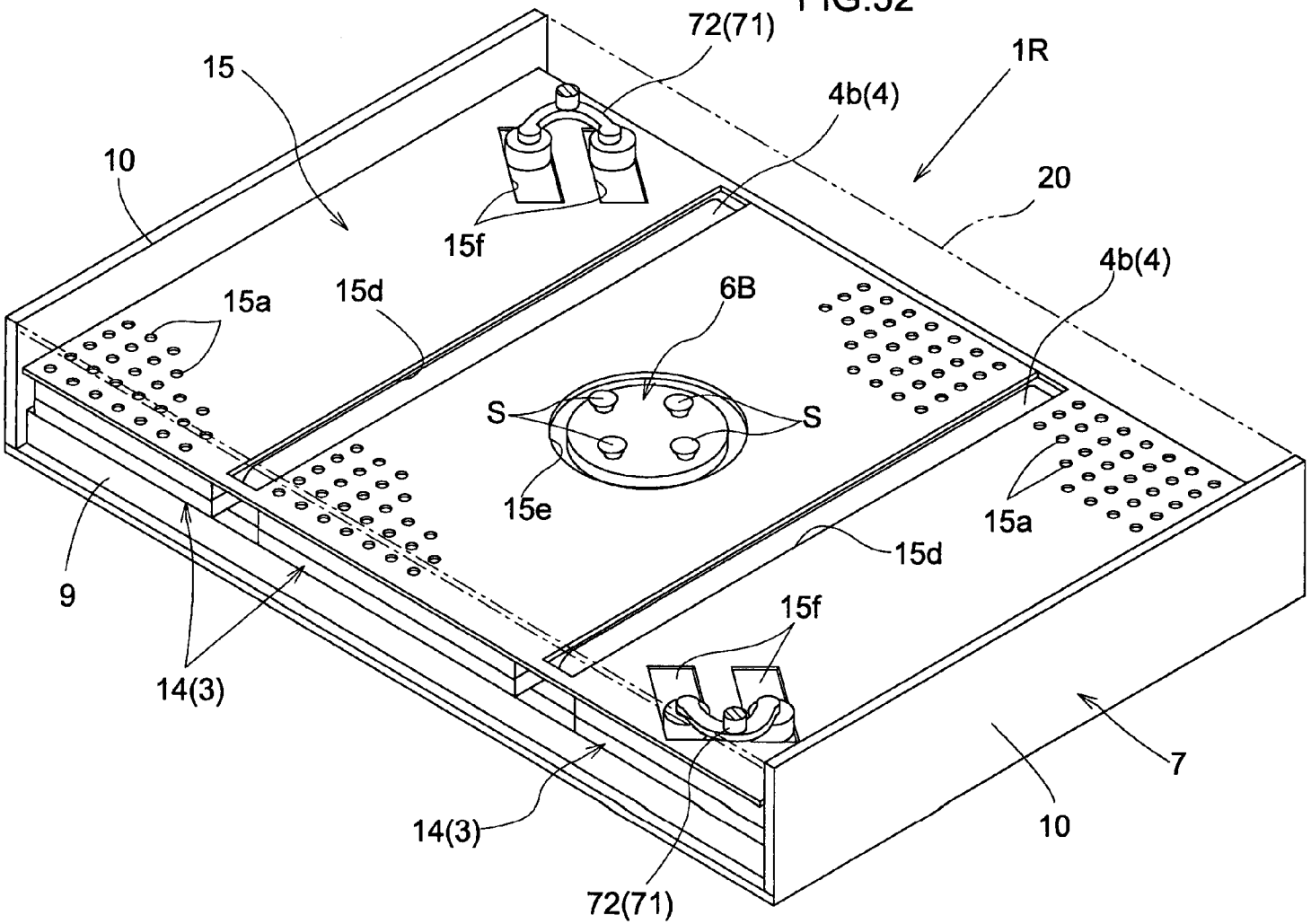
FIG. 52 is a perspective view of the relay transport member according to the sixth embodiment.

Also, as shown in FIG. 52, each transport portion is structured such that it supports the glass substrate 2 with the air-supplying-type support means 3 in a contactless manner and with the drive force application means 4 in a contacting manner, and supplies the supported glass substrate 2 with a drive force in the transporting direction by the drive force application means 4 to transport the glass substrate 2 in the transporting direction, and the air-supplying-type support means 3 and the drive force application means 4 are accommodated in the casing member 7.

The first transport member 1A has a single or a plurality of first transport units lined up side by side, the second transport member 1B has a single or a plurality of second transport units lined up side by side, and the relay transport member 1R has a single relay transport unit. That is, the transporting apparatus H has a combination of first transport units, second transport units, and a relay transport unit.

The relay transport member 1R is described below.

Figure 53:
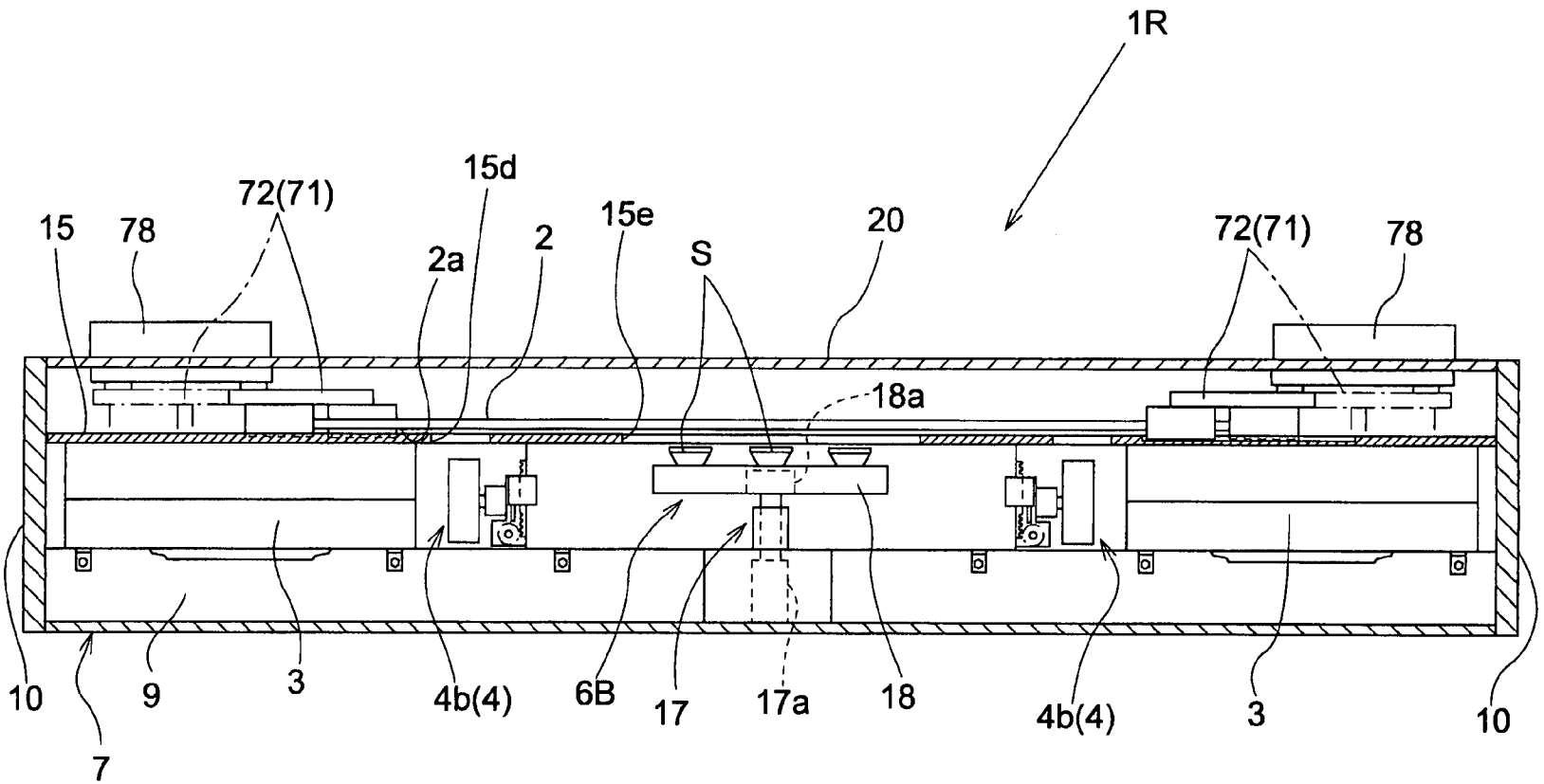
FIG. 53 is a front view of the relay transport member according to the sixth embodiment.

FIGS. 52 and 53 show that the relay transport member 1R has the air-supplying-type means 3 provided in the relay transport member 1R, the drive force application means 4 provided in the relay transport member 1R for applying a drive force in the transporting direction to the glass substrate 2, orientation changing means 6B for switching the glass substrate 2 between a first transporting orientation and a second transporting orientation, orientation correcting means 71 for correcting shifting in the orientation of the glass substrate 2, and the casing member 7 provided in the relay transport member 1R for accommodating the air-supplying-type support means 3, the drive force application means 4, the orientation changing means 6B, and the orientation correcting means 71.

The air-supplying-type support means 3 is provided with a total of six fan filter units, these being two fan filter units 14 lined up in the front-to-back direction and three lined up in the width direction. The two fan filter units lined up in the width direction are provided sideways, and a space through which the orientation changing means 6B can be raised and lowered is formed in a center portion of the air-supplying-type support means 3. Also, a changing means aperture 15*e* is formed in the air rectifying plate 15 such that the orientation changing means 6B can protrude above the air-supplying-type support means 3.

It should be noted that in addition to the changing means aperture 15*e*, the air rectifying plate 15 is also furnished with through holes 15*a* formed by punching, application means apertures 15*d* formed such that the drive force application means 4 can protrude above the air-supplying-type support means 3, and recessed portions 15*f* into which a portion of the orientation changing means 72 enters.

The drive force application means 4 provided in the relay transport member 1R is described next. As shown in FIG. 52 and FIG. 53, the drive force application means 4 is configured for dual-side driving and is provided with a pair of belt-shaped drive force application portions (one example of the drive force application portions) 4*b* for supporting both end portions in the width direction of the glass substrate 2 in a contacting manner. As shown in FIG. 53, these two belt-shaped drive force application portions 4*b* are split between two gaps in the front-to-back direction that are formed by lining up three fan filter units 14 in the width direction, and in the case of supporting a glass substrate 2 in the first transporting orientation, which has a narrow width, the belt-shaped drive force application portions 4*b* support both ends of the glass substrate 2 toward the center, and in the case of supporting a glass substrate 2 in the second transporting orientation, which has a wide width, the belt-shaped drive force application portions 4*b* support both ends of the glass substrate 2 toward the outer edge.

Figure 56:
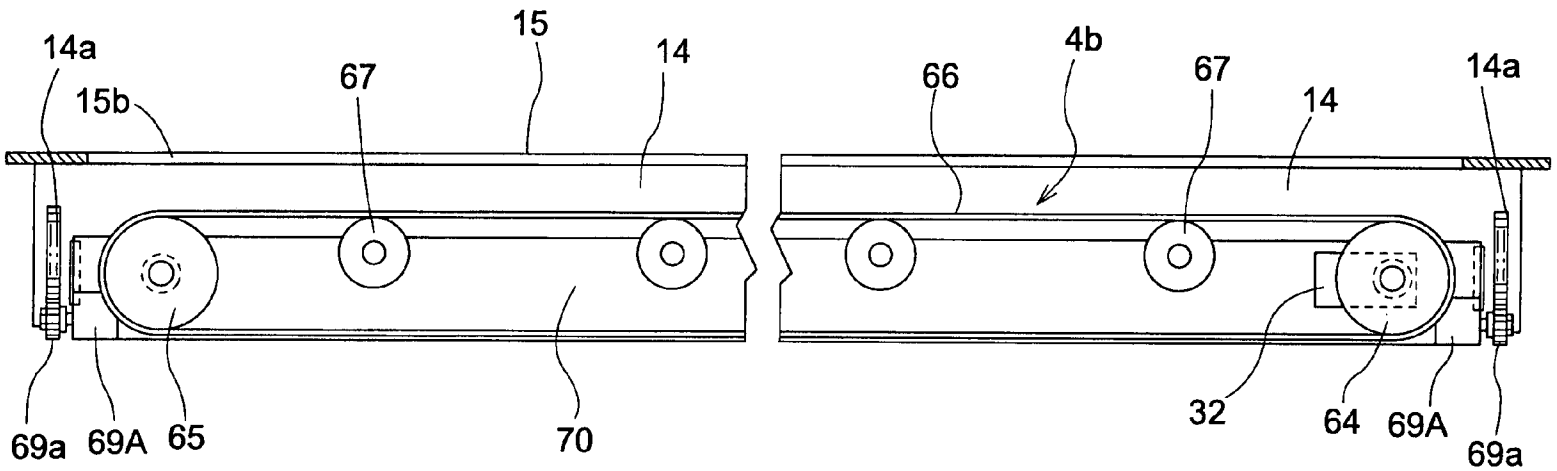
FIG. 56 is a lateral view of the belt-shaped drive force application portion according to the sixth embodiment.

As shown in FIG. 56, each belt-shaped drive force application portion 4*b* has a drive wheel 64 that is positioned on the upstream side in the transporting direction and that is rotated by an electric drive motor 32, a driven wheel 65 that is positioned on the transporting upstream side and that is can rotate freely, a timing belt 66 that is wound between the drive wheel 64 and the driven wheel 65 and that supports the lower surface 2*a* of the glass substrate 2 in a contacting manner and applies a drive force thereto, inner support wheels 67 for supporting the send route portion of the timing belt 66 from its inner circumferential surface side, and a support frame 70 for supporting these.

Figure 54:
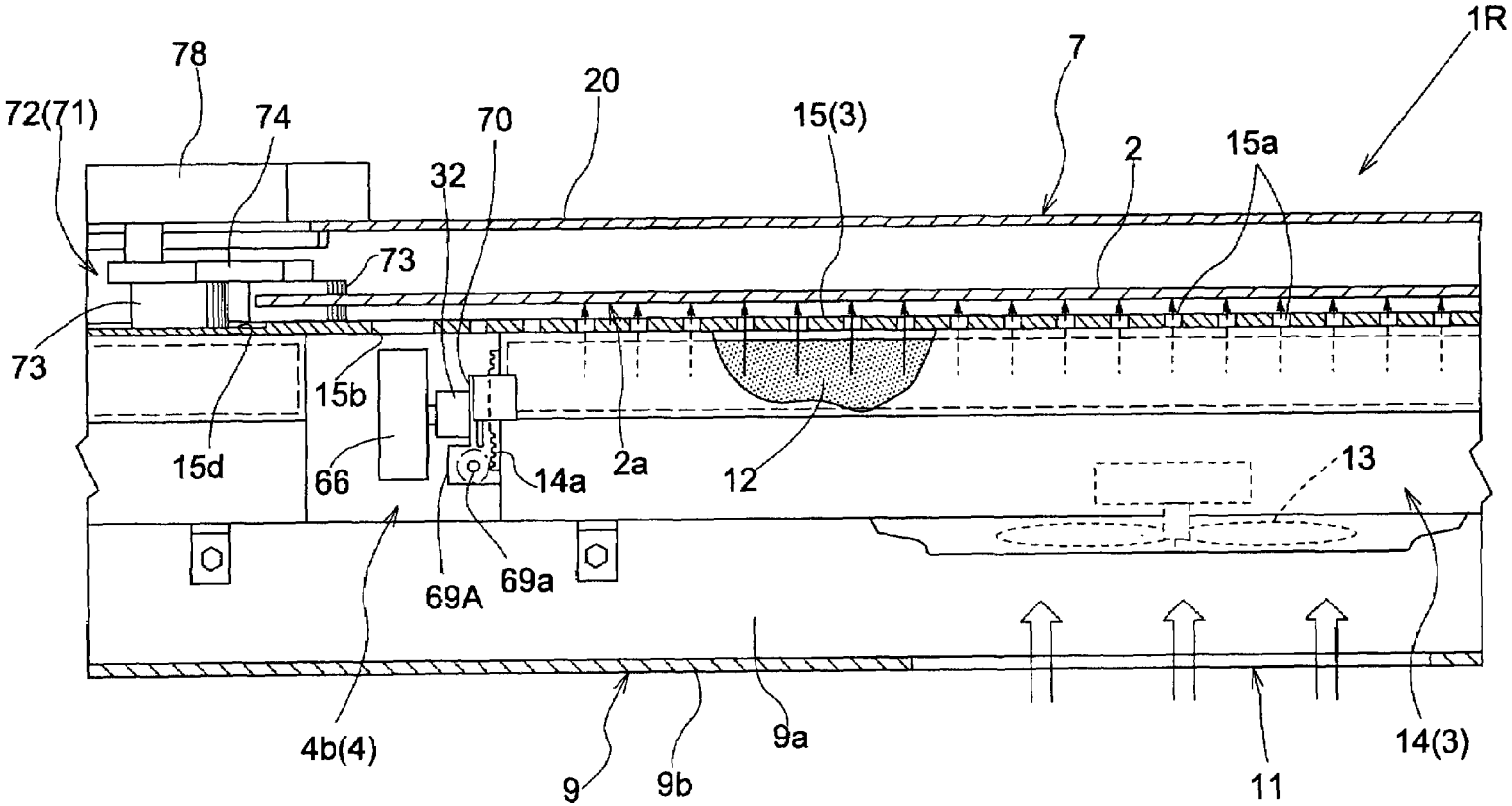
FIG. 54 is a partially magnified front view of the relay transport member according to the sixth embodiment.
Figure 55:
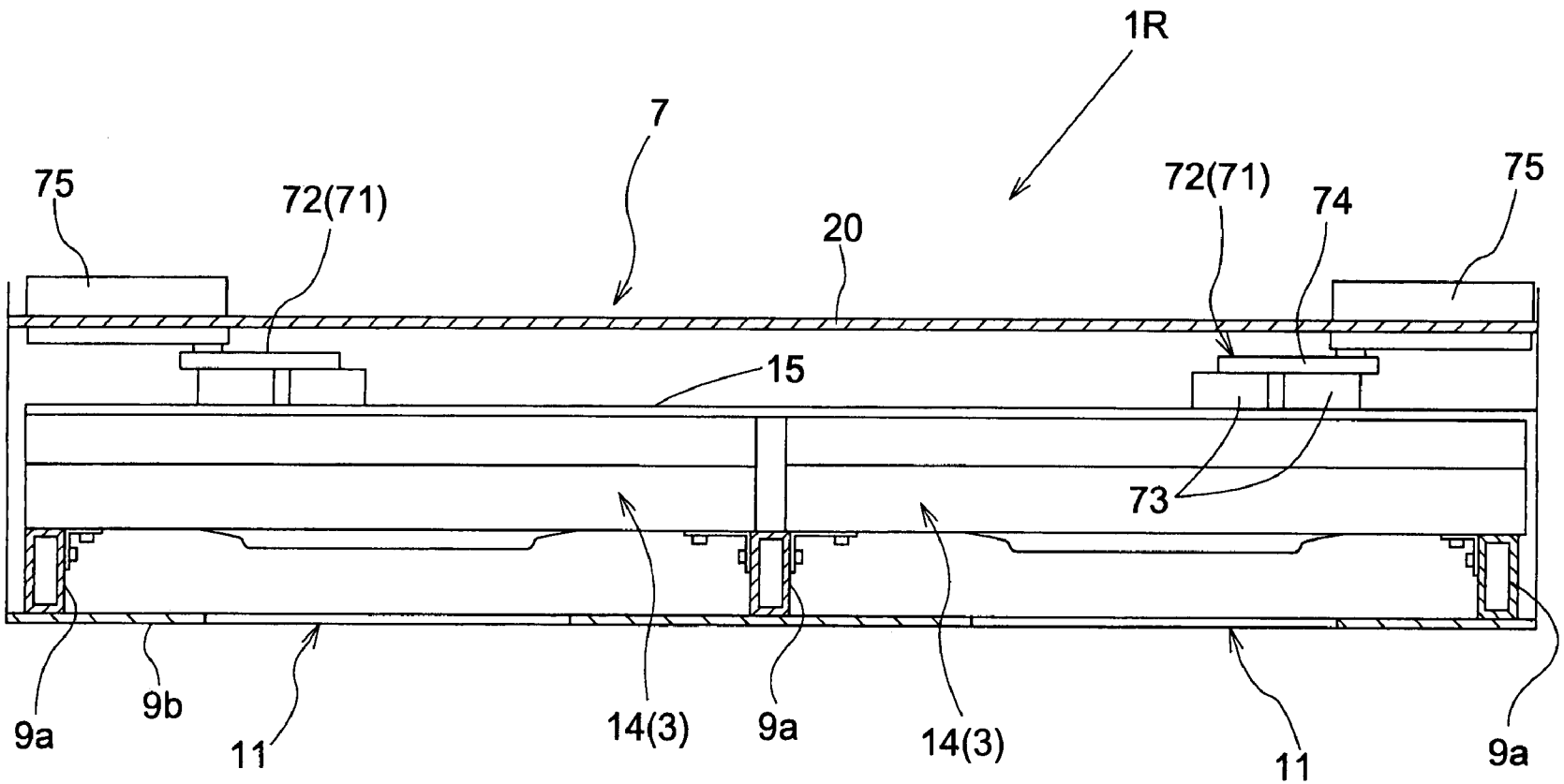
FIG. 55 is a lateral view of the relay transport member according to the sixth embodiment.

Also, as shown in FIG. 54 and FIG. 56, the support frame 70 is provided with an electric raising and lowering motor 69A for raising and lowering the belt-shaped drive force application portions 4*b*, and an output gear 69*a* of the raising and lowering motor 69A meshes with a gear groove 14*b* formed in the lateral surface of the fan filter units 14. Consequently, the belt-shaped drive force application portions 4*b* are raised and lowered by rotatively driving the raising and lowering motor 69A forward and in reverse.

The orientation changing means 6B is described next. As shown in FIG. 53, the orientation changing means 6B rests and is supported on the unit frame member 9, and a plurality of adsorption pads S (one example of the suction portions) that are capable of adheringly holding the lower surface of the glass substrate 2 are provided on the upper surface of a rotating portion 18 in such a manner that they can freely rotate about a vertical axis and can be raised and lowered.

That is, as shown in FIG. 53, the orientation changing means 6B has an extension portion 17 that can be extended and shortened vertically by a cylinder mechanism 17*a* supported on and provided within the unit frame member 9, the rotating portion 18, which can be rotated by a rotation motor 18*a* provided therein at the upper end portion of the extension portion 17, and the adsorption pads S. Thus, the adsorption pads S are rotatively actuated by rotating the rotating portion 18, and the adsorption pads S are raised and lowered by extending and shortening the extension portion 17.

Also, a rotative force is applied to the glass substrate 2 by rotatively actuating the adsorption pads S while they adheringly hold the glass substrate 2, thereby switching the glass substrate between the first transporting orientation and the second transporting orientation.

The orientation correcting means 71 is described next. As shown in FIG. 54, the orientation correcting means 71 is provided with a pair of correction mechanisms 72 that are capable of moving in the inside-to-outside direction of the relay transport member 1R, and this pair of correction mechanisms 72 are structured so as to abut against diagonally opposing corner portions of the glass substrate 2 from the side, sandwiching the glass substrate 2 between them. Also, the correction mechanisms 72 have a pair of pressing members 73 that are respectively capable of abutting against a lateral surface in the front-to-back direction and a lateral surface in the left-to-right direction of the glass substrate 2, a main portion 74 that connects and supports the pair of pressing members 73, and a drive mechanism 78 for moving the main portion 74 in the inside-to-outside direction.

Thus, the orientation correcting means 71 is structured such that by drive mechanism 78 moving the main portion 74 in the inside-to-outside direction to cause all four pressing members 73 to abut against the glass substrate 2 and sandwich it from the side, the orientation of a glass substrate 2 that has shifted from the second transporting orientation is corrected to the second transporting orientation.

Aside from the fact that they have different widths, the first transport member 1A and the second transport member 1B have substantially the same configuration, and their structure is the same as that disclosed in the above embodiments.

The height relationship between the air-supplying-type support means and the drive force application means in the first transport member, the second transport member, and the relay transport member is described next. As shown in FIG. 57, the air-supplying-type support means 3 provided in the first transport member 1A, the air-supplying-type support means 3 provided in the second transport member 1B, and the air-supplying-type support means 3 provided in the relay transport member 1R are provided to support the transported object at the same or substantially the same height.

The drive force application means 4 provided in the relay transport member 1R is provided such that it can be raised and lowered between an upper position where it supports the glass substrate 2 in a contacting manner at the same or substantially the same height as the drive force application means 4 provided in the first transport member 1A and the drive force application means 4 provided in the second transport member 1B, and a lower position where it is positioned lower than the drive force application means 4 provided in the first transport member 1A and the drive force application means 4 provided in the second transport member 1B.

The transporting apparatus H is also provided with a detection sensor that is not shown for detecting whether or not the glass substrate is present, and control means that is not shown for controlling, based on the detection results of the detection sensor, the operation of the drive force application means 4, the orientation changing means 6B, and the orientation correcting means 71.

The manner in which the relay transport member 1R switches the transporting orientation of the transported object is described next.

As mentioned above, the drive force application means 4 provided in the relay transport member 1R can be raised and lowered, and as shown in FIG. 57, the relay transport member 1R, by raising the drive force application means 4 to the upper position, is put into a state for transporting in which the glass substrate 2 is brought into contact with the drive force application means 4, and by lowering the drive force application means 4 to the lower position, is put into a state for rotation in which the glass substrate 2 in not in contact with the drive force application means 4.

In the state for transporting, transporting between the relay transport member 1R and the first transport member 1A is performed to deliver the glass substrate 2 from first transport member 1A through the drive force from the drive force application means 4, and transporting the transported object between the relay transporting portion 1R and the second transport member 1B is performed to transport the glass substrate 2 that has been delivered to the second transport member 1B, and in the state for rotation, a rotative force is applied to the glass substrate 2 by the orientation changing means 6B, which is provided in order to rotate the glass substrate 2 about a vertical axis, to switch the glass substrate 2 from the first transporting orientation to the second transporting orientation.

The operation of the relay transport member when switching a glass substrate that has been delivered in a first transporting orientation from the first transport member 1A to the second transporting orientation and transporting it to the second transport member 1B is described below.

Figure 57A:
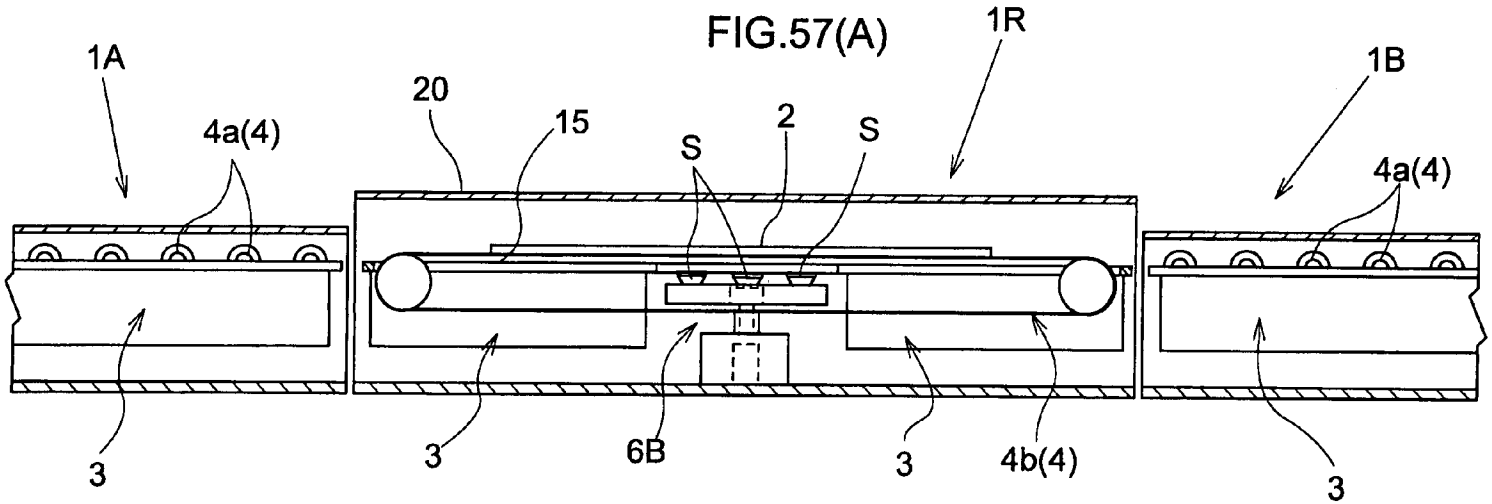
FIG. 57 is a lateral view showing the transporting state and the state for rotation in the sixth embodiment.

First, as shown in FIG. 57A, the drive force application means 4 is raised to a raised position to set the relay transport member 1R to the state for transporting in which it supports the glass substrate 2 using the air-supplying-type support means 3 and the drive force application means 4. In this state, the orientation changing means 6B is lowered such that contact between the adsorption pads S and the glass substrate 2 that is transported is cancelled, and the orientation correcting means 71 is retreated outward in the inside-to-outside direction so that it does not abut against the glass substrate 2 that is being transported. In this state a drive force is applied in the first transporting direction to the glass substrate 2 by actuating the drive force application means 4 provided in the first transport member 1A and the drive force application means 4 provided in the relay transport member 1R, and when the detection sensor detects that the glass substrate 2 has been transported up to a predetermined position of the relay transport member 1R, actuation of these drive force application means 4 is stopped.

Figure 57B:
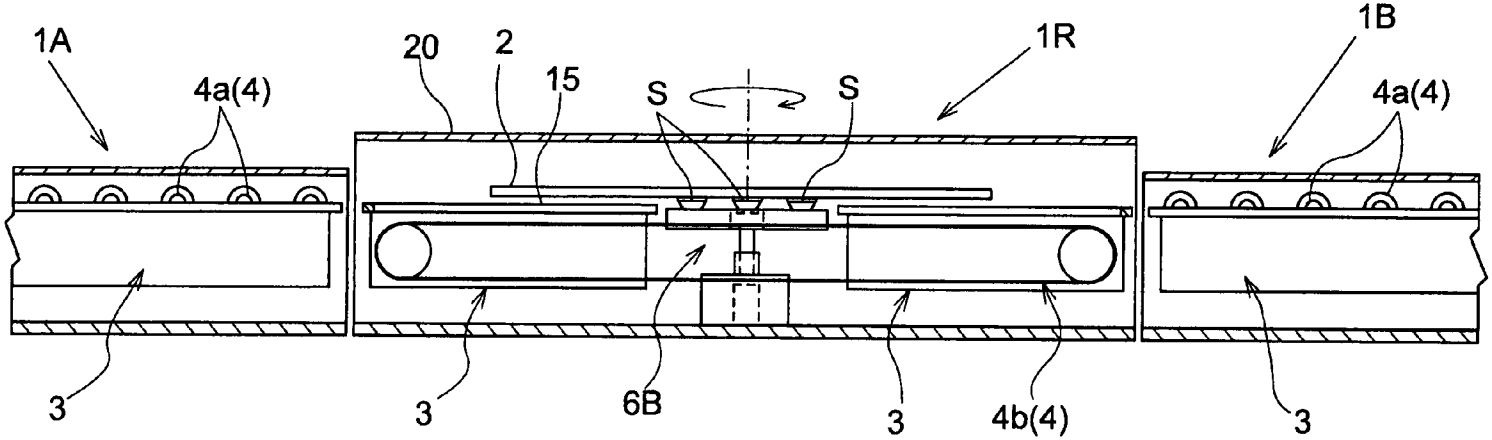

Then, as shown in FIG. 57B, the drive force application means 4 is lowered to the lowered position to put the relay transport member 1R into the state for rotation in which it contactlessly supports the glass substrate 2 with only the air-supplying-type support means 3. Next, the orientation changing means 6B changes the orientation of the glass substrate 2 from the first transporting orientation to the second transporting orientation by extending the extension portion 17 to raise the adsorption pads S, adheringly holding the lower surface 2*a* of the glass substrate 2 with the adsorption pads S, and rotating the rotating portion 18. Contact between the adsorption pads S and the glass substrate 2 is then ended by releasing the adhering holding thereof by the adsorption pads S and shortening the extension portion 17 to lower the adsorption pads S.

The orientation correcting means 71 then moves the correcting mechanisms 72 inward in the inside-to-outside direction to abut against diagonally opposing corner portions of the glass substrate 2 to sandwich it from the side, thereby correcting the orientation of the glass substrate 2, which has shifted from the second transporting orientation, to the second transporting orientation.

After the orientation of the glass substrate 2 has been switched to the second orientation, the drive force application means 4 is raised up to the upper position to set the relay transport member 1R to the state for transporting, and the orientation correcting means 71 is retreated outward in the inside-to-outside direction so that it does not abut against the glass substrate 2 that is transported.

The drive force application means 4 provided in the relay transport member 1R and the drive force application means 4 provided in the second transport member 1B are actuated in this state to apply a drive force in the transporting direction to the glass substrate 2 to transport the glass substrate 2 to the second transport member 1B.

Seventh Embodiment

Figure 62:
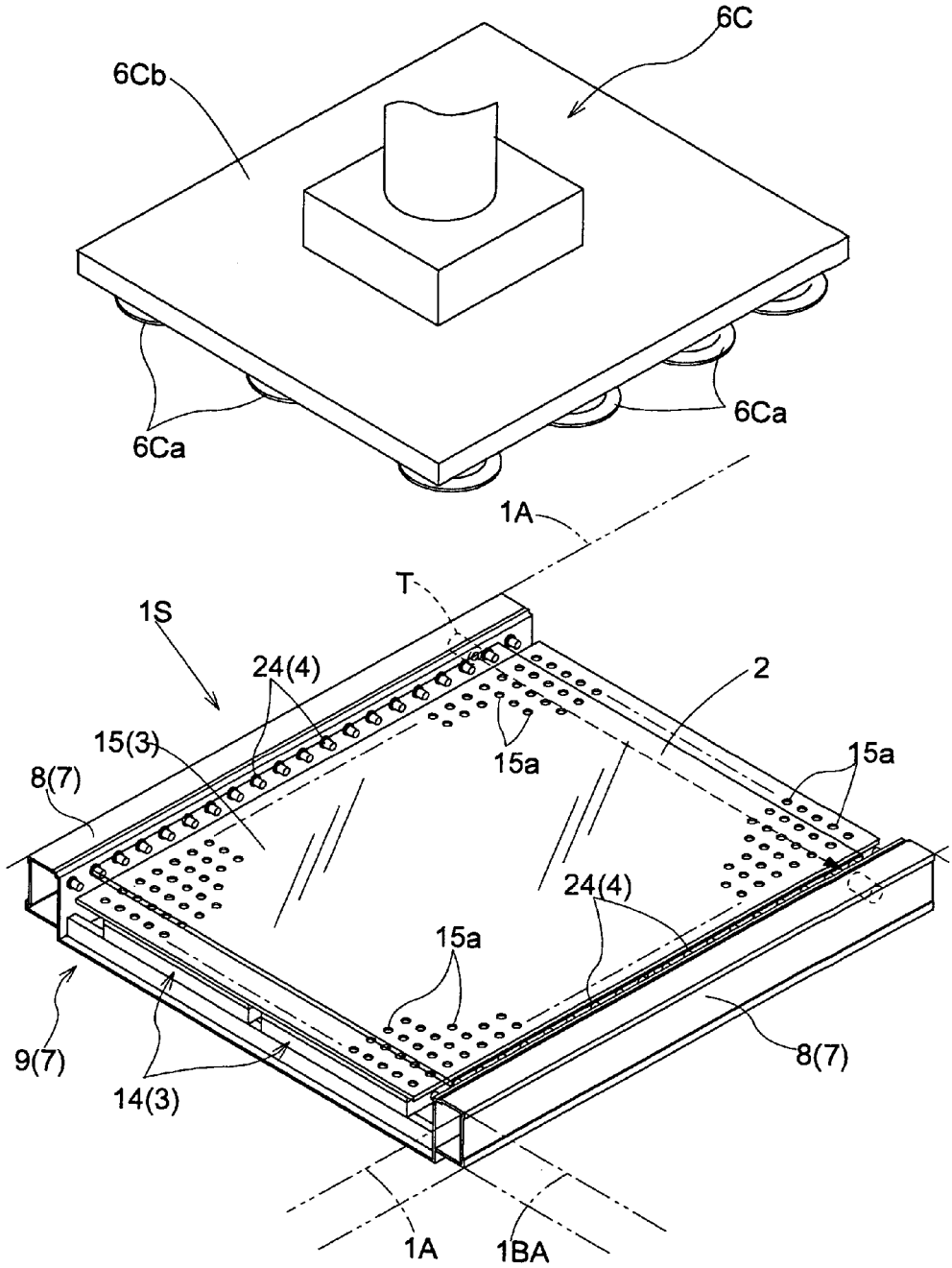
FIG. 62 is a perspective view of the relay transport member according to the seventh embodiment.

A seventh embodiment, in which a transported object that has arrived at the relay transport member is transferred to the second transport member by the transfer means 6C of FIG. 62, is described next.

Figure 61:
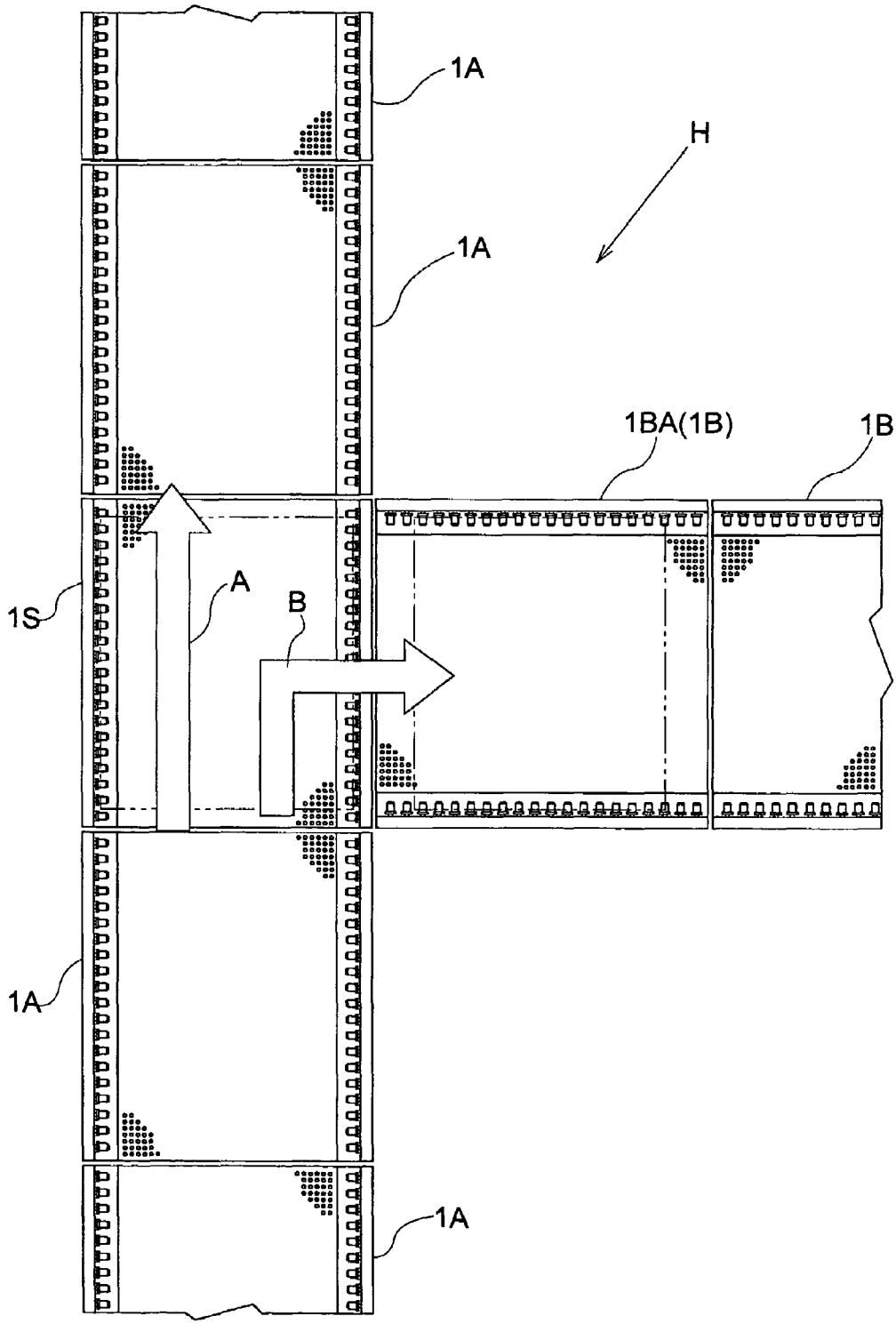
FIG. 61 is a plan view of the transporting apparatus according to the seventh embodiment.

As shown in FIG. 61, a transporting apparatus H is provided with a first transport member 1A for transporting the glass substrate 2 in a first transporting direction, a second transport member 1B for transporting the glass substrate 2 in a second transporting direction that intersects the first transporting direction, and a relay transport member 1S that is positioned at a spot where it connects the first transport member 1A and the second transport member 1B and receives the glass substrate 2 from the first transport member 1A and transports the glass substrate 2 that has been delivered to the second transport member 1B, as transport portions.

Also, as shown in FIG. 62, each transport portion is structured such that it supports the glass substrate 2 with the air-supplying-type support means 3 in a contactless manner and with the drive force application means 4 in a contacting manner, and supplies the supported glass substrate 2 with a drive force in the transporting direction by the drive force application means 4 to transport the glass substrate 2 in the transporting direction, and the air-supplying-type support means 3 and the drive force application means 4 are accommodated in the casing member 7.

Figure 66:
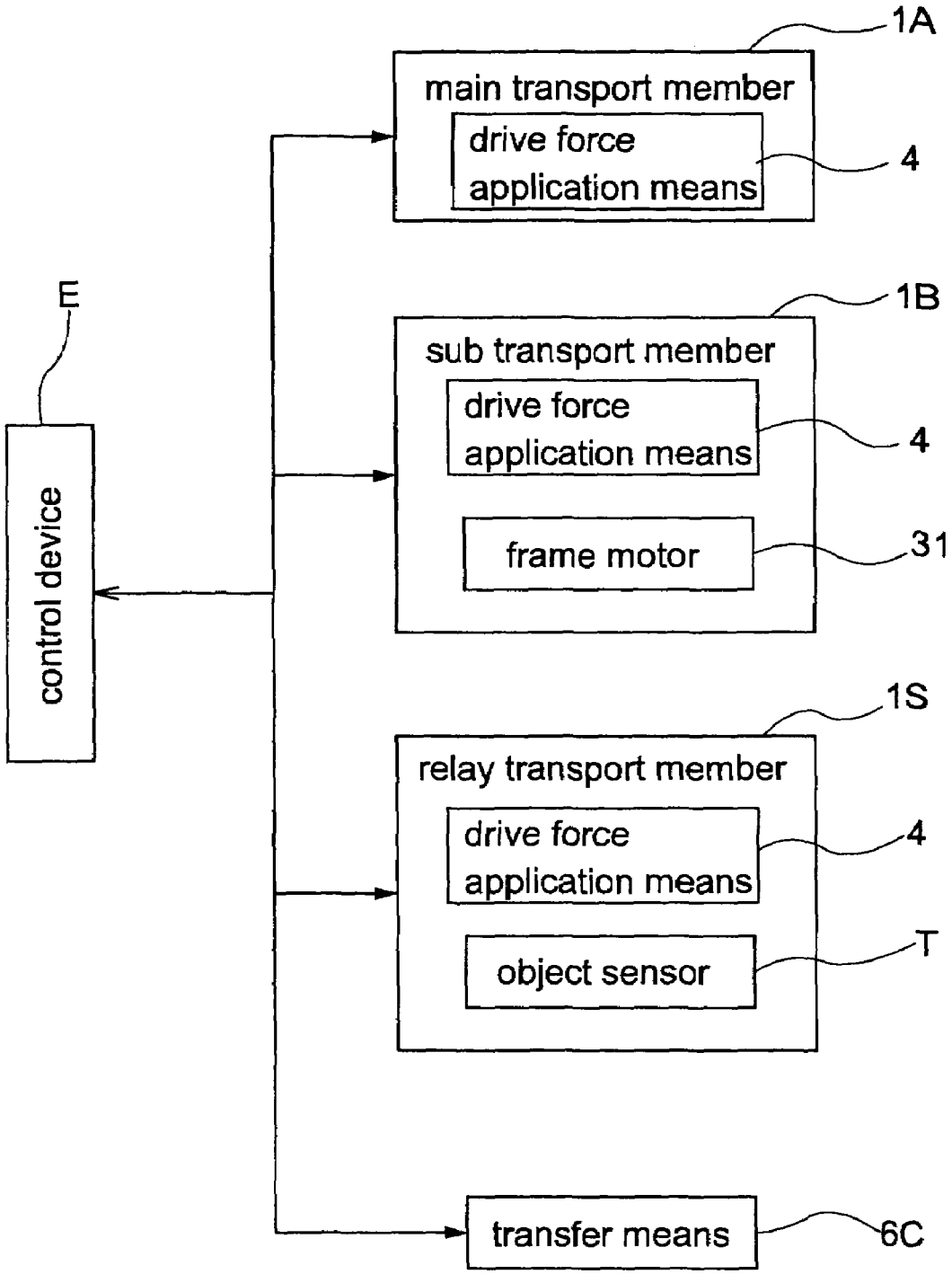
FIG. 66 is a control block diagram of the transporting apparatus according to the seventh embodiment.

Also, as shown in FIG. 66, a control device E for controlling the operation of the drive force application means 4 provided in the transport portions and a transfer means 6C that adheringly holds the upper surface 2*b* of the glass substrate 2 and that can raise and lower the glass substrate 2 and move the glass substrate 2 in the second transporting direction, based on the detection results of an object sensor T provided in the relay transport member 1S for detecting whether or not the glass substrate 2 is on the transport route, is also provided.

The first transport member 1A has a single or a plurality of first transport units lined up side by side, the second transport member 1B has a single or a plurality of first transport units lined up side by side, and the relay transport member 1S has a single relay transport unit. That is, the transporting apparatus H has a combination of first transport units, second transport units, and a relay transport unit.

The relay transport member 1S is described below.

Figure 63:
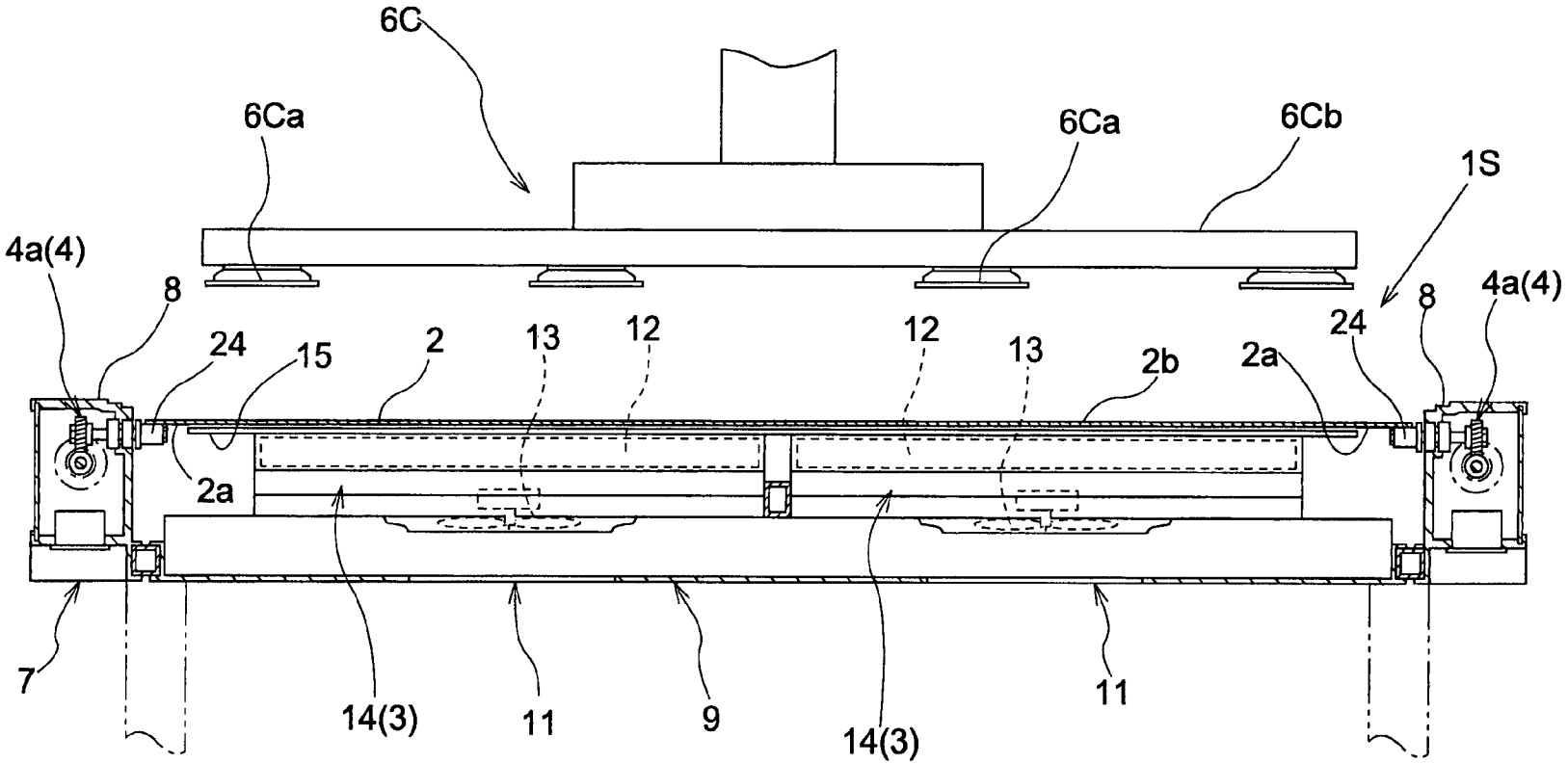
FIG. 63 is a front view of the relay transport member according to the seventh embodiment.

As shown in FIGS. 62 and 63, the relay transport member 1S has a air-supplying-type support means 3, which has been described already, a drive force application means 4 provided in the relay transport member 1S for applying a drive force in the transporting direction to the glass substrate 2, the object sensor T, and the casing member 7 provided in the relay transport member 1S for accommodating the air-supplying-type support means 3, the drive force application means 4, and the object sensor T.

The first transport member 1A and the second transport member 1B are identical except that the first transport member 1A and the second transport member 1B excluding the second transport member for delivery 1BA have different widths. The second transport member 1B is provided with a second transport member for delivery 1BA for receiving the glass substrate 2 from the relay transport member 1S, as shown in FIG. 61.

Figure 64:
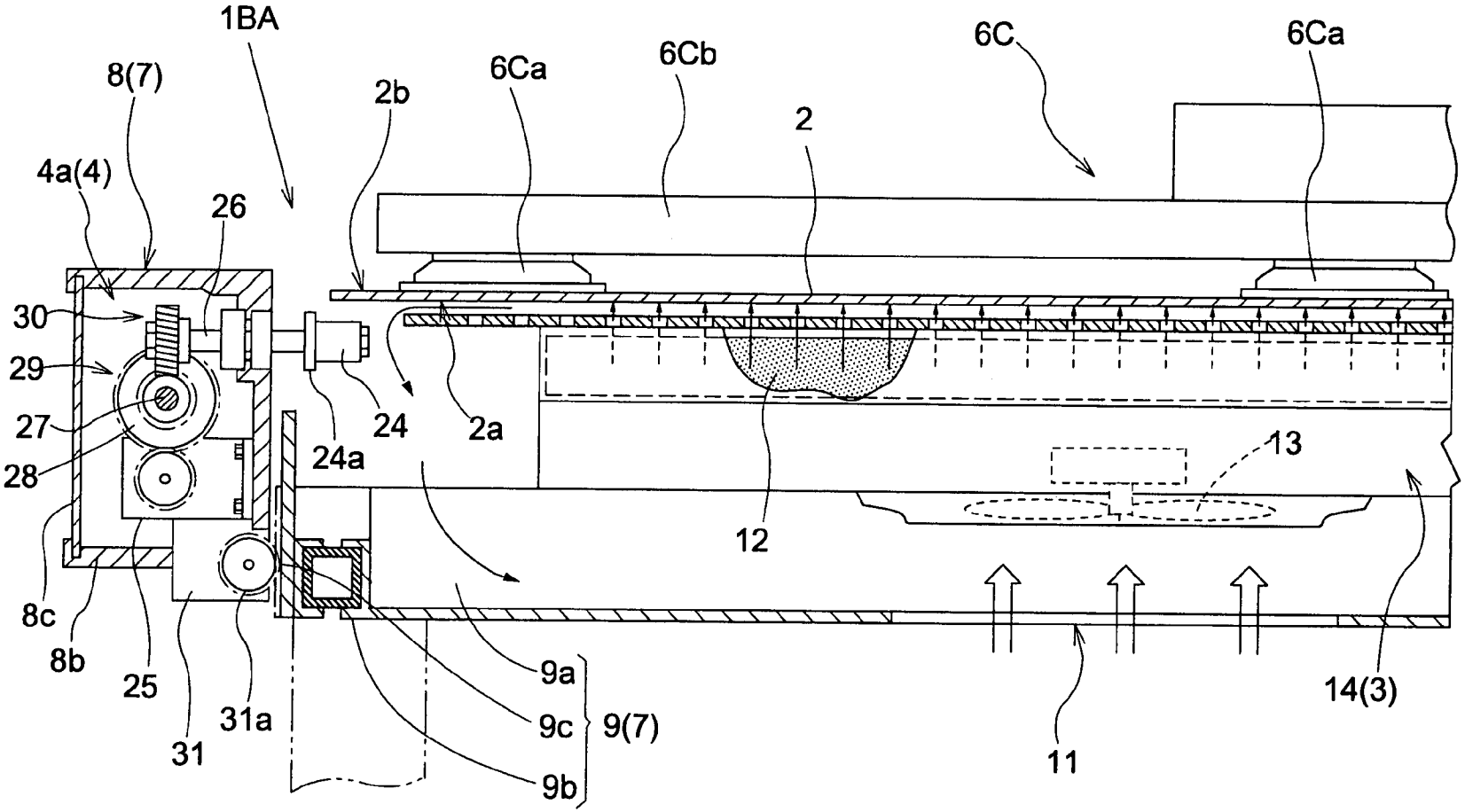
FIG. 64 is a partially magnified front view of the transport portion for delivery according to the seventh embodiment.

The second transport member for delivery 1BA, as shown in FIG. 64, has the air-supplying-type support means 3 that is provided in the second transport member for delivery 1BA, the drive force application means 4 that is provided in the second transport member for delivery 1BA for applying a drive force in the second transporting direction to the glass substrate 2, and the casing member 7 provided in the second transport member for delivery 1BA for accommodating the air-supplying-type support means 3 and the drive force application means 4.

The second transport member for delivery 1BA is configured such that, by raising and lowering the drive force application means 4 provided in the second transport member 1BA, it can be switched between a transport state in which the drive force application means 4 is in contact with the lower surface 2*a* of the glass substrate 2 supported by the air-supplying-type support means 3 and a retreated state in which the drive force application means 4 is not in contact with the glass substrate 2 supported by the air-supplying-type support means 3.

The action of raising and lowering the drive force application means 4 provided in the second transport member for delivery 1BA is described next. Each of the pair of accommodation frames 8 is supported on the unit frame member 9 in such a manner that it can be raised and lowered. That is, an electric frame motor 31 for raising and lowering the accommodation frame 8 is provided at a lower portion of each accommodation frame 8, and the output gear 31*a* of the frame motor 31 meshes with a gear groove 9*c* formed in a lateral surface of the support frame portion 9*a* of the unit frame member 9. Consequently, the pair of accommodation frames 8 are respectively raised and lowered by rotatively driving the pair of frame motors 31 forward and in reverse, thereby raising and lowering the drive force application means 4 provided in one the pair of the accommodation frames 8. It should be noted that FIG. 64 shows a state in which the second transport member for delivery 1BA has been switched to the retreated state.

The transfer means 6C is described next. As shown in FIGS. 62, 63, and 65, the transfer means 6C is provided with adsorption pads 6Ca, for adheringly holding the 2*b* of the glass substrate 2, on the lower surface of a support portion 6Cb, and is configured such that due to a drive mechanism outside the drawings the adsorption pads 6Ca can be raised and lowered and moved between the first transport member 1A and the second transport member for delivery 1BA. Thus, by raising and lowering, and moving in the second transporting direction, the adsorption pads 6Ca when they are adheringly holding the upper surface 2*b* of the glass substrate 2, the glass substrate 2 can be raised and lowered and moved in the second transporting direction.

Next, a first transport, such as indicated by the arrow A in FIG. 61, in which the glass substrate 2 is delivered from the first transport member 1A on the transporting upstream side to the relay transport member 1S and the glass substrate 2 that is delivered is transported to the first transport member 1A on the transporting downstream side without changing its transporting direction, and a branching transport, such as that indicated by the arrow B, in which the glass substrate 2 is delivered from the first transport member 1A to the relay transport member 1S and the transporting direction of the glass substrate 2 that has been delivered is switched from the first transporting direction to the second transporting direction and the glass substrate 2 is transported to the second transport member 1B.

When performing a first transport as shown by the arrow A in FIG. 61, the drive force application means 4 provided in the first transport member 1A and the drive force application means 4 provided in the relay transport member 1S are activated so as to apply a drive force in the first transporting direction to the glass substrate 2 to deliver the glass substrate 2 from the first transport member 1A on the transporting upstream side to the relay transport member 1S, and the glass substrate 2 that has been delivered is transported to the first transport member 1A on the transporting downstream side.

Figure 65A:
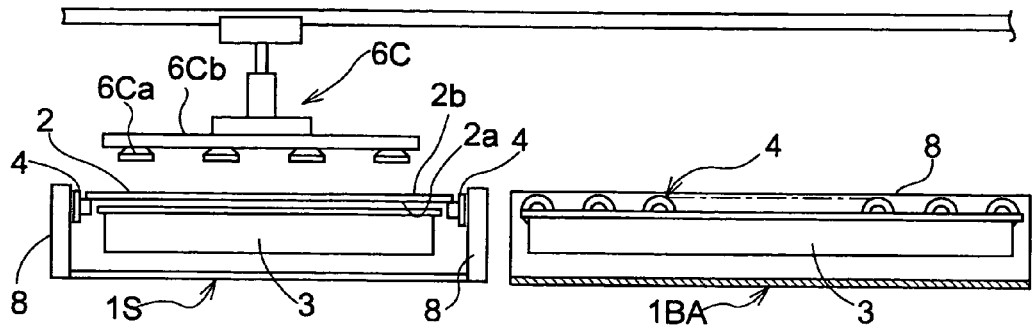
FIG. 65 is an action diagram of branching transporting with the transporting apparatus according to the seventh embodiment.

When performing a branching transport as indicated by the arrow B in FIG. 61, first the drive force application means 4 provided in the first transport member 1A and the drive force application means 4 provided in the relay transport member 1S are activated so as to apply a drive force in the first transporting direction to the glass substrate 2 to deliver the glass substrate 2 from the first transport member 1A on the transporting upstream side to the relay transport member 1S, and when the object sensor T has detected that the glass substrate 2 that has been delivered has been transported up to a predetermined position of the relay transport member 1S, actuation of the drive force application means 4 provided in the first transport member 1A and the drive force application means 4 provided in the relay transport member 1S is stopped. It should be noted that in this state, the lower surface 2*a* is supported by the air-supplying-type support means 3 and the drive force application means 4 as shown in FIG. 65A.

Figure 65B:
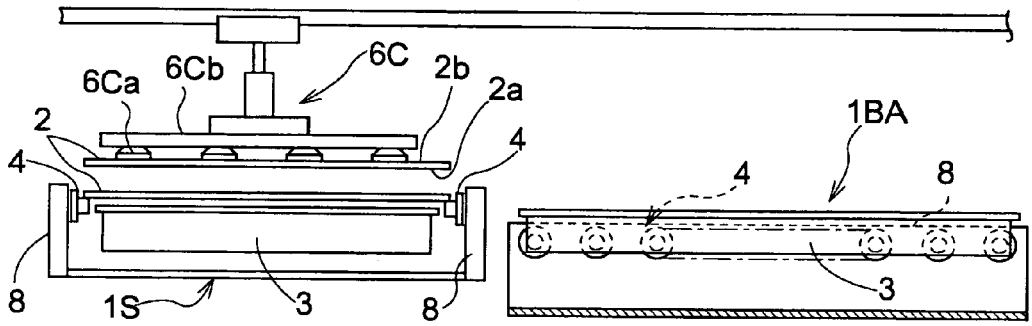

The glass substrate 2 that has been delivered to the relay transport member 1S is then transported to the second transport member for delivery 1BA in the second transport member 1B by the transfer means 6C. To describe the operation of the transfer means 6C when transporting the glass substrate 2 to the second transport member for delivery 1BA in further detail, the transfer means 6C is lowered to press the adsorption pads 6Ca against the upper surface 2*b* of the glass substrate 2 that has been delivered to the relay transport member 1S, the adsorption pads 6Ca adhere to and hold the upper surface 2*b* of the glass substrate 2, and the adsorption pads 6CA are raised up to raise up the glass substrate 2 as shown in FIG. 65B. Next, the adsorption pads 6Ca are moved in the second transporting direction to transport the glass substrate 2 to above the second transport member for delivery 1BA, and the adsorption pads 6Ca are lowered until the state shown in FIGS. 64 and 65C, in which the lower surface 2*a* of the glass substrate 2 that is being adheringly held is supported by the air-supplying-type support means 3, after which adhering holding of the glass substrate 2 is released.

When the glass substrate 2 is transported to the second transport member for delivery 1BA, the drive force application means 4 provided in the second transport member for delivery 1BA is lowered to switch the second transport member for delivery 1BA to the retreated state so that the glass substrate 2 that is being adheringly held by the adsorption pads 6Ca and the drive force application means 4 provided in the second transport member for delivery 1BA do not come into contact. Then, after the glass substrate 2 has been transported to the second transport member for delivery 1BA and the adsorption pads 6Ca retreated upwards, the drive force application means 4 is raised up to switch the second transport member for delivery 1BA to the transporting state, and the glass substrate 2 is supplied with a drive force in the second transporting direction by the drive force application means 4 and thereby transported to the second transport member 1B on the transporting downstream side.

The drive force application means 4 provided in the first transport member 1A and the drive force application means 4 provided in the relay transport member 1S, whose operation has been stopped, are activated once again after the glass substrate 2 has been raised up by the transfer means 6C as shown in FIG. 65B.

The next glass substrate 2 that is transported next to the glass substrate 2 that been subjected to branching transporting as discussed above is then transported in the first transporting direction, and as for this next glass substrate 2, if first transporting is to be performed, then actuation of the drive force application means 4 is continued even after the object sensor T has detected the glass substrate 2 to transport that glass substrate 2 to the first transport member on the transporting downstream side, and if branching transporting is to be performed, then actuation of the drive force application means is stopped when the glass substrate 2 has been detected by the object sensor T, and the glass substrate 2 is held on standby above the relay transport member 1S so that it can be transferred to the second transport member by the transfer means.

Figure 65C:
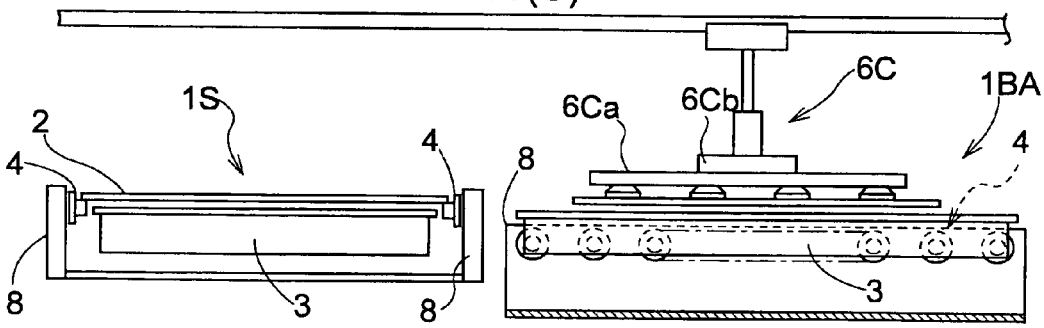
Figure 65D:
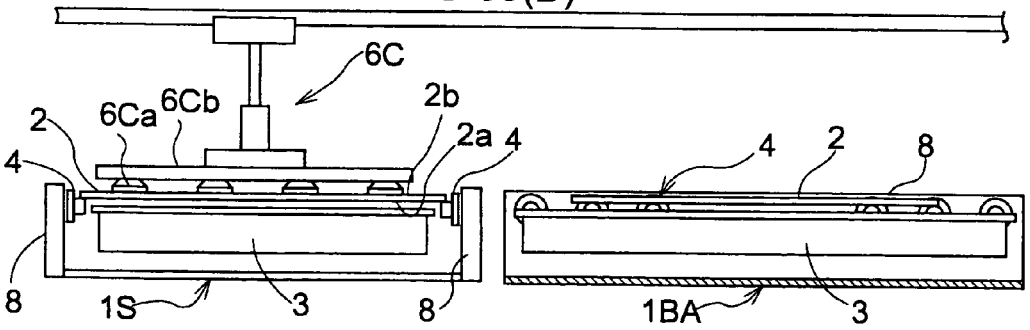

That is, it is possible to deliver the next glass substrate 2 for which branching transporting is to be performed to the relay transport member 1S in advance before branching transporting of the previous glass substrate 2 has ended, and when branching transporting of the previous glass substrate 2 has finished and the next glass substrate 2 has been delivered to the relay transport member 1S in advance as shown in FIG. 65C, then branching transporting can be performed again as shown in FIG. 65B.

Other Embodiments (1) In the first through third embodiments, the glass substrate 2 is transported only in the forward direction from the upstream side of the first transport member 1A to the downstream side of the second transport member 1B, but it is also possible to adopt a configuration in which the glass substrate 2 is also transported in the reverse direction from the downstream side of the second transport member 1B to the upstream side of the first transport member 1A.

That is, the L-shaped transport unit 1L can also be of a configuration in which the first drive force application portion 34Ba can apply a drive force in the direction opposite the first transporting direction X to the glass substrate 2, the second drive force application portion 34Bb can apply a drive force in the direction opposite the second transporting direction Y to the glass substrate 2, and the transporting direction of a glass substrate that has been received from the second transport member 1B is switched from the second transporting direction Y to the first transporting direction X to deliver that glass substrate to the first transport member 1A. That is, the drive force application means 4, including the L-shaped drive force application means 34, can be made capable of transporting in the forward and reverse directions in the transporting direction.

Also, in a transporting apparatus configured as in the first embodiment or the second embodiment, the first drive force application portion 34Ba can be raised and lowered between a support position in which the glass substrate 2 is supported in a contacting manner by the first drive rollers 45, and a retreated position in which it has been retreated downward so as to avoid contact between the glass substrate 2 and the first drive rollers 45. That is, in this configuration, the first single-side frame member portion 44*a* also can be raised and lowered in the same manner as the second single-side frame member portion 44*b*, and by raising and lowering the first single-side frame member portion 44*a*, which supports the first drive force application portion 34Ba, the first drive force application means 34Ba is raised and lowered between the support position and the retreated position.

In the transporting apparatus configured as in the third embodiment, of the eight fan filter units 14 of the L-shaped air-supplying-type support means, a total of three fan filter units 14, namely the two positioned on the downstream side in the first transporting direction of the fan filter unit group discussed above and the second fan filter unit from the upstream side in the first transporting direction on the one end side in the width direction of the fan filter unit group, are structured as variable fan filter units 14A.

The raising and lowering operation of the first drive force application portion 34Ba and the second drive force application portion 34Bb in a case where, in the transporting apparatuses configured as in the first embodiment and the second embodiment, the L-shaped drive force application means 34 is configured such that it can transport in the forward and reverse directions of the transporting direction as discussed above. It should be noted that the raising and lowering operation when transporting the glass substrate 2 in the direction opposite the transporting direction is described, and description of the procedure for the raising and lowering operation when transporting the glass substrate 2 in the transporting direction is omitted because it is only necessary to perform the procedure in reverse. Also, the manner in which the positions of the first restricting rollers 47 and the second restricting rollers 48 are changed when adopting the same configuration as in the first embodiment is shown in FIG. 27, and is described using FIG. 27. The manner in which the orientation of the L-shaped air-supplying-type support means 33 is altered when the same configuration as in the second embodiment is adopted is not shown in the drawings.

Figure 27A:
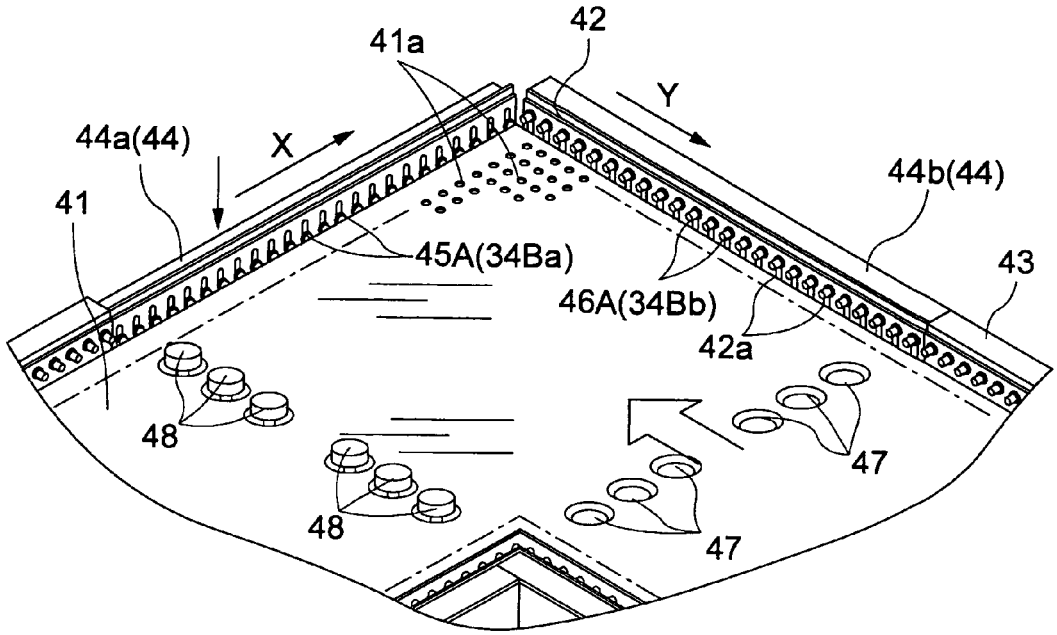
FIG. 27 is an action diagram of the L-shaped transport unit in the other embodiment (1)

First, as shown in FIG. 27A, the first drive force application portion 34Ba is lowered to the retreated position so that the glass substrate 2 and the first drive force application portion 34Ba do not abut against one another, the second drive force application portion 34Bb is raised to the support position so that the lower surface 2*a* on the one end side in the width direction of the glass substrate 2 is supported in a contacting manner by the second drive rollers 46, and the glass substrate 2 is transported in the reverse direction of the second transporting direction Y.

Figure 27B:
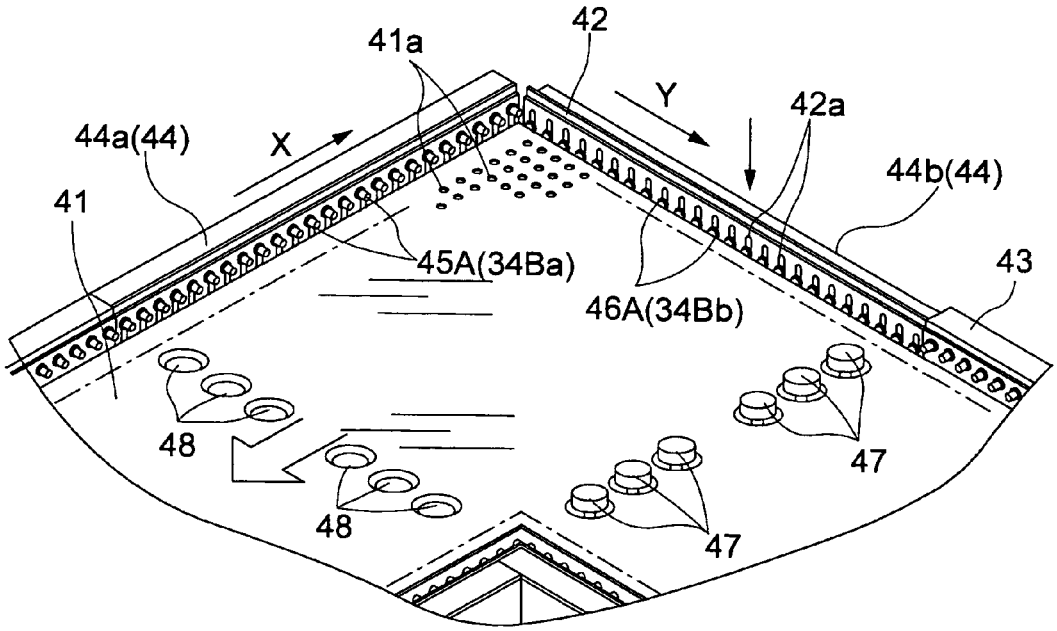

When the glass substrate 2 has been transported up to the last end in the first transporting direction, then, as shown in FIG. 27B, the first drive force application portion 34Ba is raised up to the support position so that the lower surface 2*a* on the one end side in the width direction of the glass substrate 2 is supported in a contacting manner by the first drive rollers 45, and with the second drive force application portion 34Bb lowered to the retreated position such that the glass substrate 2 and the second drive force application portion 34Bb do not abut against one another, the glass substrate 2 is transported in the reverse direction of the first transporting direction X.

The manner in which the rotation speed of the three variable fan filter units 14A are changed and adjusted is described next with regard to a case where in the transporting apparatus configured as in the third embodiment the L-shaped drive force application means 34 has been made capable of transporting in the forward and reverse directions of the transporting direction as discussed above. It should be noted that the raising and lowering operation when transporting the glass substrate 2 in the direction opposite the transporting direction is described, and description of the procedure for the raising and lowering operation when transporting the glass substrate 2 in the transporting direction is omitted because it is only necessary to perform the procedure in reverse. Also, the orientation of the L-shaped air-supplying-type support means 34 when configured in the same way as in the third embodiment is changed in the manner opposite to that of a case where the glass substrate 2 is transported in the forward direction.

Figure 28:
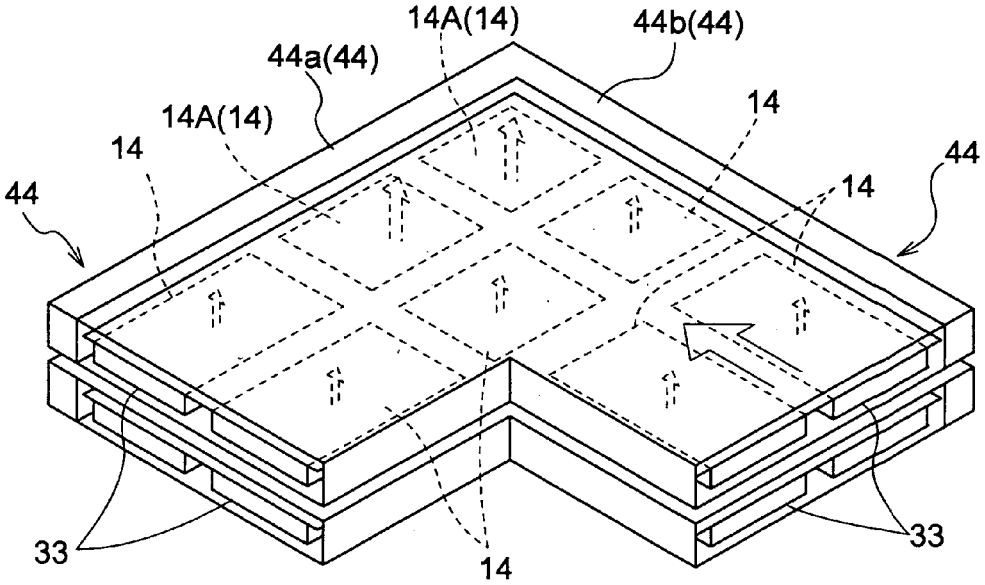
FIG. 28 is an action diagram of the L-shaped transport unit in the other embodiment (1)

First, as shown in FIG. 28, the glass substrate 2 is transported in the reverse direction of the second transporting direction Y with the variable blower fans 13*a* in the two variable fan filter units 14A lined up in the first transporting direction X of the three variable fan filter units 14A set to the fast rotation velocity so that the glass substrate 2 and the first drive force application portion 34Ba do not abut against one another, and the variable blower fan 13*a* in the remaining single fan filter unit 14A set to the equal rotation velocity such that the second drive rollers 46 of the second drive force application portion 34Bb apply sufficient drive force to the one end side in the front-to-back direction of the glass substrate 2.

The glass substrate 2 is then transported in the reverse direction of the first transporting direction Y with the variable blower fans 13*a* in the two variable fan filter units 14A lined up in the second transporting direction Y of the three variable fan filter units 14A set to the fast rotation velocity so that the glass substrate 2 and the second drive force application portion 34Bb do not abut against one another, and the variable blower fan 13*a* in the remaining single fan filter unit 14A set to the equal rotation velocity such that the first drive rollers 45 of the first drive force application portion 34Ba apply sufficient drive force to the one end side in the width direction of the glass substrate 2.

(2) In the first through third embodiments, the drive portion has a plurality of drive rollers, but it is also possible to adopt a configuration in which it has an endless belt-shaped member such as a timing belt. Also, in the first embodiment, the restricting portion has a plurality of first restricting rollers and second restricting rollers, but it is also possible for both the first restricting rollers and the second restricting rollers also to be in the form of an endless belt. Further, the restricting portion can be supported on the L-shaped transport cover in such manner that it can be raised and lowered.

(3) In the first embodiment and the second embodiment, it is possible for the first single-side frame member portion to be configured such that it can be raised and lowered as in the other embodiment (1), and in the third embodiment, it is also possible for three variable fan filter units to be provided as in the other embodiment (1).

In other words, even if the glass substrate is transported only in the forward direction of the transporting direction, when switching the transporting direction from the first transporting direction to the second transporting direction and transporting, the first drive force application portion can be kept from coming into contact with the lower surface of the glass substrate to allow transporting in the second transporting direction to be started smoothly.

(4) In the first and second embodiments and the various other embodiments thereof, the relay transport member is defined as the L-shaped transport unit 1L, and always switched the transporting direction of the glass substrate 2 so that the transporting direction of the glass substrate 2 received from the first transport member 1A is switched from the first transporting direction X to the second transporting direction Y and delivered to the second transport member 1B, but it is not absolutely necessary that the transporting direction of the glass substrate 2 is changed.

Figure 29:
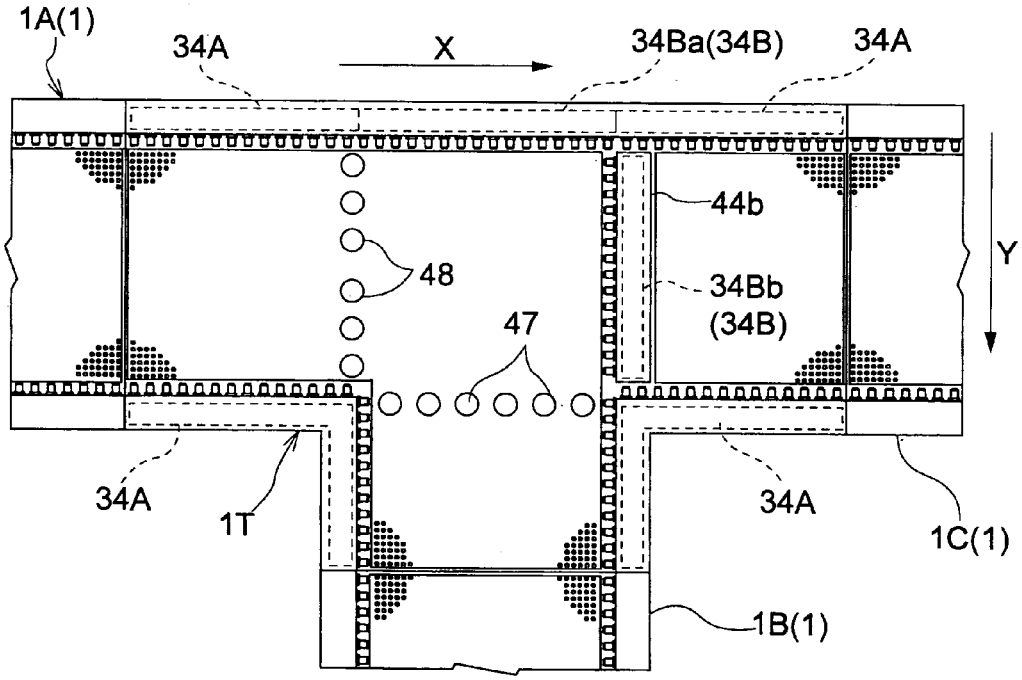
FIG. 29 is a plan view of the T-shaped transport unit in the other embodiment (4)

For example, it is possible to provide a T-shaped transport unit 1T such as that shown in FIG. 29 in place of the L-shaped transport unit 1L in the first embodiment. This T-shaped transport unit 1T is structured such that it can transport the glass substrate 2 in the first transporting direction X over the second drive force application portion 34Bb that has been lowered to the retreated position. It should be noted that the entire T-shaped transport unit 1T can also be configured for single-side driving as in the second embodiment.

That is, the T-shaped transport unit 1T is not provided with the fastening lateral wall 42, and is provided with the dual-side drive force application portion 34A for applying a drive force to transport the glass substrate 2 over the second drive force application portion 34Bb toward the transport portion 1C. The T-shaped transport unit 1T is also configured such that when the second single-side frame member portion 44*b* has been lowered to set the second drive force application portion 34Bb to the retreated position, the upper end of the raising and lowering single-side frame member portion is positioned lower than the lower surface of the glass substrate 2 that is supported by the fan filter units 14. Thus, the glass substrate 2 can be transported over the second drive force application portion 34Bb at a position that is more in the first transporting direction than the position where the transporting direction is changed from the first transporting direction X to the second transporting direction Y (the last end in the first transporting direction in the first embodiment).

It should be noted that a gap is formed between the second single-side frame member portion 44*b* and the frame member portions located on either side thereof such that the first drive rollers 45 can be provided.

Figure 30:
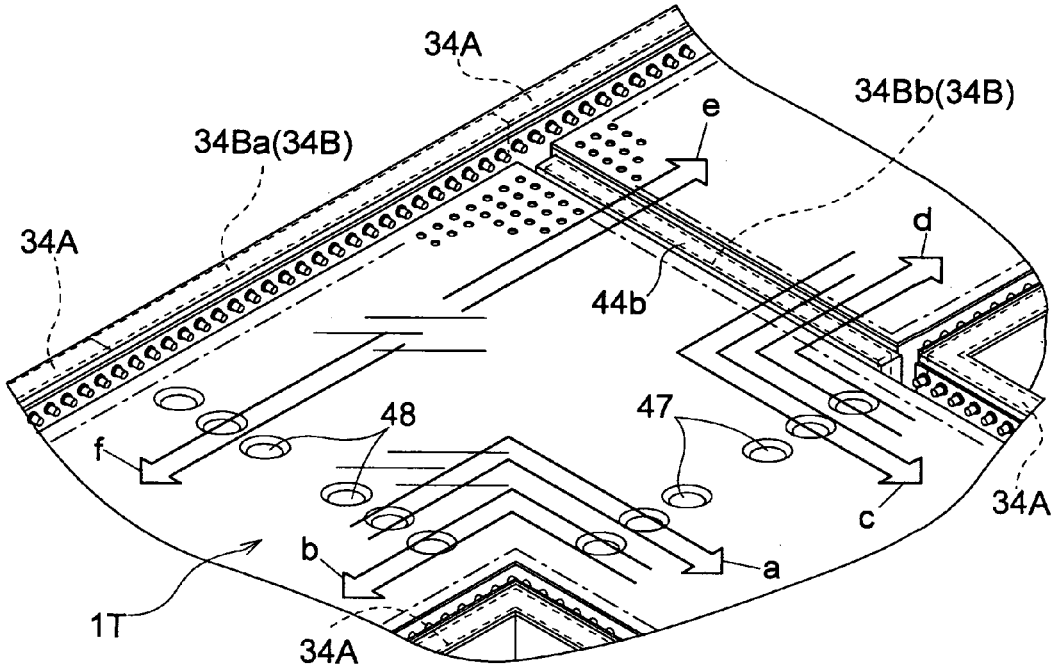
FIG. 30 is an action diagram of the T-shaped transport unit in the other embodiment (4)

Consequently, with the T-shaped transport unit 1T, in addition to switching the transporting direction of the glass substrate 2 that has been received from the first transport member 1A from the first transporting direction X to the second transporting direction Y to deliver the glass substrate 2 to the second transport unit 1B as shown by the arrow a in FIG. 30, it is also possible to keep the first transporting direction X as the transporting direction of the glass substrate 2 that has been received from the first transport member 1A and deliver the glass substrate 2 to the transport portion 1C as shown by the arrow e in FIG. 30.

In the case of transporting with the T-shaped transport unit as shown by the arrow e, the second drive force application portion 34Bb is lowered to the retreated position so that the glass substrate 2 can be transported over the second drive force application portion 34Bb without the glass substrate 2 and the second drive force application portion 34Bb coming into contact with one another, the first restricting rollers 47 are raised to the action position so that the glass substrate 2 is transported in the first transporting direction X in a stable manner, and the second restricting rollers 48 are lowered to the retreated position so that they are not in the way when the glass substrate 2 is transported in the first transporting direction X.

Also, by adopting a configuration in which it is possible to transport the glass substrate 2 in the reverse direction of the first transporting direction X or to transport the glass substrate 2 in the reverse direction of the second transporting direction Y as in the other embodiment (1), it is further possible to transport the glass substrate 2 as shown by the arrows b, c, d, and f in FIG. 30.

It should be noted that the transport portion 1C, in the case of transporting the glass substrate 2 as shown by the arrows e and f, becomes the second transport member on the downstream side of the first transport member 1A, and in the case of transporting the glass substrate 2 as shown by the arrows c and d, becomes the first transport member on the upstream side of the second transport member 1B.

Figure 31:
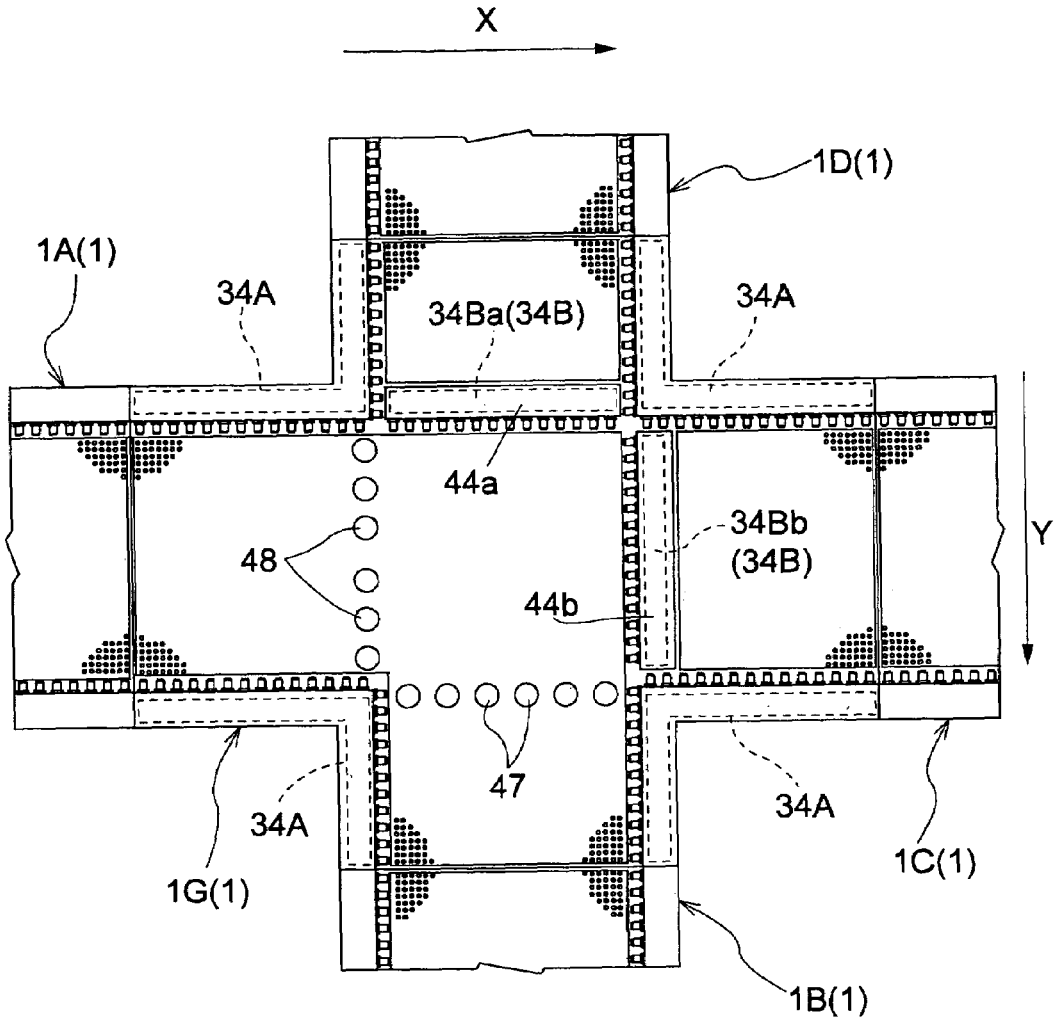
FIG. 31 is a plan view of the cross-shaped transport unit in the other embodiment (4)
Figure 32:
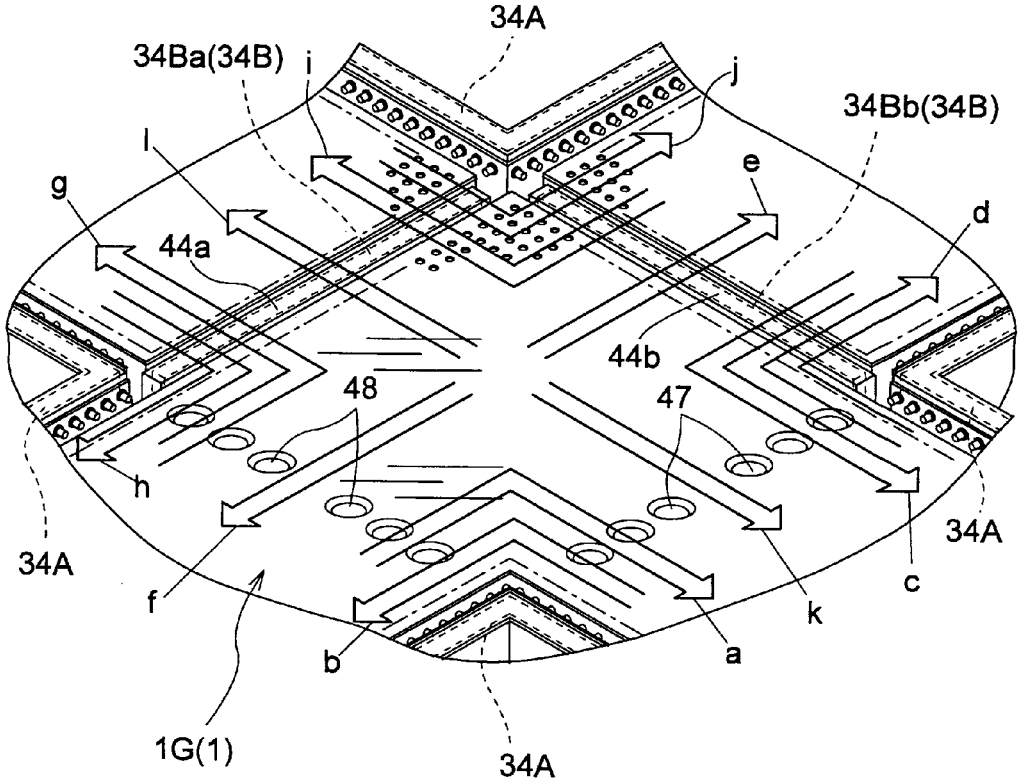
FIG. 32 is an action diagram of the cross-shaped transport unit in the other embodiment (4)

It is further possible to provide a cross-shaped transport unit 1G, for example, such as that shown in FIG. 31 in place of the L-shaped transport unit 1L according to the first embodiment. The cross-shaped transport unit 1G is structured such that it can transport the glass substrate 2 in the second transporting direction Y over the first drive force application portion 34Ba and such that it can transport the glass substrate 2 in the first transporting direction X over the second drive force application portion 34Bb. In this case, by adopting a configuration in which it is possible to transport the glass substrate 2 in the reverse direction of the first transporting direction X or to transport the glass substrate 2 in the reverse direction of the second transporting direction Y as in the other embodiment (1), it is further possible to deliver the glass substrate 2 as shown by the arrows a to 1 in FIG. 32.

It should be noted that it is also possible to structure the entire cross-shaped transport unit 1G for single-side driving as in the second embodiment.

(5) In the above embodiments, an example of a blowing unit in which the dust removal filter and the blower fan are combined into a single unit is shown, but it is not absolutely necessary that the dust removal filter and the blower fan are attached as a single unit, and it is also possible to adopt a configuration in which, for example, a guide route or the like for guiding air blown by the blower fan to the dust removal filter is provided and the dust removal filter and the blower fan are constituted by separate members.

(6) In all the embodiments discussed above, a glass substrate for liquid crystal serves as an example of the transported object, but the transported object may also be a semiconductor wafer, for example, and there is no limitation to the foregoing embodiments regarding the shape or size of the transported object.

(7) In the fourth and fifth embodiments, the auxiliary drive means 6A is provided with a timing belt 66 or the like to support the lower surface 2*a* of the glass substrate 2 in a contacting manner and apply drive force thereto, but it can also be provided with pressing portions 73 for applying drive force in the second transporting direction to the glass substrate 2 by moving in the second direction after abutting against the lateral surface on the one side in the width direction of the glass substrate 2, that is, the lateral surface on the transporting upstream side in the second transporting direction.

Figure 47A:
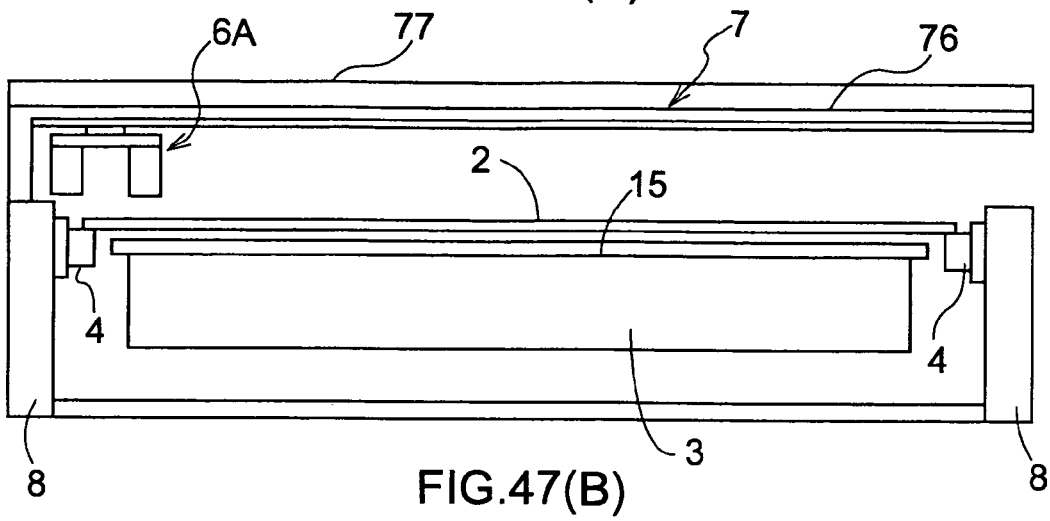
FIG. 47 is a front view showing the first transporting state and the second transporting state of the relay transport member according to the other embodiment (7)
Figure 47B:
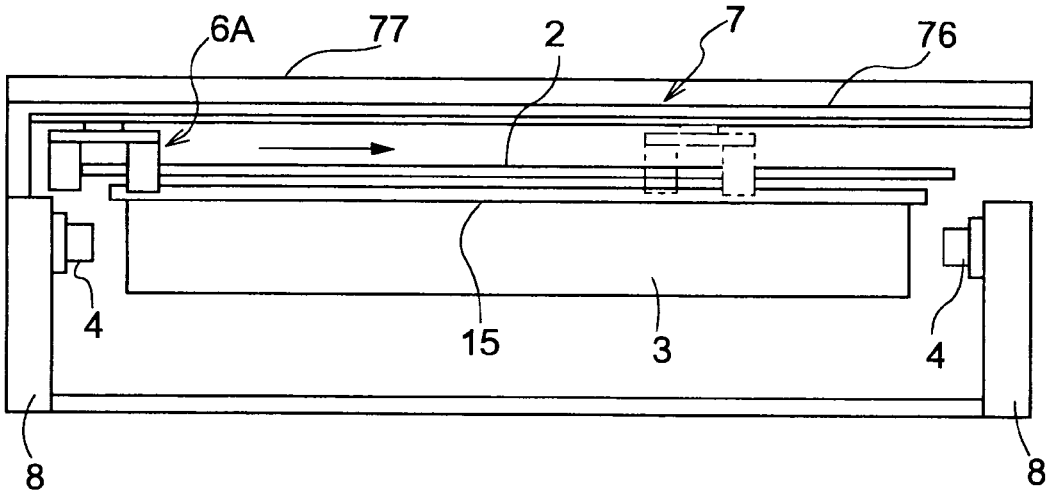
Figure 48:
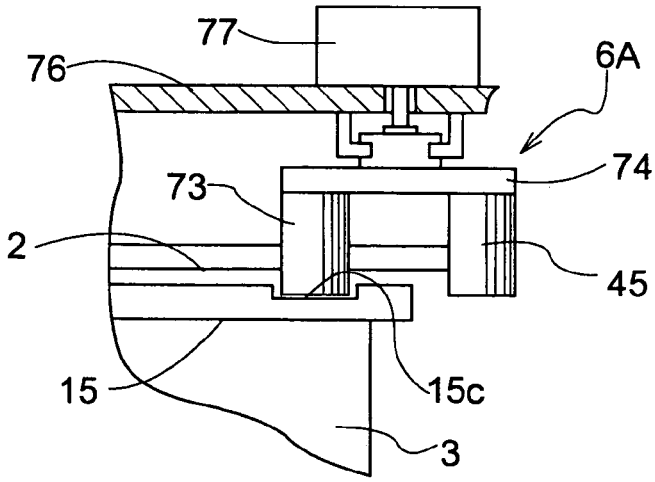
FIG. 48 is a diagram showing the height relationship between the auxiliary drive means and the air rectifying plate according to the other embodiment (7)

Using a case in which this is adopted for the fourth embodiment as an example, in FIG. 47, the casing member 7 is provided with a cover member 76 that covers the area above the air-supplying-type support means 3, and the auxiliary drive means 6A is supported on the cover member 76 in such a manner that it can be moved in the second transporting direction by a drive mechanism 77. As shown in FIG. 48, the auxiliary drive means 6A is provided with a main portion 74 that moves in the second transporting direction, the pressing members 73 supported on the main portion 74, restricting members 75 that are also supported on the main portion 74 and that are for restricting shifting of the position of the glass substrate 2 in the front-to-back direction by abutting against the front and back lateral surfaces of the glass substrate 2, and the drive mechanism 77 for moving the restricting members 75 in the second transporting direction.

As shown in FIG. 48, it is also possible to adopt a configuration in which recessed entry portions 15*c* formed in the second transporting direction are provided in the air rectifying plate 15 such that in the second transporting state the lower end of the pressing members 73 is positioned lower than the upper surface of the air rectifying plate 15, and when the auxiliary drive means 6A is moved in the second transporting direction it is moved with a portion of the pressing members 73 inside the recessed entry portions 15*c*, so as to reliably abut against the lateral surface on the transporting upstream side of the glass substrate that is supported by the air-supplying-type transporting means 3 in the second transporting state.

Figure 49:
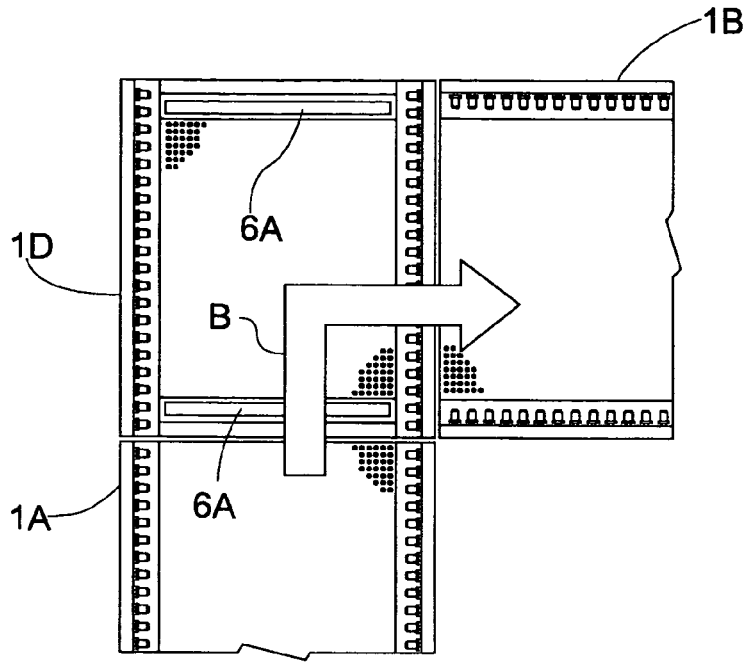
FIG. 49 is a plan view of the transporting apparatus according to the other embodiment (8)
Figure 50:
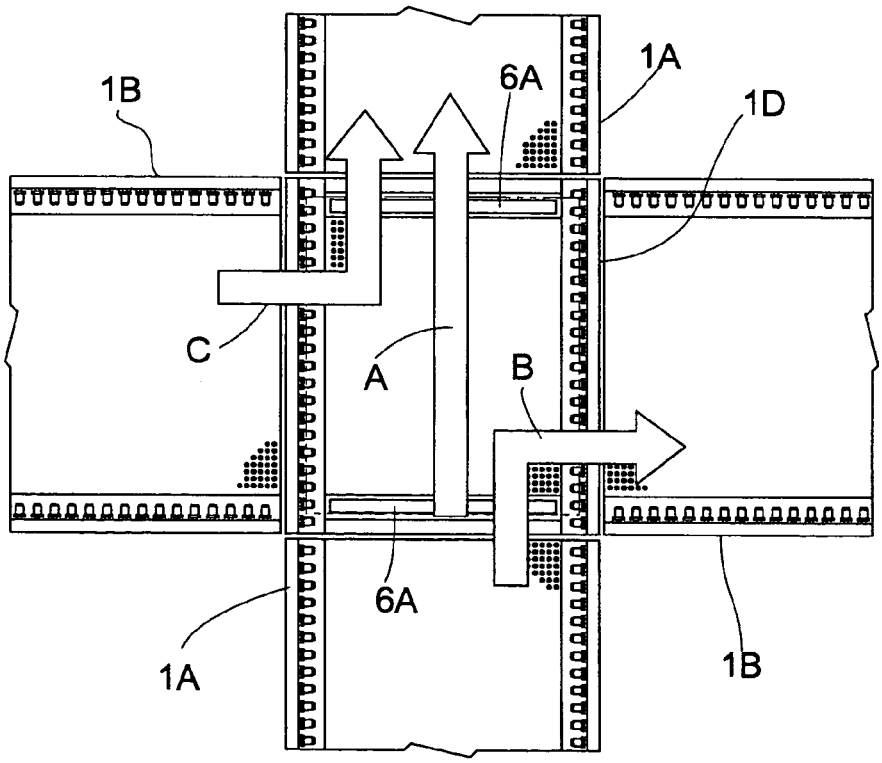
FIG. 50 is a plan view of the transporting apparatus according to the other embodiment (8)

(8) In the fourth and fifth embodiments, a first transport member 1A is provided on both the transporting upstream side and the transporting downstream side in the first transporting direction of the relay transport member 1D and the second transport member 1B is provided on one of either the transporting upstream side or the transporting downstream side in the second transporting direction of the relay transport member 1D, but this can be suitably changed, and as shown in FIG. 49, it is also possible to not provide a first transport member 1A on the transporting downstream side in the first transporting direction, and as shown in FIG. 50, it is also possible to provide a second transport member 1B on both the transporting upstream side and the transporting downstream side in the second transporting direction.

(9) In the fourth and fifth embodiments, the drive force application means 4 provided in the relay transport member 1D applies a drive force to move the glass substrate 2 forward in the first transporting direction, and the auxiliary drive means 6A applies a drive force to move the glass substrate 2 forward in the second transporting direction, but it is also possible to adopt a configuration in which the drive force application means 4 provided in the relay transport member 1D can apply drive force so as to move the glass substrate 2 forward and in reverse in the first transporting direction, and the auxiliary drive means 6A is capable of applying a drive force so as to move the glass substrate 2 forward and in reverse in the second transporting direction.

In other words, it is also possible to adopt a configuration in which, taking the fourth embodiment as an example, the glass substrate 2 can be transported in the directions opposite the directions indicated by the arrows A to C in FIG. 33. It is also possible to adopt a configuration in which it is possible to perform both branching transporting as shown by arrow B and merging transporting as shown by arrow C with a single relay transport member 1D.

(10) In the fourth and fifth embodiments, the relay transport member 1D is switched between the first transporting state and the second transporting state through a relative raising and lowering operation, in which one of the air-supplying-type support means 3 in the relay transport member 1D and the drive force application means 4 in the relay transport member 1D is raised or lowered, but it is also possible to adopt a configuration in which both the air-supplying-type support means 3 in the relay transport member 1D and the drive force application means 4 in the relay transport member 1D are raised or lowered to move them relative to one another and switch the relay transport member 1D between the first transporting state and the second transporting state.

(11) In the fifth embodiment, one of the drive force application portions 4*a* in the drive force application means 4 provided in the relay transport member 1D is capable of being raised and lowered, but it is also possible to adopt a configuration in which both of the pair of drive force application portions 4*a* can be raised and lowered.

(12) In the fourth embodiment, the auxiliary drive means 6A is provided with a timing belt 66, but it is also possible to provide it with a plurality of roller members.

(13) In the sixth embodiment, the first transport member 1A and the second transport member 1B are provided separately, but it is also possible to adopt a configuration in which a single transport portion can serve as both the first transport member and the second transport member.

Figure 58:
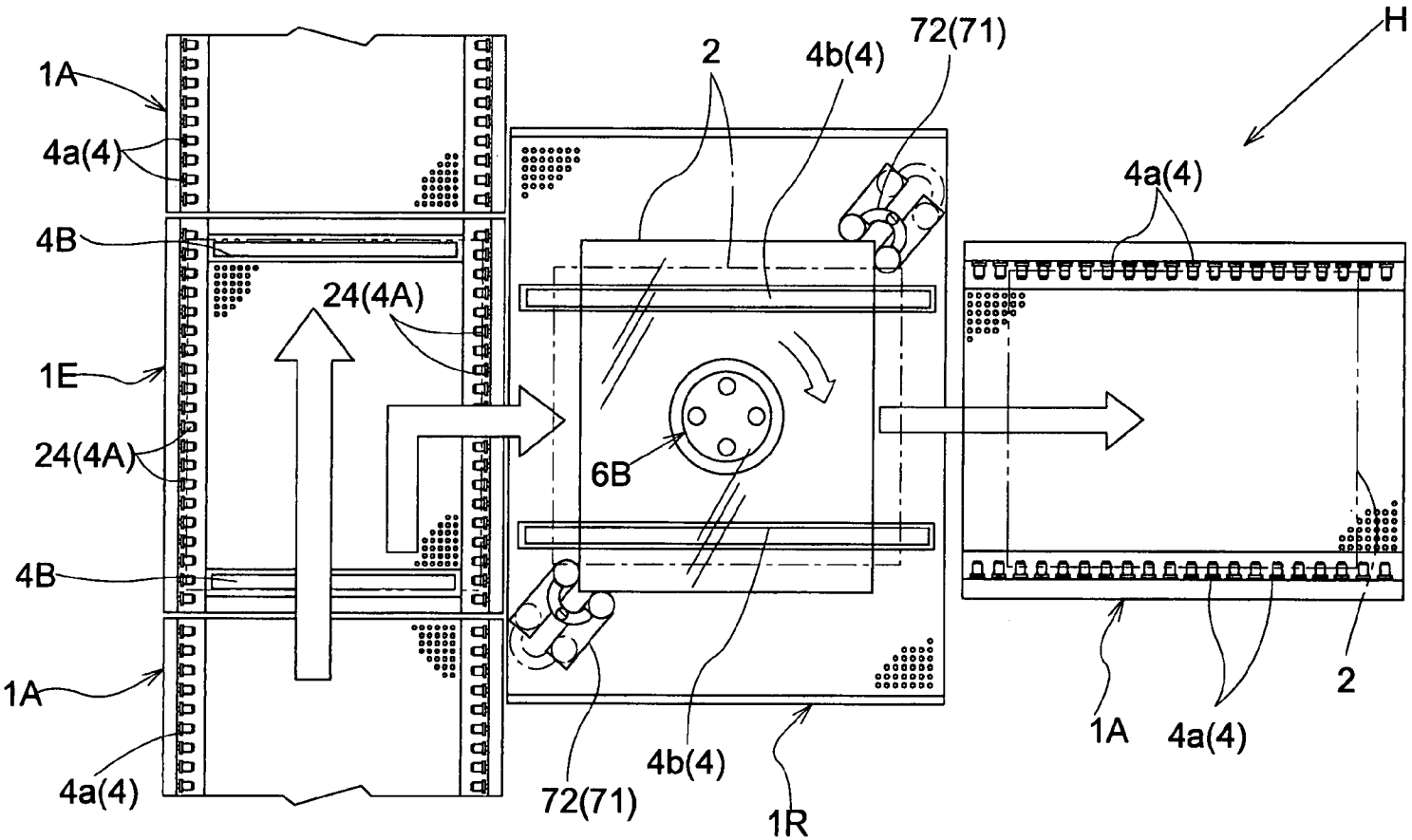
FIG. 58 is a plan view of the transporting apparatus according to the other embodiment (13)

That is, for example, as shown in FIG. 58, a dual-purpose transport portion 1E that functions as both a first transport member and a second transport member and transports the glass substrate 2 in the first transporting orientation and the second transporting orientation can also provided as a second transport member.

Figure 59:
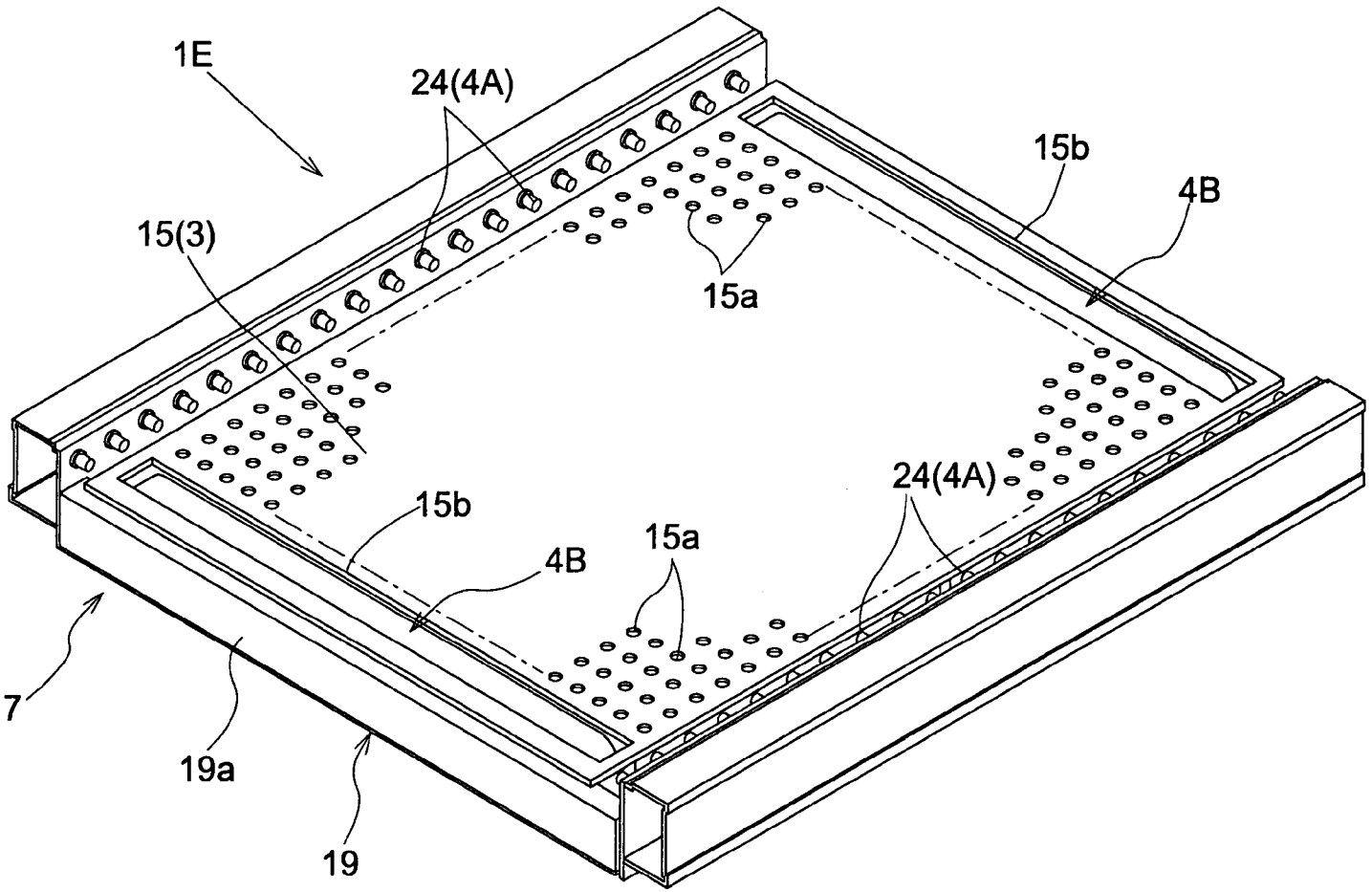
FIG. 59 is a perspective view of the dual-purpose transport portion according to the other embodiment (13)

The dual-purpose transport portion 1E is described below. As shown in FIG. 59, the dual-purpose transport portion 1E has the air-supplying-type support means 3 provided in the dual-purpose transport portion 1E, the drive force application means 4 provided in the dual-purpose transport portion 1E for applying a drive force in the transporting direction to the glass substrate 2, and the casing member 7 provided in the relay transport member 1R that accommodates the air-supplying-type support means 3 and the drive force application means 4. It should be noted that structural elements that are identical to those of other transport portions are assigned identical reference numerals and are omitted from the description.

The drive force application means provided in the dual-purpose transport portion 1E has a pair of first drive force application portions 4A for applying a drive force in the first transporting direction, which is the same direction as the first transport member 1A, to the glass substrate 2, and a pair of second drive force application portions 4B for applying a drive force in the second transporting direction, which is the same direction as the relay transport member 1R, to the glass substrate 2. The first drive force application portions 4A have the same structure as the roller-type drive force application portions 4*a*, and the second drive force application portions 4B have the same structure as the belt-shaped drive force application portions 4*b*.

Figure 60A:
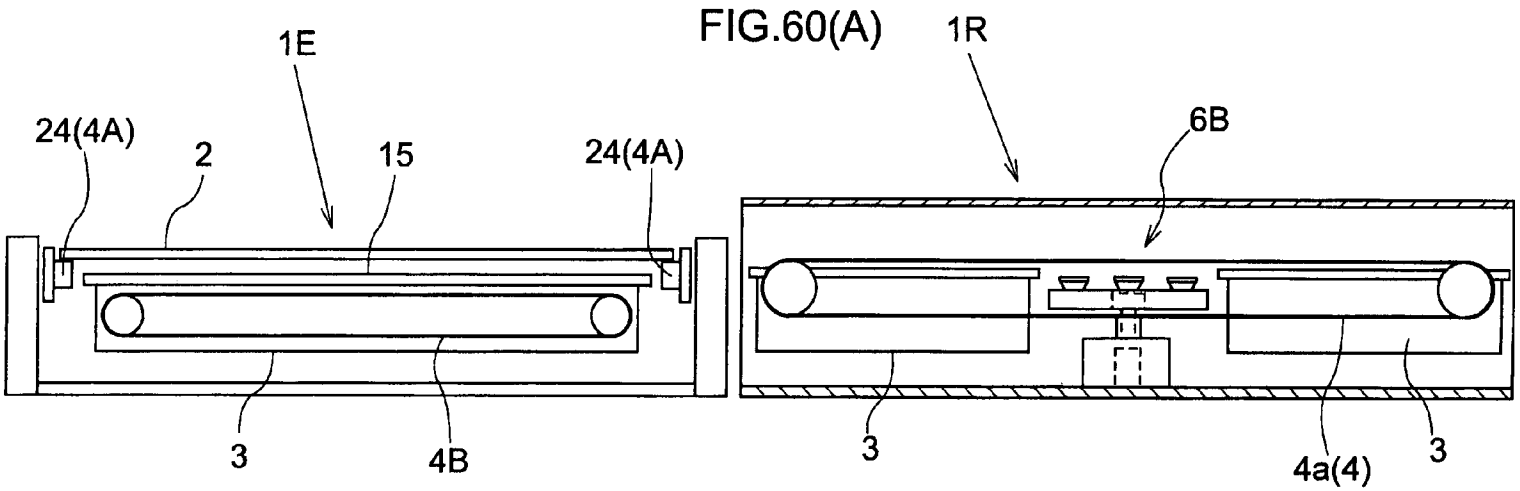
FIG. 60 is a front view showing the first transporting state and the second transporting state in the other embodiment (13)
Figure 60B:
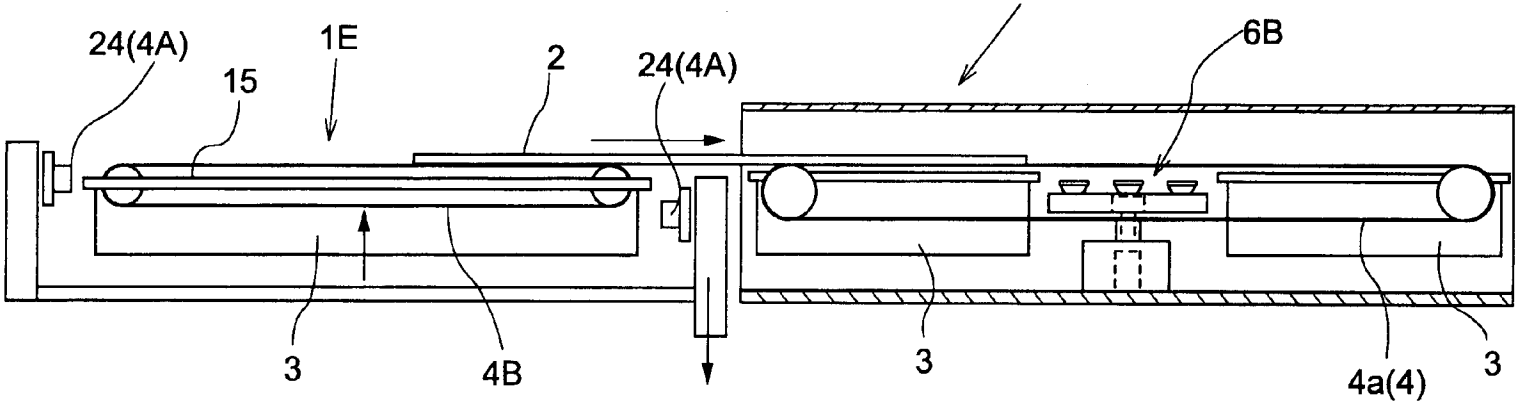

As shown in FIG. 60, the pair of first drive force application portions 4A are configured such that the first drive force application portion 4A on the downstream side in the second transporting direction can be raised and lowered, and the pair of second drive force application portions 4B are configured such that both can be raised and lowered.

As regards the dual-purpose transport portion 1E, one of the first drive force application portions 4A is raised up and both of the second drive force application portions 4B are lowered to attain a first transporting state, in which the lower surface 2*a* of the glass substrate 2, which is contactlessly supported by the air-supplying-type support means 3, is supported in a contacting manner by the pair of first drive force application portions 4A, so that the glass substrate 2 is delivered from the first transport member 1A on the transporting upstream side in, and the glass substrate 2 that has been delivered is then transported to the first transport member 1A on the transporting downstream side. One of the first drive force application portions 4A is lowered and both of the second drive force application portions 4B are raised up to attain a second transporting state, in which the lower surface 2*a* of the glass substrate 2, which is contactlessly supported by the air-supplying-type support means 3, is supported in a contacting manner by the pair of first drive force application portions 4B, so that the glass substrate 2 that is delivered is transported to the second transport member 1B on the transporting downstream side in.

Consequently, the dual-purpose transport portion 1E functions as a first transport member in the first transporting state and functions as a second transport member in the second transporting state.

(14) In the sixth embodiment, switching between the state for transporting and the state for rotation is transported out by raising and lowering the drive force application means 4, but it is also possible to transport out switching by raising and lowering the air-supplying-type support means 3 or by raising and lowering both the air-supplying-type support means 3 and the drive force application means 4.

(15) In the sixth embodiment, the relay transport member 1R is structured such that the glass substrate 2 is delivered from the first transport member 1A and the glass substrate 2 that is delivered is transported to the second transport member 1B, or such that the glass substrate 2 is delivered from a dual-purpose transport portion (second transport member) and the glass substrate 2 that has been delivered is transported to the first transport member 1A, but it is also possible to adopt a configuration in which both transporting modes can be performed.

Figure 67:
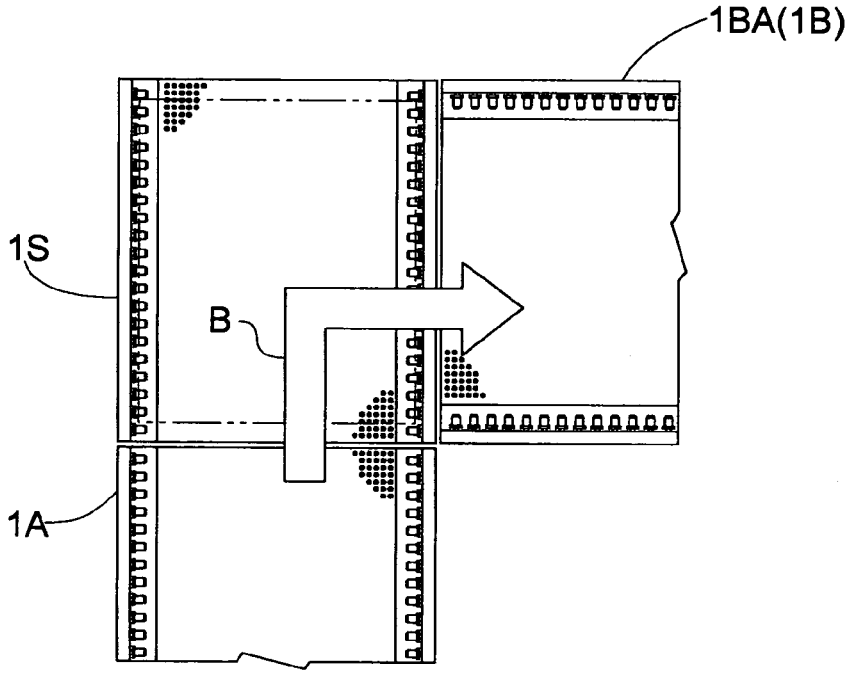
FIG. 67 is a plan view of the transporting apparatus according to the other embodiment (16)

(16) In the seventh embodiment, it is possible to perform a first transport and a branching transport, but as shown in FIG. 67 it is also possible to adopt a configuration in which only a branching transport can be performed.

Figure 68:
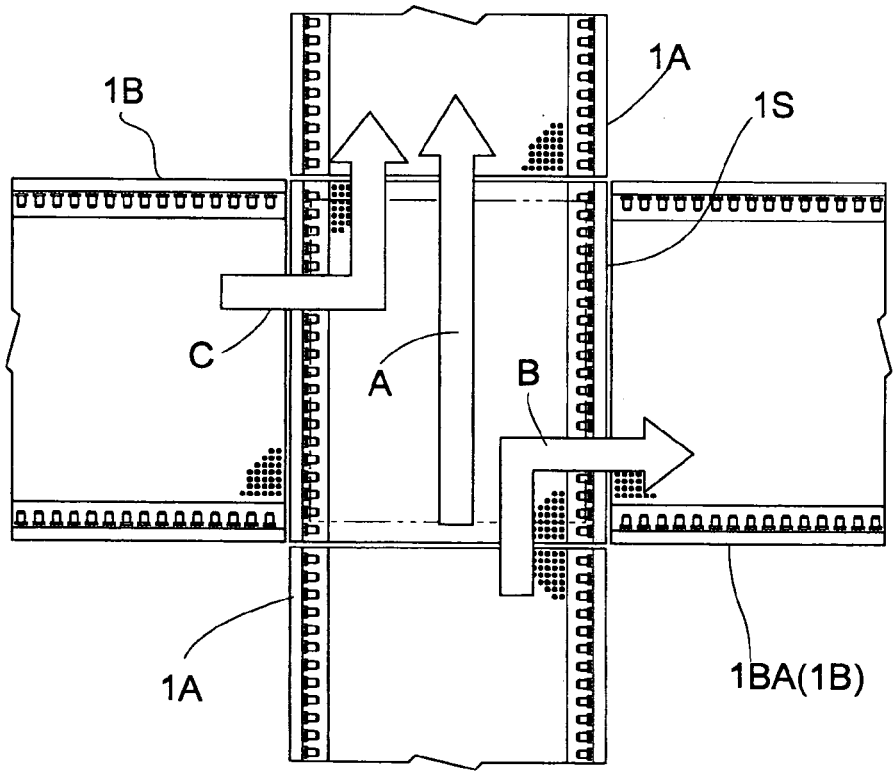
FIG. 68 is a plan view of the transporting apparatus according to the other embodiment (17).

(17) In the seventh embodiment, it is possible to perform a first transport and a branching transport, but it is also possible to adopt a configuration in which, in addition to a first transport and a branching transport, it is also possible to provide a second transport member 1B on both sides of the relay transport member 1S in the second transporting direction as shown in FIG. 68 and, as shown by arrow C, transport out a merging transport in which the glass substrate 2 is delivered from the second transport member 1B on the transporting upstream side and the glass substrate 2 that has been delivered is transported to the first transport member 1A on the transporting downstream side. In this case, that glass substrate 2 is delivered from the second transport member 1B to the relay transport member 1S by the transfer means 6C and the glass substrate 2 that has been delivered is transported to the first transport member 1A by the drive force application means 4 provided in the relay transport member 1A. It is also possible to adopt a configuration in which a second transport for transporting the glass substrate 2 of the second transport member 1B on the transporting upstream side to the second transport member 1B (second transport member for delivery 1BA) on the transporting downstream side over the relay transport member 1S with the transfer means 6C.

(18) In the seventh embodiment, the transfer means 6C is capable of rotating the glass substrate 2 that is adheringly held by a predetermined angle (90°) about a vertical axis during transportation from the relay transport member 1S to the second transport member 1B, but it is also possible to adopt a configuration in which the orientation of the glass substrate 2 with respect to the first transporting direction on the first transport member 1A and the orientation of the glass substrate 2 with respect to the second transporting direction on the second transport member 1B are the same orientation, allowing the transport portions to be employed for both orientations.

(19) In the seventh embodiment, the second transport member 1B is switched between a transporting state and a released state by raising and lowering the drive force application means 4 of the second transport member 1B, but it is also possible to adopt a configuration in which the second transport member 1B is switched between a transporting state and a retreated state by raising and lowering the air-supplying-type support means 3 in the second transport member 1B or by raising and lowering both the air-supplying-type support means 3 in the second transport member 1B and the drive force application means 4 in the second transport member 1B.

It is also possible for one or both of the air-supplying-type support means 3 and the drive force application means 4 of the relay transport member 1S, in addition to those of the second transport member 1B, to be raised and lowered so that the relay transport member 1S can be switched between a transporting state and a retreated state, and for the relay transport member 1S to be switched to the retreated state in advance when the adsorption pads 6Ca are pressed against the upper surface 2*b* of the glass substrate 2.

What is claimed is:

1. A transporting apparatus, comprising:

(A) a first transport member for transporting a transported object;

(B) a second transport member, different from the first transport member, for transporting the transported object;

(C) a relay transport member disposed at a position that links the first transport member and the second transport member;

(D) means for changing at least one of a transporting direction and a transporting orientation of the transported object received from one of the first transport member and the second transport member before the transported object is forwarded to the other of the first transport member and second transport member;

wherein each of the first transport member and second transport member has:

a) air-supplying-type support means for supplying purified air toward a lower surface of the transported object to contactlessly support the transported object;

b) drive force application means for applying a drive force in the respective transporting direction to the transported object by contacting the lower surface of the transported object that is supported by the air-supplying-type support means.

2. The transporting apparatus according to claim 1, wherein the first transport member transports the transported object in a first transporting direction, the second transport member transports the transported object in a second transporting direction, which intersects the first transporting direction, and the relay transport member changes the transporting direction of the transported object that is received from the first transport member from the first transporting direction to the second transporting direction and delivers the transported object to the second transport member; and wherein the means for changing is provided to the relay transport member, and the means for changing comprises a first drive force application portion configured for single-side driving that applies a drive force in the first transporting direction to a width end portion on the side away from the second transport member in the width direction, which is perpendicular to the first transporting direction, of the transported object, and a second drive force application portion configured for single-side driving that applies a drive force in the second transporting direction to a front-to-back end portion on the side away from the first transport member in a front-to-back direction, which is perpendicular to the second transporting direction, of the transported object, and changes the transporting direction of the transported object such that the transported object to which the drive force has been applied by the first drive force application portion to be transported in the first transporting direction is imparted with the drive force by the second drive force application portion to be transported in the second transporting direction.

3. The transporting apparatus according to claim 2, wherein the second drive force application portion is provided with a contact-type second drive portion for applying a drive force to support the lower surface of the transported object in a contacting manner, and can be raised and lowered between a support position for supporting the transported object in a contacting manner with the second drive portion and a retreated position in which the second drive force application portion is retreated downward so as to avoid contact between the transported object and the second drive portion.

4. The transporting apparatus according to claim 3, wherein the first drive force application portion can apply a drive force in a direction opposite the first transporting direction to the transported object, the second drive force application portion is capable of applying a drive force in a direction opposite the second transporting direction to the transported object, and the relay transport member is accordingly structured so as to change the transporting direction of the transported object received from the second transport member from the second transporting direction to the first transporting direction and deliver the transported object to the first transport member; and wherein the first drive force application is provided with a contact-type first drive portion for applying a drive force to support the lower surface of the transported object in a contacting manner, and can be raised and lowered between a support position for supporting the transported object in a contacting manner with the first drive portion and a retreated position in which the first drive force application portion is retreated downward so as to avoid contact between the transported object and the first drive portion.

5. The transporting apparatus according to claim 2, further comprising:

a first stop portion that abuts against a lateral surface, on the width one end side portion to which drive force is applied by the first drive force application portion, of the transported object to stop the transported object from moving in the width direction; and a second stop portion that abuts against a lateral surface, on the front-to-back one end portion side to which drive force is applied by the second drive force application portion, of the transported object to stop the transported object from moving in the front-to-back direction;

wherein the orientation of the air-supplying-type support means can be changed between a first transporting orientation in which the transported object is in a sloped orientation such that a width other end side in the width direction is positioned higher than the width one end side to which drive force is applied by the first drive force application portion, and a second transporting orientation in which the transported object is in a sloped orientation such that a front-to-back other end side in the front-to-back direction is positioned higher than the front-to-back one end side to which drive force is applied by the second drive force application portion.

6. The transporting apparatus according to claim 2, further comprising:

a first restricting portion that abuts against a lateral surface on a width other end portion side on the side opposite the width one end portion to which drive force is applied by the first drive force application portion of the transported object to restrict movement of the transported object in the width direction; and a second restricting portion that abuts against a lateral surface on a front-to-back other end portion side on the side opposite the front-to-back one end portion side to which drive force is applied by the second drive force application portion of the transported object to restrict movement of the transported object in the front-to-back direction;

wherein the position of the first restricting portion can be changed between an action position where it is positioned on the transport route of the transported object transported in the second transporting direction and abuts against the lateral surface on the width other end portion side, and a retreated position where it is retreated away from the transport route of the transported object transported in the second transporting direction; and wherein the position of the second restricting portion can be changed between an action position where it is positioned on the transport route of the transported object transported in the first transporting direction and abuts against the lateral surface on the front-to-back other end portion side, and a retreated position where it is retreated away from the transport route of the transported object transported in the first transporting direction.

7. The transporting apparatus according to claim 6, wherein the first restricting portion and the second restricting portion can be changed to the retreated position by lowering them from the action position; and wherein the air-supplying-type support means is provided with a recessed portion into which the first restricting portion and the second restricting portion enter when positioned in the retreated position.

8. The transporting apparatus according to claim 2, wherein the air-supplying-type support means has air-supplying units, each of which a dust removal filter for removing dust and air-supplying means for supplying purified air toward the lower surface of the transported object through the dust removal filter are incorporated into a single unit, and wherein said air-supplying units are lined up in the first transporting direction and the second transporting direction.

9. A transporting apparatus comprising:

a casing;

a blower fan supported on the casing;

a filter that is supported on the casing and that is disposed above the blower fan;

a porous plate that is supported on the casing and that is disposed above the filter;

first drive rollers located above the porous plate and lined up in a first direction, which are capable of abutting against a first edge of a transported object and are configured to provide a driving force to the transported object in the first direction; and second drive rollers located above the porous plate and lined up in a second direction, which are capable of abutting against a second edge that is different from the first edge of the transported object and are configured to provide driving force to the transported object in the second direction.

10. The transporting apparatus according to claim 9, wherein the first drive rollers are supported to a vertically extending frame in such a manner that the first drive rollers can move vertically with respect to the vertically extending frame.

11. The transporting apparatus according to claim 9, wherein the second drive rollers are supported to a vertically extending frame in such a manner that the second drive rollers can move vertically with respect to the vertically extending frame.

12. The transporting apparatus according to claim 9, wherein the first drive rollers and the second drive rollers are capable of rotating about horizontal axes.

13. The transporting apparatus according to claim 9, wherein a blowing force of the blower fan can be changed.

14. The transporting apparatus according to claim 9, further comprising:

a plurality of first restricting rollers lined up in the first direction with a set spacing between the first restricting rollers and the first drive rollers.

15. The transporting apparatus according to claim 14, wherein the position of the first restricting rollers can be altered vertically by an actuator.

16. The transporting apparatus according to claim 9, further comprising:

a plurality of second restricting rollers lined up in the second direction with a set spacing between the second restricting rollers and the second drive rollers.

17. The transporting apparatus according to claim 16, wherein the position of the second restricting rollers can be altered vertically by an actuator.

18. The transporting apparatus according to claim 9, wherein the blower fan and the filter are provided as a unit through a housing, constituting a fan filter unit.

19. The transporting apparatus according to claim 18, wherein the first drive rollers and the second drive rollers are provided in a relay transport member; and wherein the transporting apparatus further comprises a first transport member located on the upstream side of the relay transport member and a second transport member located on the downstream side of the relay transport member, and the first transport member and the second transport member each have fan filter units.

20. The transporting apparatus according to claim 1, wherein the first transport member transports the transported object in a first transporting direction, the second transport member transports the transported object in a second transporting direction, which intersects the first transporting direction, and the relay transport member transports the transported object in the first transporting direction to transport the transported object between the first transport member and the relay transport member, and transports the transported object in the second direction to transport the transported object between the relay transport member and the second transport member;

wherein the relay transport member is provided with the drive force application means and the air-supplying-type support means, and the drive force application means of the relay transport member is configured for dual-side driving and is provided with a pair of drive force application portions for supporting both end portions in a width direction, which perpendicularly intersects the first transporting direction, of the transported object in a contacting manner; and wherein the means for changing is provided in the relay transport member, and the means for changing is switched between a first transporting state in which the transported object is brought into contact with the drive force application means and a second transporting state in which the transported object is not in contact with the drive force application means, due to relative raising and lowering of the drive force application means with respect to the air-supplying-type support means, wherein the means for changing, in the first transporting state, transports the transported object between the first transport member and the relay transport member due to a drive force from the drive force application means, and further is provided with an auxiliary drive means for applying a drive force in the second transporting direction, and wherein, in the second transporting state, the means for changing transports the transported object between the relay transport member and the second transport member, thereby changing the transporting direction of the transported object.

21. The transporting apparatus according to claim 20, wherein the relay transport member is provided with the air-supplying-type support means at substantially the same height as the air-supplying-type support means provided in the first transport member and the air-supplying-type support means provided in the second transport member; and wherein the drive force application means of the relay transport member can be raised and lowered such that in the first transporting state, the drive force application means of the relay transport member is in an upper position located at substantially the same height as the drive force application means provided in the first transport member, and in the second transporting state, the drive force application means of the relay transport member is in a lower position where the drive force application means of the relay transport member is located lower than the drive force application means provided in the second transport member.

22. The transporting apparatus according to claim 20, wherein the drive force application means of the relay transport member is provided in a fixed manner at a height that is substantially the same height as the drive force application means provided in the first transport member and that is lower than the drive force application means provided in the second transport member; and wherein the air-supplying-type support means of the relay transport member can be raised and lowered such that in the first transporting state the air-supplying-type support means of the relay transport member is in a lower position where it supports the transported object at the same or at substantially the same height as supported by the air-supplying-type support means provided in the first transport member, and in the second transporting state, the air-supplying-type support means of the relay transport member is in an upper position where it supports the transported object at the same or at substantially the same height as supported by the air-supplying-type support means provided in the second transport member.

23. The transporting apparatus according to claim 20, wherein the auxiliary drive means is capable of raising and lowering drive rotors, which support the lower surface of a transported object in a contacting manner and apply a drive force thereto, so that in the second transporting state the lower surface of the transported object is supported in a contacting manner by the drive rotors, and in the first transporting state contacting support of the lower surface of the transported object is cancelled.

24. The transporting apparatus according to claim 20, wherein the auxiliary drive means is provided with a pressing member that applies a drive force in the second transporting direction to the transported object by moving in the second transporting direction while abutting against a lateral surface on a transporting upstream side in the transporting direction of the transported object.

25. The transporting apparatus according to claim 20, wherein the drive force application means provided in the relay transport member is capable of applying drive force so as to move the transported object forward and in reverse in the first transporting direction, and the auxiliary drive force is capable of applying drive force so as to move the transported object forward and in reverse in the second transporting direction.

26. The transporting apparatus according to claim 20, wherein the air-supplying-type support means has air-supplying units, each of which a dust removal filter for removing dust and air-supplying means for supplying purified air toward the lower surface of the transported object through the dust removal filter are incorporated into a single unit, and wherein said air-supplying units are lined up in the first transporting direction and the second transporting direction.

27. A transporting apparatus comprising:

a casing;

a blower fan supported on the casing;

a filter that is supported on the casing and that is disposed above the blower fan;

a porous plate that is supported on the casing and that is disposed above the filter;

rollers that are located above the porous plate and that are capable of moving a transported object in a first direction; and a belt unit that can be moved between an abutting position and a non-abutting position with respect to the transported object on the rollers, and that extends in a second direction that is different from the first direction to move the transported object in the second direction when in the abutting position.

28. The transporting apparatus according to claim 27, wherein the belt unit moves up and down through a slit provided in the porous plate.

29. The transporting apparatus according to claim 27, wherein the blower fan and the filter are provided as a unit through a housing, constituting a fan filter unit.

30. The transporting apparatus according to claim 1, wherein the first transport member transports the transported object in a first transporting orientation, the second transport member transports the transported object in a second transporting orientation that is rotated by a predetermined angle about a vertical axis from the first transporting orientation, and the relay transport member transports the transported object between itself the first transport member and the second transport member;

wherein the means for changing is provided in the relay transport member, and the means for changing switches between a state for transporting in which the transported object is brought into contact with the drive force application means and a state for rotation in which the transported object is not in contact with the drive force application means, due to relative raising and lowering of the drive force application means and the air-supplying-type support means provided in the relay transport member;

wherein in the state for transporting, the transported object is transported between the first transport member and the relay transport member, and between the relay transport member and the second transport member, due to drive force from the drive force application means; and wherein the means for changing comprises an orientation changing means for rotating the transported object about a vertical axis, the orientation changing means, in the state for rotation, can apply a rotation force to the transported object to switch the transported object between the first transporting orientation and the second transporting orientation.

31. The transporting apparatus according to claim 30, wherein the orientation changing means is provided with a suction portion, in such a manner that the suction portion can be rotated about a vertical axis and can be raised and lowered, the suction portion being able to adhere to the lower surface of the transported object whereby, in the state for rotation, the orientation changing means adheres to the transported object with the suction portion to rotate the transported object, and in the transporting state, releases contact between the suction portion and the transported object.

32. The transporting apparatus according to claim 30, wherein the relay transport member further comprises an orientation correcting means that abuts against a transported object from the side to correct the orientation of the transported object when it has shifted from the first transporting orientation or the second transporting orientation to the first transporting orientation or the second transporting orientation.

33. The transporting apparatus according to claim 30, wherein the air-supplying-type support means of the relay transport member is provided at substantially the same height as the air-supplying-type support means provided in the first transport member and the air-supplying-type support means provided in the second transport member; and wherein the drive force application means of the relay transport member can be raised and lowered such that in the first transporting state the drive force application means is in an upper position where the drive force application means of the relay transport member supports the transported object in a contacting manner at substantially the same height as the drive force application means provided in the first transport member and the drive force application means provided in the second transport member, and in the second transporting state, the drive force application means of the relay transport member is in a lower position where the drive force application means is located lower than the drive force application means provided in the first transport member and the drive force application means provided in the second transport member.

34. The transporting apparatus according to claim 30, wherein the air-supplying-type support means has air-supplying units, in which a dust removal filter for removing dust and air-supplying means for supplying purified air toward the lower surface of the transported object through the dust removal filter are incorporated into a single unit, and wherein the air-supplying units are lined up in the transporting direction.

35. A transporting apparatus comprising:

a casing;

a blower fan supported on the casing;

a filter that is supported on the casing and that is disposed above the blower fan;

a porous plate that is supported on the casing and that is disposed above the filter;

a belt unit that is positioned above the porous plate and that can move a transported object in a first direction; and a rotor movable between an abutting position and a non-abutting position with respect to the transported object on the belt unit and rotatable about a first axis whereby the rotor can change the attitude of the transported object.

36. The transporting apparatus according to claim 35, wherein the rotor has suctions on its upper surface.

37. The transporting apparatus according to claim 35, wherein the belt unit moves up and down through slits provided in the porous plate.

38. The transporting apparatus according to claim 35, wherein the blower fan and the filter are provided as a unit through a housing, constituting a fan filter unit.

39. The transporting apparatus according to claim 35, further comprising:

a pair of pressing portions adapted to abut against an edge of the transported object, and to move between an abutting position and a non-abutting position with respect to the transported object.

40. The transporting apparatus according to claim 39, wherein each of the pair of pressing portions is adapted to abut against one edge of the transported object and another edge that is adjacent to that edge.

41. The transporting apparatus according to claim 1, wherein the first transport member transports the transported object in a first transporting direction and the second transport member transports the transported object in a second transporting direction that intersects the first transporting direction;

wherein the drive force application means of the relay transport member delivers the transported object from the first transport member to the relay transport member; and wherein the means for changing has a transfer means that adheres to and holds an upper surface of the transported object that has arrived at the relay transport member and that is capable of raising and lowering the transported object and transfer the transported object in the second transporting direction, whereby the transfer means transfers the transported object to the second transport member.

42. The transporting apparatus according to claim 41, wherein the second transport member can be switched between a transporting state in which its drive force application means is in contact with the lower surface of the transported object that is supported by the air-supplying-type support means, and a retreated state in which its drive force application means is not in contact with the transported object that is supported by the air-supplying-type support means, through the relative raising and lowering of the drive force application means and the air-supplying-type support means provided therein.

43. The transporting apparatus according to claim 41, wherein the transfer means performs a merging transport, in which a transported object is delivered from the second transport member and the transported object that has been delivered is transported to the first transport member, by delivering the transported object from the second transport member to the relay transport member and transporting the transported object that has been delivered to the second transport member with the drive force application means of the relay transport member.

44. The transporting apparatus according to claim 41, wherein the relay transport member can be switched between a transporting state in which its drive force application means is in contact with the lower surface of the transported object that is supported by the air-supplying-type support means, and a retreated state in which its drive force application means is not in contact with the transported object that is supported by the air-supplying-type support means, through raising and lowering the drive force application means and the air-supplying-type support means provided therein relative to one another.

45. The transporting apparatus according to claim 41, wherein the air-supplying-type support means has air-supplying units, in which a dust removal filter for removing dust and air-supplying means for supplying purified air toward the lower surface of the transported object through the dust removal filter are incorporated into a single unit, and wherein said air-supplying units are lined up in the first transporting direction and the second transporting direction.

46. A transporting apparatus comprising:

a casing;

a blower fan supported on the casing;

a filter that is supported on the casing and that is disposed above the blower fan;

a porous plate that is supported on the casing and that is disposed above the filter;

a plurality of rollers that are located above the porous plate and that are capable of moving a transported object in a first direction; and a suction unit that can move vertically between an abutting position and a non-abutting position with respect to an upper surface of the transported object, and that can move in a second direction that is different from the first direction, wherein the suction unit in the abutting position lifts up the transported object with a suctioning force and moves the transported object in the second direction.

47. The transporting apparatus according to claim 46, wherein the suction unit can be moved in the second direction due to being supported on a rail.

48. The transporting apparatus according to claim 46, wherein the blower fan and the filter are provided as a unit through a housing, constituting a fan filter unit.

* * * * *